US012305266B2

(12) United States Patent
Kawata et al.

(10) Patent No.: US 12,305,266 B2
(45) Date of Patent: May 20, 2025

(54) HIGH-STRENGTH STEEL PLATE HAVING EXCELLENT FORMABILITY, TOUGHNESS AND WELDABILITY, AND PRODUCTION METHOD OF SAME

(71) Applicant: NIPPON STEEL CORPORATION, Tokyo (JP)

(72) Inventors: Hiroyuki Kawata, Tokyo (JP); Eisaku Sakurada, Tokyo (JP); Kohichi Sano, Tokyo (JP); Takafumi Yokoyama, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 930 days.

(21) Appl. No.: 17/312,853

(22) PCT Filed: Dec. 11, 2018

(86) PCT No.: PCT/JP2018/045547

§ 371 (c)(1),
(2) Date: Jun. 10, 2021

(87) PCT Pub. No.: WO2020/121417

PCT Pub. Date: Jun. 18, 2020

(65) Prior Publication Data

US 2021/0340653 A1 Nov. 4, 2021

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C23C 2/02*** | (2006.01) |
| ***C23C 2/06*** | (2006.01) |
| ***C23C 2/40*** | (2006.01) |

(52) U.S. Cl.

CPC ..... *C22C 38/58* (2013.01); *C21D 8/0205* (2013.01); *C21D 8/0226* (2013.01); *C21D 9/46* (2013.01); *C22C 38/001* (2013.01); *C22C 38/002* (2013.01); *C22C 38/005* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C23C 2/02* (2013.01); *C23C 2/0224* (2022.08); *C23C 2/06* (2013.01); *C23C 2/40* (2013.01); *C21D 2211/001* (2013.01); *C21D 2211/005* (2013.01); *C21D 2211/008* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 2013/0087254 | A1 | 4/2013 | Funakawa et al. | |
| 2014/0290807 | A1 * | 10/2014 | Goto | C22C 38/46 148/330 |
| 2019/0071757 | A1 * | 3/2019 | Murata | C22C 38/22 |

FOREIGN PATENT DOCUMENTS

| | | | | |
|---|---|---|---|---|
| JP | 2004-238679 | A | 8/2004 | |
| JP | 2004-323958 | A | 11/2004 | |
| JP | 2006-274318 | A | 10/2006 | |
| JP | 2008-297609 | A | 12/2008 | |
| JP | 2011-195956 | A | 10/2011 | |
| JP | 2011-225941 | A | 11/2011 | |
| JP | 2012-26032 | A | 2/2012 | |
| JP | 2013-181208 | A | 9/2013 | |
| WO | WO-2017169329 | A1 * | 10/2017 | C21D 11/005 |

OTHER PUBLICATIONS

Google Translate—Partial English machine translation of PCT/JP2018/045547 Dec. 11, 2018 (Year: 2024).*

Krauss, George. Steels—Processing, Structure, and Performance—7. Ferritic Microstructures. ASM International. pp. 101-118. (Year: 2005).*

* cited by examiner

*Primary Examiner* — Jophy S. Koshy

(74) *Attorney, Agent, or Firm* — Birch, Stewart, Kolasch & Birch, LLP

(57) ABSTRACT

A high-strength steel sheet excellent in formability, toughness and weldability has a chemical composition including: by mass %, C: 0.05 to 0.30%, Si: 2.50% or less, Mn: 0.50 to 3.50%, P: 0.100% or less, S: 0.0100% or less, Al: 0.001 to 2.500%, N: 0.0150% or less, O: 0.0050% or less, and the balance consisting of Fe and inevitable impurities. The high-strength steel sheet has a microstructure in a region from ⅛ t (t: sheet thickness) to ⅜ t (t: sheet thickness) from a steel sheet surface, the microstructure including: by volume %, acicular ferrite (3): 20% or more, and martensite (4): 10% or more, polygonal ferrite: 20% or less, residual austenite: 2.0% or less, and the martensite satisfies a formula (A), $$\sum_{i=1}^{5} \frac{d_i}{a_i^{1.5}} \leq 10.0 \quad \text{(A)}$$

29 Claims, 2 Drawing Sheets

HIGH-STRENGTH STEEL PLATE HAVING EXCELLENT FORMABILITY, TOUGHNESS AND WELDABILITY, AND PRODUCTION METHOD OF SAME

TECHNICAL FIELD

The present invention relates to a high-strength steel sheet excellent in formability, toughness and weldability, and a manufacturing method thereof.

BACKGROUND

In recent years, a high-strength steel sheet has been often used in an automobile for reducing a weight of a vehicle body to improve a fuel efficiency and reduce carbon dioxide emission, and absorbing collision energy in an event of collision to ensure protection and safety of a passenger. However, in general, when strength of a steel sheet is increased, the formability (ductility, hole expandability, etc.) decreases to cause the steel sheet to be difficult to process into a complicated shape. Since it is thus not easy to attain both strength and formability (e.g., ductility, hole expandability), various techniques have been proposed so far.

For instance, Patent Literature 1 discloses a technique of improving strength-elongation balance and strength-elongation flange balance in a high-strength steel sheet with tensile strength of 780 MPa or more by having a steel sheet structure include, by a space factor, ferrite in a range from 5 to 50%, residual austenite of 3% or less, and the balance being martensite (an average aspect ratio of 1.5 or more).

Patent Literature 2 discloses a technique of forming a composite structure including ferrite with an average crystal grain diameter of 10 μm or less, martensite of 20 volume % or more, and a second phase in a high-tensile hot-dip galvanized steel sheet, thereby improving corrosion resistance and secondary work brittleness resistance.

Patent Literatures 3 and 8 each disclose a technique of forming a metal structure of a steel sheet in a composite structure of ferrite (soft structure) and bainite (hard structure), thereby securing a high elongation even with a high strength.

Patent Literatures 4 discloses a technique of forming a composite structure in which, in a space factor, ferrite accounts for 5 to 30%, martensite accounts for 50 to 95%, ferrite has an average grain size of a 3-μm-or-less equivalent circle diameter, and martensite has an average grain size of a 6-μm-or-less equivalent circle diameter, thereby improving elongation and elongation flangeability in a high-strength steel sheet.

Patent Literatures 5 discloses a technique of attaining both strength and elongation at a phase interface at which a main phase is a precipitation strengthened ferrite precipitated by controlling a precipitation distribution by a precipitation phenomenon (interphase interfacial precipitation) that occurs mainly due to intergranular diffusion during transformation from austenite to ferrite.

Patent Literature 6 discloses a technique of forming a steel sheet structure in a ferrite single phase and strengthening ferrite with fine carbides, thereby attaining both strength and elongation.

Patent Literature 6 discloses a technique of attaining elongation and hole expandability by setting 50% or more of austenite grains having a required carbon concentration at an interface between austenite grains and ferrite phase, bainite phase, and martensite phase in a high-strength thin steel sheet.

In recent years, high-strength steel with a tensile strength of 590 to 1470 MPa has been used for some parts in order to reduce a weight of an automobile. However, in order to use the high-strength steel with the tensile strength of 590 MPa or more as a steel sheet for automobiles in more parts and achieve further weight reduction, not only formability (e.g., ductility and hole expansion)-strength balance but also a balance between formability and various properties (e.g., toughness and weldability) needs to be improved at the same time.

CITATION LIST

Patent Literature(s)

Patent Literature 1: JP2004-238679A
Patent Literature 2: JP2004-323958A
Patent Literature 3: JP2006-274318A
Patent Literature 4: JP2008-297609A
Patent Literature 5: JP2011-225941A
Patent Literature 6: JP2012-026032A
Patent Literature 7: JP2011-195956A
Patent Literature 8: JP2013-181208A

SUMMARY OF THE INVENTION

Problem(s) to be Solved by the Invention

In light of the demand of improving formability-various properties (e.g., toughness, weldability) balance in addition to improvement in formability-strength balance in a high-strength steel sheet with the tensile strength of 590 MPa or more, an object of the invention is to improve formability-strength-various properties (e.g., toughness, weldability) balance in a high-strength steel sheet (including a galvanized steel sheet, zinc-alloy plated steel sheet, galvannealed steel sheet, and galvannealed alloy steel sheet) with the tensile strength of 590 MPa or more, and to provide a high-strength steel sheet and a manufacturing method thereof to solve this problem.

Means for Solving the Problem(s)

The inventors have diligently studied a solution to the above problem. As a result, the inventors have found that (i) if a microstructure of a material steel sheet (steel sheet for heat treatment) is a lath structure, formation of an Mn-concentrated structure is inhibited in the microstructure, and a required heat treatment is performed, the steel sheet after the heat treatment can have an excellent formability-strength-various properties balance.

The invention has been made based on the above findings, and the gist thereof is as follows.

1. According to an aspect of the invention, a high-strength steel sheet excellent in formability, toughness, and weldability includes a chemical composition including: by mass %, C in a range from 0.05 to 0.30%, Si in a range from 2.50% or less, Mn in a range from 0.50 to 3.50%, P of 0.100% or less, S of 0.0100% or less, Al in a range from 0.001 to 2.000%, N of 0.0150% or less, O of 0.0050% or less, and the balance consisting of Fe and inevitable impurities, the steel sheet has a micro structure in a region from ⅛t (t: sheet thickness) to ⅜ t (t: sheet thickness) from a steel sheet surface, the micro structure including: by volume %, acicular ferrite of 20% or more; martensite of 10% or more; polygonal ferrite of 20% or less;

residual austenite of 2.0% or less; and 5% or less of a structure other than a structure including bainite and bainitic ferrite in addition to the above whole structure; and the martensite satisfies a formula (A) below.

[Numerical Formula 1]

$$\sum_{i=1}^{5} \frac{d_i}{a_i^{1.5}} \leq 10.0 \quad \text{(A)}$$

Herein, $d_i$ represents an equivalent circle $d_i$ameter [μm] of the i-th largest island-shaped martensite in the microstructure in a region of ⅛ t (t: sheet thickness) to ⅜ t (t: sheet thickness), and $a_i$ represents an aspect ratio of the i-th largest island-shaped martensite in the microstructure in the region of ⅛ t (t: sheet thickness) to ⅜ t (t: sheet thickness).

2. In the high-strength steel sheet excellent in formability, toughness, and weldability according to the above aspect of the invention, the chemical composition further includes: by mass %, in place of a part of Fe, one or more of Ti of 0.30% or less, Nb of 0.10% or less, and V of 1.00% or less.

3. In the high-strength steel sheet excellent in formability, toughness, and weldability according to the above aspect, the chemical composition further includes: by mass %, in place of a part of Fe, one or more of Cr of 2.00% or less, Ni of 2.00% or less, Cu of 2.00% or less, Mo of 1.00% or less, W of 1.00% or less, B of 0.0100% or less, Sn of 1.00% or less, and Sb of 0.20% or less.

4. In the high-strength steel sheet excellent in formability, toughness, and weldability according to the above aspect, the chemical composition further includes: by mass %, in place of a part of Fe, one or more of Ca, Ce, Mg, Zr, La, Hf, and REM at 0.0100% or less in total.

5. In the high-strength steel sheet excellent in formability, toughness, and weldability according to the above aspect, martensite of the microstructure includes, by volume %, 30% or more of tempered martensite where fine carbides having an average diameter 1.0 μm or less are precipitated with reference to the entire martensite.

6. In the high-strength steel sheet excellent in formability, toughness, and weldability according to the above aspect, the high-strength steel sheet includes a galvanized layer or a zinc alloy plated layer on one surface or both surfaces of the high-strength steel sheet.

7. In the high-strength steel sheet excellent in formability, toughness, and weldability according to the above aspect, the galvanized layer or the zinc alloy plated layer is an alloyed plated layer.

8. A method of manufacturing the high-strength steel sheet according to the above aspect includes:

subjecting a steel piece having the chemical composition according to any one of the above 1 to 4 to hot rolling, completing the hot rolling at a temperature in a range from 850 degrees C. to 1050 degrees C. to provide a steel sheet after the hot rolling;

cooling the steel sheet after the hot rolling from 850 degrees C. to 550 degrees C. at an average cooling rate of at least 30 degrees C. per second, winding the steel sheet at a temperature equal to or less than a Bs point that is a bainite transformation start point defined according to a formula below;

cooling the steel sheet after the hot rolling in a range from the Bs point to a point of (the Bs point−80) degrees C. under conditions satisfying a formula (1) below to provide a hot-rolled steel sheet;

subjecting or not subjecting the hot-rolled steel sheet to cold rolling at a rolling reduction of 10% or less to manufacture a steel sheet for heat treatment;

heating the steel sheet for heat treatment to a temperature in a range from (Ac1+25) degrees C. to an Ac3 point under conditions satisfying a formula (3) below for calculating by dividing an elapsed time in a temperature region from 700 degrees C. to an end point that is a lower one of a maximum heating temperature or (Ac3−20) degrees C. into 10 parts, and retaining the steel sheet for 150 seconds or less in a temperature region from the maximum heating temperature minus 10 degrees C. to the maximum heating temperature;

cooling the steel sheet from a heating retention temperature at an average cooling rate of at least 25 degrees C. per second in a temperature region from 700 degrees C. to 550 degrees C.; and cooling the steel sheet in a limited range satisfying formulae (4) and (5) for calculating by dividing a dwell time in a temperature region from a start point that is a lower one of 550 degrees C., and a Bs point to 300 degrees C. into 10 parts, Bs point (degrees C.)=611−33·[Mn]−17·[Cr]
−17·[Ni]−21·[Mo]−11·[Si]
+30·[Al]+(24·[Cr]+15·[Mo]
+5500·[B]+240·[Nb])/(8·[C])

[element]: mass % of each element.

[Numerical Formula 2]

$$\sum_{n=1}^{8} \Big\{ 5.37 \times 10^{-1} \cdot \Big( 10n + 925 - Bs - 57W_{Cr} - 78W_{Mn} - 39W_{Si} + 56W_{Al} - 41W_{Ni} - 1598\sqrt{W_B} \Big)^{2.5} \cdot \exp\left( \frac{1.44 \times 10^4}{10n - Bs - 278} \right) \cdot \exp(-5.5W_{Nb} - 2.0W_{Ti} - 0.2W_{Cr} - 1.1W_{Mo}) \cdot \Delta t(n)^{1/3} + 1.81 \times 10^1 \cdot (10n - 5)^{1.3} \cdot \exp\left( \frac{1.73 \times 10^4}{10n - Bs - 278} \right) \cdot \exp\left( -1.1W_{Mo} - 0.6W_{Cr} - 9.0\sqrt{W_B} \right) \cdot \Delta t(n)^{1/2} \Big\} \leq 1.50 \quad (1)$$

Bs: Bs point (degrees C.)

$W_M$: a composition of each element (mass %)

Δt(n): an elapsed time (second) from (Bs−10×(n−1)) degrees C. to (Bs−10×n) degrees C. between the cooling after the hot rolling, through winding, and cooling to 400 degrees C.

[Numerical Formula 3]

$$\sum_{n=1}^{10} 8.65 \times 10^2 \cdot (W_{Mn} + 0.51W_{Cr} + 0.51W_{Ni} - 0.64W_{Mo} - 0.33W_{Si} + 0.90W_{Al})^{0.5} \cdot f_\gamma(n)^{0.2} \cdot (1 - f_\gamma(n))^{1.8} \cdot \exp\left( -\frac{9.00 \times 10^3}{T(n) + 273} \right) \cdot \Delta t^{0.33} \leq 2.0 \quad (3)$$

Δt: one tenth (second) of the elapsed time, $W_M$: a composition of each element (mass %)

fγ(n): an average reverse transformation ratio in the n-th section

T(n): an average temperature in the n-th section

[Numerical Formula 4]

$$\sum_{n=1}^{10}\left\{1.39\times10^{1}\cdot(Bs-T(n))^{3}\cdot\exp\left(-\frac{1.44\times10^{4}}{T(n)+273}\right)\cdot\Delta t^{0.5}\right\}\leq1.0 \quad (4)$$

[Numerical Formula 5]

$$\sum_{n=1}^{10}\left\{1.56\times10^{2}\cdot\left(W_{Si}+0.9W_{Al}\cdot\left(\frac{T(n)}{550}\right)^{2}+0.3(W_{Cr}+W_{Mo})\cdot\frac{T(n)}{550}\right)\cdot\exp\left(-6.7\cdot\left(1-\frac{T(n)}{550}\right)\right)\cdot\left(\frac{T(n)-250}{300}\right)^{0.5}\cdot(Bs-T(n))^{3}\cdot\exp\left(-\frac{1.44\times10^{4}}{T(n)+273}\right)\cdot\Delta t^{0.5}\right\}\leq1.0 \quad (5)$$

Δt: one tenth (second) of the elapsed time

Bs: Bs point (degrees C.)

T(n): an average temperature (degrees C.) in the n-th section $W_M$: a composition of each element (mass %)

9. A method of manufacturing the high-strength steel sheet according to the above aspect includes:

subjecting a steel piece having the chemical composition according to any one of the above 1 to 4 to hot rolling, completing the hot rolling at a temperature in a range from 850 degrees C. to 1050 degrees C. to provide a steel sheet after the hot rolling;

cooling the steel sheet after the hot rolling from 850 degrees C. to 550 degrees C. at an average cooling rate of at least 30 degrees C. per second, winding the steel sheet at a temperature equal to or less than a Bs point that is a bainite transformation start point defined according to a formula below;

cooling the steel sheet from the Bs point to a point of (the Bs point−80) degrees C. under conditions satisfying a formula (1) below to provide a hot-rolled steel sheet;

subjecting or not subjecting the hot-rolled steel sheet to a first cold rolling to manufacture a steel sheet for intermediate heat treatment;

heating the steel sheet for intermediate heat treatment to a temperature equal to or more than (Ac3−20) degrees C. under conditions satisfying a formula (2) below for calculating by dividing an elapsed time in a temperature region from 700 degrees C. to (Ac3−20) degrees C. into 10 parts;

subsequently, cooling the steel sheet for intermediate heat treatment from the heating temperature at an average cooling rate of at least 30 degrees C. per second in a temperature region from 700 degrees C. to 550 degrees C., cooling the steel sheet for intermediate heat at the average cooling rate of at least 20 degrees C. per second in a temperature region from the Bs point to (Bs−80) degrees C., and leaving the steel sheet for intermediate heat from (Bs−80) degrees C. to Ms point for a dwell time of at most 1000 seconds and from the Ms point to (Ms−50) degrees C. at the average cooling rate of at most 100 degrees C. per second to manufacture an intermediate heat-treated steel sheet;

subjecting or not subjecting the cooled intermediate heat-treated steel sheet to a second cold rolling at a rolling reduction of 10% or less to manufacture a steel sheet for heat treatment;

heating the steel sheet for heat treatment to a temperature in a range from (Ac1+25) degrees C. to an Ac3 point under conditions satisfying a formula (3) below for calculating by dividing an elapsed time in a temperature region from 700 degrees C. to an end point that is a lower one of a maximum heating temperature or (Ac3−20) degrees C. into 10 parts, and retaining the steel sheet for heat treatment for 150 seconds or less in a temperature region from the maximum heating temperature minus 10 degrees C. to the maximum heating temperature; and cooling the steel sheet for heat treatment from a heating retention temperature at an average cooling rate of at least 25 degrees C. per second in a temperature region from 700 degrees C. to 550 degrees C., and cooling the steel sheet for heat treatment in a limited range satisfying formulae (4) and (5) for calculating by dividing a dwell time in a temperature region from a start point that is a lower one of 550 degrees C., and a Bs point to 300 degrees C. into 10 parts, Bs point (degrees C.)=611−33·[Mn]−17·[Cr]
−17·[Ni]−21·[Mo]−11·[Si]
+30·[Al]+(24·[Cr]+15·[Mo]
+5500·[B]+240·[Nb])/(8·[C])

[element]: mass % of each element.

[Numerical Formula 6]

$$\sum_{n=1}^{8}\left\{5.37\times10^{-1}\cdot\left(10n+925-Bs-57W_{Cr}-78W_{Mn}-39W_{Si}+56W_{Al}-41W_{Ni}-1598\sqrt{W_B}\right)^{2.5}\cdot\exp\left(\frac{1.44\times10^{4}}{10n-Bs-278}\right)\cdot\exp\left(-5.5W_{Nb}-2.0W_{Ti}-0.2W_{Cr}-1.1W_{Mo}\right)\cdot\Delta t(n)^{1/3}+1.81\times10^{1}\cdot(10n-5)^{1.3}\cdot\exp\left(\frac{1.73\times10^{4}}{10n-Bs-278}\right)\cdot\exp\left(-1.1W_{Mo}-0.6W_{Cr}-9.0\sqrt{W_B}\right)\cdot\Delta t(n)^{1/2}\right\}\leq1.50 \quad (1)$$

Bs: Bs point (degrees C.)

$W_M$: a composition of each element (mass %)

Δt(n): an elapsed time (second) from (Bs−10×(n−1)) degrees C. to (Bs−10×n) degrees C. between the cooling after the hot rolling, through winding, and cooling to 400 degrees C., Ms point (degrees C.)=561−474[C]−33·[Mn]
−17·[Cr]−17·[Ni]−21·[Mo]
−11·[Si]+30·[Al]

[element]: mass % of each element

[Numerical Formula 7]

$$\sum_{n=1}^{10} 5.92\times10^{2}\cdot f_{\gamma}(n)^{0.3}\cdot(1-f_{\gamma}(n))^{1.4}\cdot\exp\left(-\frac{9.00\times10^{3}}{T(n)+273}\right)\cdot\Delta t^{0.5}\leq 1.0 \quad (2)$$

Δt: one tenth (second) of the elapsed time $f_{\gamma}(n)$: an average reverse transformation ratio in the n-th section T(n): an average temperature in the n-th section

[Numerical Formula 8]

$$\sum_{n=1}^{10} 8.65\times10^{2}\cdot (W_{Mn}+0.51W_{Cr}+0.51W_{Ni}-0.64W_{Mo}-0.33W_{Si}+0.90W_{Al})^{0.5}\cdot f_{\gamma}(n)^{0.2}\cdot(1-f_{\gamma}(n))^{1.8}\cdot\exp\left(-\frac{9.00\times10^{3}}{T(n)+273}\right)\cdot\Delta t^{0.33}\leq 2.0 \quad (3)$$

Δt: one tenth (second) of the elapsed time, $W_M$: a composition of each element (mass %)

fγ(n): an average reverse transformation ratio in the n-th section

T(n): an average temperature in the n-th section

[Numerical Formula 9]

$$\sum_{n=1}^{10}\left\{1.39\times10^{1}\cdot(Bs-T(n))^{3}\cdot\exp\left(-\frac{1.44\times10^{4}}{T(n)+273}\right)\cdot\Delta t^{0.5}\right\}\leq 1.0 \quad (4)$$

[Numerical Formula 10]

$$\sum_{n=1}^{10}\left\{1.56\times10^{2}\cdot\left(W_{Si}+0.9W_{Al}\cdot\left(\frac{T(n)}{550}\right)^{2}+0.3(W_{Cr}+W_{Mo})\cdot\frac{T(n)}{550}\right)\cdot\exp\left(-6.7\cdot\left(1-\frac{T(n)}{550}\right)\right)\cdot\left(\frac{T(n)-250}{300}\right)^{0.5}\cdot(Bs-T(n))^{3}\cdot\exp\left(-\frac{1.44\times10^{4}}{T(n)+273}\right)\cdot\Delta t^{0.5}\right\}\leq 1.0 \quad (5)$$

Δt: one tenth (second) of the elapsed time

Bs: Bs point (degrees C.)

T(n): an average temperature (degrees C.) in the n-th section $W_M$: a composition of each element (mass %)

10. In the method according to the above aspect, the first cold rolling for the steel sheet for heat treatment is performed at the rolling reduction of 80% or less.

11. In the method according to the above aspect, the first cold rolling for the steel sheet for heat treatment is performed at the rolling reduction of more than 10%.

12. The method according to the above aspect further includes a tempering treatment of heating the steel sheet for heat treatment to a temperature in a range from 200 degrees C. to 600 degrees C., after cooling the steel sheet in a limited range satisfying formulae (4) and (5) for calculating by dividing a dwell time in a temperature region from a start point that is a lower one of 550 degrees C., and a Bs point to 300 degrees C. into 10 parts.

13. The method according to the above aspect further includes temper rolling at a rolling reduction of 2.0% or less before the tempering treatment.

14. The manufacturing method of the high-strength steel sheet according to the above aspect includes: immersing the steel sheet in a plating bath including zinc as a main component during dwelling in a range from 550 degrees C. to 300 degrees C. to form a galvanized layer or a zinc alloy plated layer on one surface or both surfaces of the steel sheet.

15. The manufacturing method of the high-strength steel sheet according to the above aspect includes: leaving the steel sheet dwelling in a range from 550 degrees C. to 300 degrees C., cooling the steel sheet to a room temperature, and subsequently forming a galvanized layer or a zinc alloy plated layer by electroplating on one surface or both surfaces of the steel sheet.

16. The manufacturing method of the high-strength steel sheet according to the above aspect includes: immersing the steel sheet in a plating bath including zinc as a main component during the tempering treatment to form a galvanized layer or a zinc alloy plated layer on one surface or both surfaces of the steel sheet.

17. The manufacturing method of the high-strength steel sheet according to the above aspect includes: subjecting the steel sheet to the tempering treatment, cooling the steel sheet to a room temperature, and subsequently forming a galvanized layer or zinc alloy plated layer by electroplating on one surface or both surfaces of the steel sheet.

18. The manufacturing method of the high-strength steel sheet according to the above aspect includes: immersing the steel sheet in a plating bath, subsequently while leaving the steel sheet dwelling from 300 degrees C. to 550 degrees C., heating the galvanized layer or the zinc alloy plated layer to a temperature in a range from 450 degrees C. to 550 degrees C. to perform an alloying treatment on the galvanized layer or the zinc alloy plated layer.

19. The manufacturing method of the high-strength steel sheet according to the above aspect includes: setting a heating temperature of the plated layer or the zinc alloy plated layer to a temperature in a range from 450 degrees C. to 550 degrees C. in the tempering treatment to perform an alloying treatment on the galvanized layer or the zinc alloy plated layer.

According to the above aspects of the invention, a high-strength steel sheet excellent in formability, toughness and weldability can be provided.

DESCRIPTION OF EMBODIMENT(S)

Figure 1:
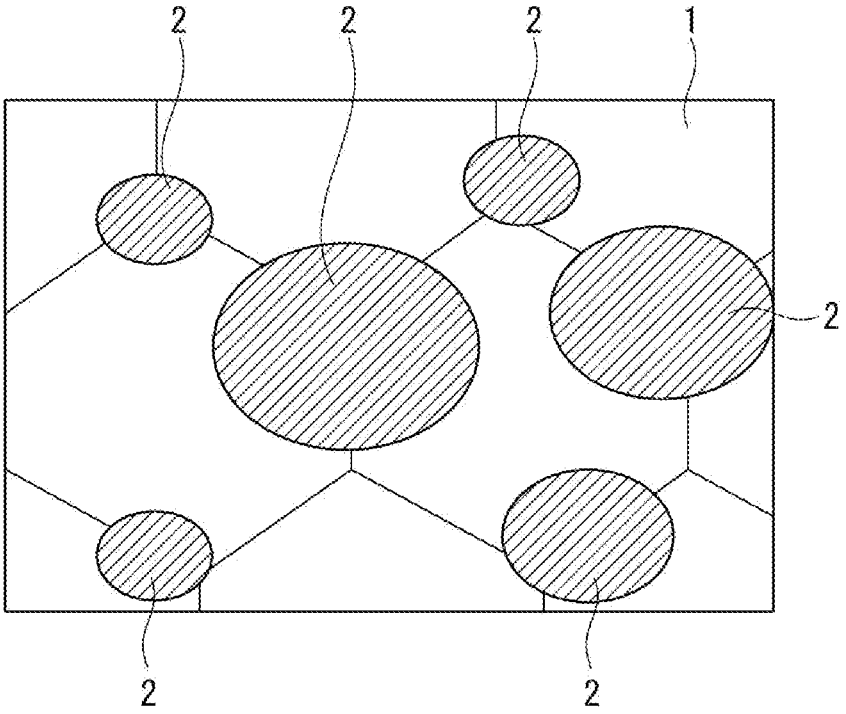
FIG. 1 schematically shows a structure of a typical high-strength steel sheet.

In order to manufacture a high-strength steel sheet having excellent toughness and weldability according to an exemplary embodiment of the invention, it is preferable to manufacture a steel sheet for heat treatment (hereinafter, occasionally referred to as a "steel sheet a") and heat the steel sheet for heat treatment. The steel sheet for heat treatment has a chemical composition including, by mass %, C in a range from 0.05 to 0.30%, Si of 2.50% or less, Mn in a range from 0.50 to 3.50%, P of 0.100% or less, S of 0.010% or less, Al in a range from 0.001 to 2.000%, N of 0.0150% or less, O of 0.0050% or less, and the balance consisting of Fe and inevitable impurities, and the steel sheet has a microstructure in a region from ⅛t (t: sheet thickness) to ⅜ t (t: sheet thickness) from a steel sheet surface, the microstructure including: by volume %, 80% or more of a lath structure formed of one or more of martensite or tempered martensite, bainite, and bainitic ferrite;

2.0% or less of an Mn-concentrated structure containing Mn of at least (Mn % of steel sheet)×1.50; and 2.0% or less of coarse aggregated residual austenite.

A high-strength steel sheet (hereinafter, occasionally referred to as "the present steel sheet A") excellent in formability, toughness, and weldability has a chemical composition including: by mass %, C in a range from 0.05 to 0.30%; Si of 2.50% or less; Mn in a range from 0.50 to 3.50%; P of 0.100% or less; S of 0.010% or less; Al in a range from 0.001 to 2.000%; N of 0.0150% or less; O of 0.0050% or less; and the balance consisting of Fe and inevitable impurities, and the steel sheet has a microstructure in a region from ⅛t (t: sheet thickness) to ⅜ t (t: sheet thickness) from a steel sheet surface, the microstructure including: by volume %, acicular ferrite of 20% or more, martensite of 10% or more, polygonal ferrite of 20% or less, residual austenite of 2.0% or less; and 5% or less of a structure other than a structure including bainite and bainitic ferrite in addition to the above whole structure, and the martensite satisfies a formula (A) below.

[Numerical Formula 11]

$$\sum_{i=1}^{5} \frac{d_i}{a_i^{1.5}} \leq 10.0 \tag{A}$$

Herein, $d_i$ represents an equivalent circle diameter [μm] of the i-th largest island-shaped martensite in the microstructure in a region of ⅛ t (t: sheet thickness) to ⅜ t (t: sheet thickness), and $a_i$ represents an aspect ratio of the i-th largest island-shaped martensite in the microstructure in the region of ⅛ t (t: sheet thickness) to ⅜t (t: sheet thickness).

A high-strength steel sheet excellent in formability, toughness, and weldability of the invention (hereinafter, occasionally referred to as "the present steel sheet A1") includes a galvanized layer or a zinc alloy plated layer on one surface or both surfaces of the steel sheet A.

In a high-strength steel sheet excellent in formability, toughness, and weldability of the invention (hereinafter, occasionally referred to as "the present steel sheet A2"), the galvanized layer or the zinc alloy plated layer on one surface or both surfaces of the present steel sheet A1 is an alloyed plated layer.

A method (hereinafter, occasionally referred to as "the manufacturing method a1") of manufacturing the above steel sheet for heat treatment (steel sheet a) includes: subjecting a steel piece having the chemical composition of the steel sheet a to hot rolling, completing the hot rolling at a temperature in a range from 850 degrees C. to 1050 degrees C. to provide a steel sheet after the hot rolling;

cooling the steel sheet after the hot rolling from 850 degrees C. to 550 degrees C., winding the steel sheet at a temperature equal to or less than a Bs point that is a bainite transformation start point defined according to a formula below, cooling the steel sheet in a range from the Bs point to a point of (the Bs point 80 degrees C.) under conditions satisfying a formula (1) below to provide a hot-rolled steel sheet, and subjecting or not subjecting the hot-rolled steel sheet to cold rolling with a rolling reduction of 10% or less, so that the steel sheet for heat treatment can be manufactured.

Bs point (degrees C.)=611−33·[Mn]−17·[Cr]
−17·[Ni]−21·[Mo]−11·[Si]
+30·[Al]+(24·[Cr]+15·[Mo]
+5500·[B]+240·[Nb])/(8·[C])

[element]: mass % of each element,

[Numerical Formula 12]

$$\sum_{n=1}^{8} \Big\{ 5.37 \times 10^{-1} \cdot \Big( 10n + 925 - Bs - 57W_{Cr} - 78W_{Mn} - 39W_{Si} + 56W_{Al} - 41W_{Ni} - 1598\sqrt{W_B} \Big)^{2.5} \cdot \exp\left( \frac{1.44 \times 10^4}{10n - Bs - 278} \right) \cdot \exp\left( -5.5W_{Nb} - 2.0W_{Ti} - 0.2W_{Cr} - 1.1W_{Mo} \right) \cdot \Delta t(n)^{1/3} + 1.81 \times 10^1 \cdot (10n - 5)^{1.3} \cdot \exp\left( \frac{1.73 \times 10^4}{10n - Bs - 278} \right) \cdot \exp\left( -1.1W_{Mo} - 0.6W_{Cr} - 9.0\sqrt{W_B} \right) \cdot \Delta t(n)^{1/2} \Big\} \leq 1.50 \tag{1}$$

In the formula (1), Bs represents the Bs point (degrees C.), $W_M$ represents a chemical composition (mass %) of each element, and Δt(n) represents an elapsed time (second) from (Bs−10×(n−1)) degrees C. to (Bs−10×n) degrees C. in a duration from cooling after hot rolling through winding to cooling to 400 degrees C.

The above-described steel sheet for heat treatment (steel sheet a) can be manufactured according to the following manufacturing method (hereinafter, occasionally referred to as a "manufacturing method a2" by using the hot-rolled steel sheet manufactured by the processes of the manufacturing method a1 as a hot-rolled steel sheet.

Specifically, the manufacturing method a2 includes: manufacturing the hot-rolled steel sheet manufactured by the processes of the manufacturing method a1, and subjecting or not subjecting the hot-rolled steel sheet to a first cold rolling to manufacture a steel sheet for intermediate heat treatment;

heating the steel sheet for intermediate heat treatment with the chemical composition of the steel sheet a up to a temperature equal to or more than (Ac3−20) degrees C. under conditions satisfying a formula (2) below, according to which an elapsed time in a temperature region from 700 degrees C. to (Ac3−20) degrees C. is divided into 10 parts, subsequently, cooling the steel sheet for intermediate heat treatment from the heating temperature at an average cooling rate of at least 30 degrees C. per second in a temperature region from 700 degrees C. to 550 degrees C., cooling the steel sheet for intermediate heat at the average cooling rate of at least 20 degrees C. per second in a temperature region from the Bs point to (Bs−80) degrees C., and leaving the steel sheet for intermediate heat from (Bs−80) degrees C. to an Ms point for a dwell time of at most 1000 seconds and from the Ms point to (Ms−50) degrees C. at the average cooling rate of at most 100 degrees C. per second, subjecting or not subjecting the cooled intermediate heat-treated steel sheet to a second cold rolling at a rolling reduction of 10% or less.

Bs point (degrees C.)=611−33·[Mn]−17·[Cr]
−17·[Ni]−21·[Mo]−11·[Si]
+30·[Al]+(24·[Cr]+15·[Mo]
+5500·[B]+240·[Nb])/(8·[C])

Ms point (degrees C.)=561−474[C]−33·[Mn]
−17·[Cr]−17·[Ni]−21·[Mo]
−11·[Si]+30·[Al]

[element]: mass % of each element

[Numerical Formula 13]

$$\sum_{n=1}^{10} 5.92\times10^{2}\cdot f_{\gamma}(n)^{0.3}\cdot(1-f_{\gamma}(n))^{1.4}\cdot\exp\left(-\frac{9.00\times10^{3}}{T(n)+273}\right)\cdot\Delta t^{0.5}\leq 1.0 \quad (2)$$

The above formula (2) is a calculation formula of dividing the elapsed time in a temperature region from 700 degrees C. to (Ac3-20) degrees C. in the heating process into 10 parts. Δt represents one tenth (second) of the elapsed time. $f_{\gamma}(n)$ represents an average reverse transformation ratio in the n-th section. T(n) represents an average temperature (degrees C.) in the n-th section.

A method of manufacturing the high-strength steel sheet (hereinafter, occasionally referred to as "the present manufacturing method A") excellent in formability, toughness, and weldability is a method of manufacturing the present steel sheet A.

The method includes: heating the steel sheet a (steel sheet for heat treatment) to a temperature in a range from (Ac1+25) degrees C. to an Ac3 point under conditions satisfying a formula (3) below for calculating by dividing an elapsed time in a temperature region from 700 degrees C. to an end point that is a lower one of a maximum heating temperature or (Ac3−20) degrees C. into 10 parts, and retaining the steel sheet for 150 seconds or less in a temperature region from the maximum heating temperature minus 10 degrees C. to the maximum heating temperature;

cooling the steel sheet from a heating retention temperature at an average cooling rate of at least 25 degrees C. per second in a temperature region from 700 degrees C. to 550 degrees C., and cooling the steel sheet in a limited range satisfying formulae (4) and (5) below for calculating by dividing a dwell time in a temperature region from a start point that is a lower one of 550 degrees C. or the Bs point to 300 degrees C. into 10 parts.

[Numerical Formula 14]

$$\sum_{n=1}^{10} 8.65\times10^{2}\cdot(W_{Mn}+0.51W_{Cr}+0.51W_{Ni}-0.64W_{Mo}-0.33W_{Si}+0.90W_{Al})^{0.5}\cdot f_{\gamma}(n)^{0.2}\cdot(1-f_{\gamma}(n))^{1.8}\cdot\exp\left(-\frac{9.00\times10^{3}}{T(n)+273}\right)\cdot\Delta t^{0.33}\leq 2.0 \quad (3)$$

The above formula (3) is a calculation formula of dividing the elapsed time in a temperature region from 700 degrees C. to an end point, that is, the lower one of the maximum heating temperature or (Ac3−20) degrees C. in the heating process into 10 parts. Δt represents one tenth (second) of the elapsed time. $W_{M}$ represents a composition (mass %) of each element species. $f_{\gamma}(n)$ represents an average reverse transformation ratio in the n-th section. T(n) represents an average temperature (degrees C.) in the n-th section.

[Numerical Formula 15]

$$\sum_{n=1}^{10}\left\{1.39\times10^{1}\cdot(Bs-T(n))^{3}\cdot\exp\left(-\frac{1.44\times10^{4}}{T(n)+273}\right)\cdot\Delta t^{0.5}\right\}\leq 1.0 \quad (4)$$

[Numerical Formula 16]

$$\sum_{n=1}^{10}\left\{1.56\times10^{2}\cdot\left(W_{Si}+0.9W_{Al}\cdot\left(\frac{T(n)}{550}\right)^{2}+0.3(W_{Cr}+W_{Mo})\cdot\frac{T(n)}{550}\right)\cdot\exp\left(-6.7\cdot\left(1-\frac{T(n)}{550}\right)\right)\cdot\left(\frac{T(n)-250}{300}\right)^{0.5}\cdot(Bs-T(n))^{3}\cdot\exp\left(-\frac{1.44\times10^{4}}{T(n)+273}\right)\cdot\Delta t^{0.5}\right\}\leq 1.0 \quad (5)$$

The formulae (4) and (5) are calculation formulae by dividing the dwell time in the temperature region from the lower one (i.e., start point) of 550 degrees C., and the Bs point to 300 degrees C. into 10 parts. Δt represents one tenth (second) of the elapsed time. Bs represents the Bs point (degrees C.). T(n) represents an average temperature (degrees C.) in each step. $W_{M}$ represents the composition (mass %) of each element.

A method of manufacturing the high-strength steel sheet (hereinafter, occasionally referred to as "the present manufacturing method Ala") excellent in formability, toughness, and weldability is a method of manufacturing the present steel sheet A1.

The present manufacturing method Ala includes: immersing the high-strength steel sheet excellent in formability, toughness, and weldability manufactured by the present manufacturing method A in a plating bath including zinc as a main component to form a galvanized layer or a zinc alloy plated layer on one surface or both surfaces of the high-strength steel sheet.

A method of manufacturing the high-strength steel sheet (hereinafter, occasionally referred to as "the present manufacturing method A1*b*") excellent in formability, toughness, and weldability is a method of manufacturing the present steel sheet A1.

The present manufacturing method Alb includes: forming a galvanized layer or a zinc alloy plated layer by electroplating on one surface or both surfaces of the high-strength steel sheet excellent in formability, toughness, and weldability manufactured by the present manufacturing method A.

A method of manufacturing the high-strength steel sheet (hereinafter, occasionally referred to as "the present manufacturing method A2") excellent in formability, toughness, and weldability is a method of manufacturing the present steel sheet A2.

The present manufacturing method A2 includes: heating the galvanized layer or the zinc alloy plated layer to a temperature in a range from 450 degrees C. to 550 degrees C. in the tempering treatment to perform an alloying treatment on the galvanized layer or the zinc alloy plated layer.

The steel sheet a and the manufacturing methods a1 and a2 thereof, and the present steel sheets A, A1 and A2 and the manufacturing methods A, Ala, Alb, and A2 thereof will be described.

Firstly, reasons for limiting a chemical composition of the steel sheet a and the present steel sheets A, A1, and A2 (hereinafter, occasionally collectively referred to as "the present steel sheet") will be described. % depicted with the chemical composition means mass %.

Chemical Composition

C is in a range from 0.05 to 0.30%.

C is an element contributing to improving strength and formability. Since an effect obtainable by adding C is not sufficient at less than 0.05% of C, C is defined to be 0.05% or more. C is preferably 0.07% or more, more preferably 0.10% or more.

On the other hand, since weldability is decreased at more than 0.30% of C, C is defined to be 0.30% or less. In order to secure a favorable spot weldability, C is preferably 0.25% or less, more preferably 0.20% or less.

Si is 2.50% or less.

Si is an element contributing to improving strength and formability by making iron carbides finer, however, also embrittling steel. Since a foundry slab becomes embrittled to be susceptible to cracking and weldability is decreased at more than 2.50% of Si, Si is defined to be 2.50% or less. In order to secure impact resistance, Si is preferably 2.20% or less, more preferably 2.00% or less.

When Si is decreased to less than 0.01%, inclusive of the lower limit of 0%, coarse iron carbides are formed during transformation of bainite, thereby decreasing strength and formability. Accordingly, Si is preferably 0.005% or more, more preferably 0.010% or more.

Mn is in a range from 0.50 to 3.50%.

Mn is an element contributing to improving strength by increasing hardenability. When Mn is less than 0.50%, a soft structure is formed during a cooling step of a heat treatment, which makes it difficult to secure a required strength. Accordingly, Mn is defined to be 0.50% or more, preferably 0.80% or more, more preferably 1.00% or more.

On the other hand, when Mn exceeds 5.00%, Mn concentrates on a central part of a foundry slab, so that the foundry slab becomes embrittled to be susceptible to cracking. Moreover, an Mn-concentrated structure of the microstructure of the steel sheet is formed to deteriorate mechanical characteristics. Accordingly, Mn is defined to be 5.00% or less. In order to secure favorable mechanical characteristics and spot weldability, Mn is preferably 3.50% or less, more preferably 3.00% or less.

P is 0.100% or less.

P is an element embrittling steel or embrittling a melted portion generated by spot melting. Since the foundry slab becomes embrittled to be susceptible to cracking at more than 0.100% of P, P is defined to be 0.100% or less. In order to secure a strength of the spot melted portion, P is preferably 0.040% or less, more preferably 0.020% or less.

When P is decreased to less than 0.0001%, inclusive of the lower limit of 0%, a production cost is significantly increased. Accordingly, 0.0001% is a substantive lower limit for a practical steel sheet.

S is 0.0100% or less.

S forms MnS and is an element inhibiting formability such as ductility, hole expandability, elongation flangeability, and bendability. Since formability is significantly deteriorated at more than 0.0100% of S, S is defined to be 0.010% or less. Since S lowers the strength of the spot melted portion to secure a favorable spot weldability, S is preferably 0.007% or less, more preferably 0.005% or less.

When S is decreased to less than 0.0001%, inclusive of the lower limit of 0%, a production cost is significantly increased. Accordingly, 0.0001% is a substantive lower limit for a practical steel sheet.

Al is in a range from 0.001 to 2.000%.

Al functions as a deoxidizing element, however, is also an element embrittling steel and inhibiting spot weldability. Since a sufficient deoxidizing effect cannot be obtained at less than 0.001% of Al, Al is defined to be 0.001% or more, preferably 0.100% or more, more preferably 0.200% or more.

However, when Al exceeds 2.000%, coarse oxides are formed, so that the foundry slab becomes susceptible to cracking. Accordingly, Al is defined to be 2.000% or less. In order to secure a favorable spot weldability, Al is preferably 1.500% or less.

N is 0.0150% or less.

N forms nitrides and is an element inhibiting formability such as ductility, hole expandability, elongation flangeability, and bendability. N is also an element causing generation of blowholes to inhibit weldability during a welding process. Since formability and weldability are deteriorated at more than 0.0150% of N, N is defined to be 0.0150% or less, preferably 0.0100% or less, more preferably 0.0060% or less.

When N is decreased to less than 0.0001%, inclusive of the lower limit of 0%, a production cost is significantly increased. Accordingly, 0.0001% is a substantive lower limit for the steel sheet in practical use.

O is 0.0050% or less.

O forms oxides and is an element inhibiting formability such as ductility, hole expandability, elongation flangeability, and bendability. Since formability is significantly deteriorated at more than 0.0050% of O, O is defined to be 0.0050% or less, preferably 0.0030% or less, more preferably 0.0020% or less.

When O is decreased to less than 0.0001%, inclusive of the lower limit of 0%, a production cost is significantly increased. Accordingly, 0.0001% is a substantive lower limit for the steel sheet in practical use.

The chemical composition of each of the steel sheet a and the present steel sheet may contain the following elements in addition to the above elements in order to improve properties.

Ti is 0.30% or less.

Ti is an element contributing to improving the steel sheet strength by strengthening by precipitates, strengthening by fine grains by inhibiting growth of ferrite crystal grains, and strengthening by dislocation by inhibiting recrystallization. Since a great amount of carbonitrides are precipitated to deteriorate formability at more than 0.30% of Ti, Ti is preferably 0.30% or less, more preferably 0.150% or less.

In order to obtain a sufficient strength-improving effect by Ti, although the lower limit is 0%, Ti is preferably 0.001% or more, more preferably 0.010% or more.

Nb is 0.10% or less.

Nb is an element contributing to improving the steel sheet strength by strengthening by precipitates, strengthening by fine grains by inhibiting growth of ferrite crystal grains, and strengthening by dislocation by inhibiting recrystallization. Since a great amount of carbonitrides are precipitated to deteriorate formability at more than 0.10% of Nb, Nb is preferably 0.10% or less, more preferably 0.06% or less.

In order to obtain a sufficient strength-improving effect by Nb, Nb is preferably 0.001% or more, more preferably 0.005% or more, although the lower limit is 0%.

V is 1.00% or less.

V is an element contributing to improving the steel sheet strength by strengthening by precipitates, strengthening by fine grains by inhibiting growth of ferrite crystal grains, and strengthening by dislocation by inhibiting recrystallization. Since a great amount of carbonitrides are precipitated to deteriorate formability at more than 1.00% of V, V is preferably 1.00% or less, more preferably 0.50% or less.

In order to obtain a sufficient strength-improving effect by V, V is preferably 0.001% or more, more preferably 0.010% or more, although the lower limit is 0%.

Cr is 2.00% or less.

Cr is an element contributing to improving the steel sheet strength by improving hardenability, and the element capable of partially substituting C and/or Mn. Since hot workability is deteriorated to lower productivity at more than 2.00% of Cr, Cr is preferably 2.00% or less, more preferably 1.20% or less.

In order to obtain a sufficient strength-improving effect by Cr, Cr is preferably 0.01% or more, more preferably 0.10% or more, although the lower limit is 0%.

Ni is 2.00%

Ni is an element contributing to improving the steel sheet strength by inhibiting phase transformation at a high temperature, and the element capable of partially substituting C and/or Mn. Since weldability is decreased at more than 2.00% of Ni, Ni is preferably 2.00% or less, more preferably 1.20% or less.

In order to obtain a sufficient strength-improving effect by Ni, Ni is preferably 0.01% or more, more preferably 0.10% or more, although the lower limit is 0%.

Cu is 2.00% or less.

Cu is an element contributing to improving the steel sheet strength by being present as fine grains in steel, and the element capable of partially substituting C and/or Mn. Since weldability is decreased at more than 2.00% of Cu, Cu is preferably 2.00% or less, more preferably 1.20% or less.

In order to obtain a sufficient strength-improving effect by Cu, Cu is preferably 0.01% or more, more preferably 0.10% or more, although the lower limit is 0%.

Mo is 1.00% or less.

Mo is an element contributing to improving the steel sheet strength by inhibiting phase transformation at a high temperature, and the element capable of partially substituting C and/or Mn. Since hot workability is deteriorated to lower productivity at more than 1.00% of Mo, Mo is preferably 1.00% or less, more preferably 0.50% or less.

In order to obtain a sufficient strength-improving effect by Mo, Mo is preferably 0.01% or more, more preferably 0.05% or more, although the lower limit is 0%.

W is 1.00% or less.

W is an element contributing to improving the steel sheet strength by inhibiting phase transformation at a high temperature, and the element capable of partially substituting C and/or Mn. Since hot workability is deteriorated to lower productivity at more than 1.00% of W, W is preferably 1.00% or less, more preferably 0.70% or less.

In order to obtain a sufficient strength-improving effect by W, W is preferably 0.01% or more, more preferably 0.10% or more, although the lower limit is 0%.

B is 0.0100% or less.

B is an element contributing to improving the steel sheet strength by inhibiting phase transformation at a high temperature, and the element capable of partially substituting C and/or Mn. Since hot workability is significantly deteriorated to lower productivity at more than 0.0100% of B, B is preferably 0.0100% or less, more preferably 0.005% or less.

In order to obtain a sufficient strength-improving effect by B, B is preferably 0.0001% or more, more preferably 0.0005% or more, although the lower limit is 0%.

Sn is 1.00% or less.

Sn is an element contributing to improving the steel sheet strength by inhibiting formation of coarse crystal grains. Since the steel sheet sometimes becomes embrittled to be cracked during a rolling process at Sn exceeding 1.00%, Sn is preferably 1.00% or less, more preferably 0.50% or less.

In order to obtain a sufficient effect by adding Sn, Sn is preferably 0.001% or more, more preferably 0.010% or more, although the lower limit is 0%.

Sb is 0.20% or less.

Sb is an element contributing to improving the steel sheet strength by inhibiting formation coarse crystal grains. Since the steel sheet sometimes becomes embrittled to be cracked during a rolling process at Sb exceeding 0.20%, Sb is preferably 0.20% or less, more preferably 0.10% or less.

In order to obtain a sufficient effect by adding Sb, Sb is preferably 0.001% or more, more preferably 0.005% or more, although the lower limit is 0%.

The chemical composition of each of the steel sheet a and the present steel sheet may contain one or more of Ca, Ce, Mg, Zr, La, Hf, and REM as needed.

One or more of Ca, Ce, Mg, Zr, La, Hf, and REM are 0.0100% or less in total.

Ca, Ce, Mg, Zr, La, Hf, and REM are elements contributing to improving formability. Since ductility may be deteriorated when one or more of Ca, Ce, Mg, Zr, La, Hf, and REM exceed 0.0100% in total, one or more of Ca, Ce, Mg, Zr, La, Hf, and REM in total are preferably 0.0100% or less, more preferably 0.0070% or less.

Although the lower limit of the total of one or more of Ca, Ce, Mg, Zr, La, Hf, and REM is 0%, the total is preferably 0.0001% or more, more preferably 0.0010% or more in order to obtain a sufficient effect of improving formability.

It should be noted that REM (Rare Earth Metal) means elements belonging to lanthanoid. Although REM and Ce are often added in a form of misch metal, lanthanoid elements may be inevitably contained other than La and Ce.

In the chemical composition of each of the steel sheet a and the present steel sheet, the balance except for the above elements is Fe and inevitable impurities. The inevitable impurities are elements inevitably mixed from a raw material for steel and/or during a steel production process. As the impurities, H, Na, Cl, Sc, Co, Zn, Ga, Ge, As, Se, Y, Zr, Tc, Ru, Rh, Pd, Ag, Cd, In, Sn, Sb, Te, Cs, Ta, Re, Os, Ir, Pt, Au, and Pb may be contained at 0.010% or less in total.

Next, the microstructure of each of the steel sheet a and the present steel sheet will be described.

Difference Between Structure of Typical High-Strength Steel Sheet and Structure of Present Steel Sheet A In a typical high-strength steel sheet, segregation of Mn progresses when the steel sheet after casting is subjected to a cooling step in a hot rolling process and a subsequent heat treatment.

As shown in FIG. 1, the structure of the high-strength steel sheet is formed such that coarse-aggregated martensite 2 formed by Mn segregation is formed in an polygonal ferrite 1, whereby a sufficient formability cannot be secured. Accordingly, in the typical high-strength steel sheet, formability is improved by utilizing austenite remaining in the structure.

In contrast, the present steel sheet A is different from the typical high-strength steel sheet in forming a structure, in which an Mn segregation portion is not formed, different from that of the typical high-strength steel sheet by controlling the cooling step in the hot rolling process, the heating step in the cold rolling process, and a temperature rise step in the heat treatment process.

Figure 2:
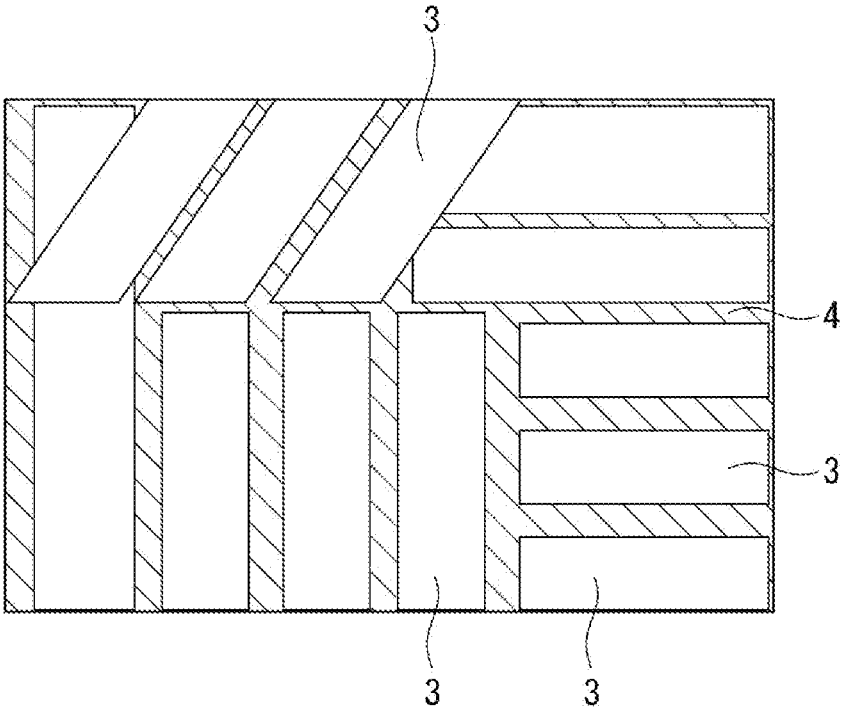
FIG. 2 schematically shows a structure of a high-strength steel sheet of the invention.

As shown in FIG. 2, the structure of the present steel sheet A is formed such that a structure of acicular ferrite 3 is formed and a martensite region 4 extends in the same direction as the acicular ferrite 3 so as to be interposed therebetween. In the structure of the present steel sheet A, coarse-aggregated martensite derived from Mn segregation is less contained. Thus, a balance between formability and strength is secured by preventing formation of a coarse hard structure and using residual austenite.

Region Defining Microstructure

A microstructure in a region from ⅛t (t: sheet thickness) to ⅜ t (t: sheet thickness) from the steel sheet surface, the region centering on ¼t (t: sheet thickness) from the steel sheet surface, typifies a microstructure of the entire steel sheet, and exhibits mechanical characteristics (e.g., formability, strength, ductility, toughness, and hole expandability) corresponding to those of the entire steel sheet. In the present steel sheets A, A1, and A2 (hereinafter, collectively referred to as "the present steel sheet A"), the microstructure in the region from ⅛t (t: sheet thickness) to ⅜ t (t: sheet thickness) from the steel sheet surface is defined.

In order that the microstructure in the region from ⅛t (t: sheet thickness) to ⅜t (t: sheet thickness) from the steel sheet surface in the present steel sheet A is made into a required microstructure by heat treatment, a microstructure in a region from ⅛t (t: sheet thickness) to ⅜ t (t: sheet thickness) from the steel sheet surface is defined same as above in the steel sheet a that is a material of the present steel sheet A.

Firstly, the microstructure in the region from ⅛t (t: sheet thickness) to ⅜t (t: sheet thickness) from the steel sheet surface (hereinafter, also referred to as "the microstructure a") is described. % depicted with the microstructure means volume %.

Microstructure a

80% or More of Lath Structure Including One or More of Martensite or Tempered Martensite, Bainite, and Bainitic Ferrite The microstructure a is defined as a structure including 80% or more of a lath structure including one or more of martensite or tempered martensite, bainite, and bainitic ferrite. At the lath structure of less than 80%, even when the steel sheet a is subjected to a required heat treatment, a required microstructure cannot be obtained and mechanical characteristics excellent in formability-strength balance cannot be obtained in the present steel sheet A. Accordingly, the lath structure is defined as 80% or more, preferably 90% or more. The lath structure may account for 100%.

An area fraction of the lath structure is obtained by: collecting a test piece from each of the present steel sheet A and the steel sheet a, the test piece having, as an observation surface, a sheet thickness cross section in parallel to a rolling direction of each of the present steel sheet A and the steel sheet a; polishing the observation surface of the test piece and subsequently polishing the observation surface to a mirror surface; and obtaining an area fraction of an area of at least $2.0\times10^{-8}$ $m^2$ in total in at least one view field in the region from ⅛t (t: sheet thickness) to ⅜t (t: sheet thickness) from a surface of the test piece in sheet thickness in accordance with Electron Back Scattering Diffraction (EBSD) using Field Emission Scanning Electron Microscope (FE-SEM).

This obtaining of the area fraction depends on an orientation difference that the lath structure has inside. Specifically, a measurement step is set at 0.2 μm, a local orientation difference in surroundings in each of measurement points is mapped by Kernel Average Misorientation (KAM) method, and a 15×15 cut mesh is used to obtain an area by a point counting method.

Since a crystal structure at each measurement point can be obtained by analysis by EBSD, distribution and form of residual austenite are also evaluated by EBSD analysis method using FE-SEM.

Specifically, the EBSD analysis is performed by: collecting a test piece from each of the present steel sheet A and the steel sheet a, the test piece having, as an observation surface, a sheet thickness cross section in parallel to a rolling direction of each of the present steel sheet A and the steel sheet a; polishing the observation surface of the test piece and subsequently removing a strain-affected layer by electrolytic polishing; and setting the measurement step at 0.2 μm in an area of at least an area of at least $2.0\times10^{-8}$ $m^2$ in total in at least one view field in the region from ⅛t (t: sheet thickness) to ⅜ t (t: sheet thickness) from a surface in sheet thickness.

A residual austenite map is made from data obtained after the measurement. Residual austenite with an equivalent circle diameter of more than 2.0 μm and an aspect ratio of less than 2.5 is extracted to obtain an area fraction.

If the microstructure a is a lath structure, the heat treatment produces fine austenite surrounded by ferrite having the same crystal orientation at a lath boundary and the austenite grows along the lath boundary. The unidirectionally elongated austenite grown along the lath boundary during the heat treatment becomes unidirectionally elongated martensite after the heat treatment, which greatly contributes to work hardening.

The lath structure of the steel sheet a is formed by appropriately adjusting the hot rolling conditions. Formation of the lath structure is described later.

An individual volume % of martensite, tempered martensite, bainite, and bainitic ferrite varies depending on the chemical composition, hot rolling conditions, and cooling conditions of the steel sheet. Although volume % is not particularly limited, but a preferable volume % is described.

Martensite becomes tempered martensite by the heat treatment of the steel sheet for heat treatment described later, and in combination with the existing tempered martensite formed before the heat treatment, contributes to the improvement of the formability-strength balance of the present steel sheet A. On the other hand, since lath martensite is very fine, as the amount of martensite increases, a ratio of unidirectionally elongated martensite present at the ferrite grain boundary increases, and formability is sometimes rather deteriorated. Accordingly, volume % of martensite in the lath structure is preferably 80% or less, more preferably 50% or less.

Tempered martensite is a structure greatly contributing to improving the formability-strength balance of the present steel sheet A. However, sometimes, coarse carbide are formed in the tempered martensite and become isotropic austenite during subsequent heat treatment. Accordingly, volume % of the tempered martensite in the lath structure is preferably 80% or less.

Bainite and bainitic ferrite each are a structure having an excellent formability-strength balance. However, sometimes, coarse carbide are formed in the bainite and become isotropic austenite during subsequent heat treatment. Accordingly, a volume fraction of bainite in the lath structure is preferably 50% or less, more preferably 20% or less.

In the microstructure a, other structures (e.g., pearlite, cementite, polygonal ferrite, and residual austenite) is set at less than 20%.

Since polygonal ferrite does not have austenite nucleation sites in crystal grains, the polygonal ferrite becomes ferrite including no austenite in the microstructure after the heat treatment and does not contribute to improving the strength.

Moreover, polygonal ferrite sometimes does not have a specific crystal orientation relationship with mother phase austenite. When the polygonal ferrite increases, austenite having a crystal orientation significantly different from that of the mother phase austenite is sometimes formed at a boundary between the polygonal ferrite and the mother phase austenite during the heat treatment. Newly formed austenites with different crystal orientations around the ferrite grow isotropically, which does not contribute to improving mechanical characteristics.

The residual austenite in the steel sheet a does not contribute to mechanical characteristics since a part of the residual austenite becomes isotropic during the heat treatment. Moreover, pearlite and cementite are transformed into austenite during the heat treatment and grow isotropically, which does not contribute to improving mechanical characteristics. Accordingly, other structures (e.g., pearlite, cementite, polygonal ferrite, and residual austenite) is set at less than 20%, preferably less than 10%.

In particular, coarse and isotropic residual austenite grows by heating in the heat treatment of the steel sheet for heat treatment to become coarse and isotropic austenite, and becomes coarse and isotropic island-shaped martensite in the subsequent cooling, so that toughness is deteriorated.

Therefore, the volume fraction of coarse aggregated residual austenite having an equivalent circle diameter of more than 2.0 μm and an aspect ratio of less than 2.5, which is a ratio of a long axis to a short axis, is limited to 2.0% or less. The smaller amount of the residual austenite is the better. The residual austenite is preferably 1.5% or less, more preferably 1.0% or less. The residual austenite may be 0.0%.

2.0% or less of an Mn-concentrated structure containing Mn of at least (Mn % of steel sheet a)×1.50

Even if an Mn-concentrated region in the microstructure is a lath structure, the Mn-concentrated region is preferentially reverse-transformed to austenite during heating in the heat treatment of the steel sheet for heat treatment, and the transformation is unlikely to proceed in the subsequent cooling. Accordingly, residual austenite is likely to be formed. If Mn is less than (Mn % of the steel sheet a)×1.50, it is difficult to form residual austenite, so the standard for Mn concentration is defined at (Mn % of the steel sheet a)×1.50.

In the microstructure a, when the Mn-concentrated structure containing Mn (Mn % of steel sheet a)×1.50 or more exceeds 2.0%, the volume % of the residual austenite exceeds 2.0% in the microstructure of the present steel sheet A. Accordingly, the Mn-concentrated structure in the microstructure a is restricted to 2.0% or less, preferably 1.5% or less, more preferably 1.0% or less.

Next, in the present steel sheet A obtained by applying the heat treatment to the steel sheet a, the microstructure (hereinafter, also referred to as "the microstructure A") in the region from ⅛t (t: sheet thickness) to ⅜ t (t: sheet thickness) from the steel sheet surface will be described. % depicted with the microstructure means volume %.

Microstructure A

The microstructure A is a structure mainly formed of acicular ferrite and martensite (including tempered martensite) in which polygonal ferrite is limited to 20% or less (including 0%) and residual austenite is limited to 2.0% or less (including 0%).

20% or More of Acicular Ferrite

When the lath structure of the microstructure a (one or more of martensite or tempered martensite, bainite, and bainitic ferrite: 80% or more) is subjected to the required heat treatment, the lath-shaped ferrite is united into acicular ferrite, and austenite grains unidirectionally elongated are formed at the crystal grain boundary.

Further, when the cooling treatment is performed under predetermined conditions, the austenite unidirectionally elongated becomes a martensite region unidirectionally elongated, thereby improving the formability-strength balance of the microstructure A.

When the volume fraction of the acicular ferrite is less than 20%, a sufficient effect cannot be obtained, an isotropic martensite region is significantly increased, and the formability-strength balance of the microstructure A is deteriorated. Accordingly, the volume fraction of the acicular ferrite is defined as 20% or more. In order to particularly improve the formability-strength balance, the volume fraction of the acicular ferrite is preferably 30% or more.

On the other hand, when the volume fraction of the acicular ferrite exceeds 90%, the volume fraction of martensite is decreased, so that the volume fraction of martensite cannot be made to 10% or more as described later and the strength is significantly lowered. Accordingly, the volume fraction of the acicular ferrite is 90% or less. In order to increase the strength, it is preferable to decrease the volume fraction of the acicular ferrite while increasing the volume fraction of martensite. From this viewpoint, the volume fraction of the acicular ferrite is preferably 75% or less, more preferably 60% or less.

10% or More of Martensite

Martensite is a structure of improving the steel sheet strength. When martensite is less than 10%, a required steel sheet strength cannot be secured in terms of the formability-strength balance. Accordingly, martensite is defined at 10% or more, preferably 20% or more.

On the other hand, when the volume fraction of martensite exceeds 80%, the volume fraction of acicular ferrite cannot arrive at 20% or more as described above to weaken restraint by ferrite, resulting in an isotropic form of the martensite region. Accordingly, the volume fraction of martensite is defined as 80% or less. In order to particularly improve the formability-strength balance, the volume fraction of acicular ferrite is preferably limited to 50% or less, more preferably 35% or less.

30% or More of Tempered Martensite with Precipitated Fine Carbides in Martensite When martensite is tempered martensite containing fine carbides, resistance of martensite to cracking is significantly improved, and further, martensite also has a sufficient strength, thereby improving the formability-strength balance. In order to obtain this effect, a ratio of tempered martensite containing fine carbides in martensite is preferably 30% or more. The larger ratio of the tempered martensite is preferable. The ratio is more preferably 50% or more and may be 100%.

However, when the tempering excessively proceeds and an average diameter of carbides in martensite exceeds 1.0 μm, the carbides act as a propagation path of crack and rather deteriorates the resistance to cracking.

When the average diameter of carbides is 1.0 μm or less, fracture toughness is not deteriorated, thereby exhibiting the effects of the invention. Since the strength of carbides is lowered when the carbides become large, the average diameter of the carbides is preferably 0.5 μm or less in order to attain both strength and toughness. Although the effects of the invention can be obtained without carbides, it is preferable that martensite contains fine carbides in terms of toughness.

The martensite can be obtained by heating the steel sheet a under predetermined conditions to generate austenite extending in one direction from the lath structure, and then cooling the steel sheet a under predetermined conditions to transform the austenite into martensite. The martensite has such an island-shaped structure that is divided by acicular ferrite and extends in one direction. Since the martensite extends in one direction, the concentration of strain becomes gentle and local cracking is less likely to occur, so that formability is improved.

On the other hand, since coarse and isotropic island-shaped martensite is easily cracked by strain applied, when a density of the martensite is high, brittle fracture at impact is likely to occur, a ductile brittle transition temperature rises significantly to deteriorate toughness.

In order to avoid deterioration of toughness, the size and form of the island-shaped martensite need to satisfy the following formula (A).

[Numerical Formula 17]

$$\sum_{i=1}^{5} \frac{d_i}{a_i^{1.5}} \leq 10.0 \quad \text{(A)}$$

Here, $d_i$ represents an equivalent circle diameter [μm] of the i-th largest island-shaped martensite in the microstructure in the region of ⅛ t (t: sheet thickness) to ⅜ t (t: sheet thickness), and $a_i$ represents an aspect ratio of the i-th largest island-shaped martensite in the microstructure in the region of ⅛ t (t: sheet thickness) to ⅜ t (t: sheet thickness). This formula is for evaluating the local cracking occurrence and the risk of connecting the cracks to each other, regarding the island-shaped martensite in which cracks occur preferentially in the initial stage of cracking occurrence and propagation of the cracks. Since initial cracking occurs only in coarse island-shaped martensite, the risk of the initial cracking only needs to be evaluated for relatively large island-shaped martensite. Specifically, in the observation of the microstructure in the exemplary embodiment of the invention, the risk may be evaluated up to the fifth largest island-shaped martensite.

As the size of the island-shaped martensite becomes larger and/or as the aspect ratio becomes smaller, that is, as the martensite is more equiaxed, the value in the left side of the formula becomes larger and toughness is deteriorated. When the value in the left side exceeds 10.0, predetermined characteristics are not exhibited.

As the density of coarse island-shaped martensite increases, the size of the second and subsequent island-shaped martensite increases, and the value on the left side of the formula (A) increases, so that brittle fracture is likely to occur.

As the value of the formula (A) is smaller, local cracking and connection are less likely to occur, and thus, a ductile brittle transition temperature is decreased to preferably improve toughness. A value of the left side of the formula (A) is preferably 7.5 or less, more preferably 5.0 or less.

When the equivalent circle diameter of the largest island-shaped martensite is 1.0 μm or less, all $d_i$ are 1.0 or less and the aspect ratio $a_i$ is always 1.0 or more. Accordingly, the left side of the formula (A) is always 5.0 or less. Therefore, the evaluation of the formula (A) may be omitted when the equivalent circle diameter of the largest island-shaped martensite is 1.0 μm or less.

20% or Less of Polygonal Ferrite

Polygonal ferrite is a structure that competes with acicular ferrite. Since acicular ferrite decreases as polygonal ferrite increases, the volume fraction of polygonal ferrite is limited to 20% or less. The smaller volume fraction of polygonal ferrite is preferable. The volume fraction thereof may be 0%.

2.0% or Less of Residual Austenite

Residual austenite transforms into extremely hard martensite upon impact and acts strongly as a propagation path for brittle fracture. When residual austenite exceeds 2.0%, the absorption energy at the time of brittle fracture is significantly reduced, the progress of fracture cannot be sufficiently suppressed, and toughness is significantly deteriorated. Therefore, residual austenite is defined at 2.0% or less. This is the characteristic of microstructure A. Volume % of residual austenite is preferably 1.6% or less, more preferably 1.2% or less, and may be 0.0%.

Balance: Inevitable Generation Phase

The balance of the microstructure A is bainite, bainitic ferrite and/or an inevitable generation phase. Bainite and bainitic ferrite are structures having an excellent balance between strength and formability, and may be contained in the microstructure as long as a sufficient amount of acicular ferrite and martensite are secured.

If a total of the volume fractions of bainite and bainitic ferrite exceeds 60%, the fraction of acicular ferrite and/or martensite may not be sufficiently obtained. Therefore, the total of the volume fractions of bainite and bainite is preferably 60% or less.

The inevitable generation phase in the balance structure of the microstructure A is pearlite, cementite and the like. As the amount of pearlite and/or cementite increases, ductility decreases and the formability-strength balance decreases. Therefore, the volume fraction of structure other than the above-mentioned all structures (pearlite and/or cementite, etc.) is preferably 5% or less.

By making the microstructure A mainly including the above-mentioned form of ferrite, martensite of 10% or more, and residual austenite of 2% or less, excellent toughness and excellent formability-strength balance can be attained. Therefore, the ductile-brittle transition temperature of the microstructure A reaches −40 degrees C. or less, and the absorption energy after the ductile-brittle transition is equal to or more than (the absorption energy before the ductile-brittle transition)×0.15.

In the above chemical composition, in the spot welded portion of the present steel sheet A having the microstructure A, a cross joint strength can achieve the tensile shear strength×0.25 or more. It is presumed that this is because the form of the microstructure at thermally affected portion at the welding point inherits the form of the acicular ferrite and martensite regions, and the fracture resistance of thermally affected portion is improved.

Here, a method of determining the volume fraction (volume %) of the structure will be described.

A test piece having a sheet thickness cross section parallel to the rolling direction of the steel sheet as the observation surface is collected from each of the present steel sheet A and the steel sheet for heat treatment (steel sheet a). A fraction of the lath structure is obtained by: polishing the observation surface of the test piece and subsequently applying Nital etching to the observation surface; observing an area of at least $2.0\times10^{-9}$ $m^2$ in total in at least one view field in the region from ⅛t (t: sheet thickness) to ⅜ t (t: sheet thickness) from a surface in sheet thickness using Field Emission Scanning Electron Microscope (FE-SEM); and analyzing an area fraction (area %) of each structure.

Since it is empirically known that the area fraction (area %)≈volume fraction (volume %), the area fraction is used as the volume fraction. The acicular ferrite in the microstructure A refers to ferrite having the aspect ratio of 3.0 or more, which is the ratio of the major axis to the minor axis of the crystal grains, in the observation by FE-SEM. Further, similarly, polygonal ferrite refers to ferrite having the aspect ratio of less than 3.0.

The volume fraction of residual austenite in the microstructure of the present steel sheet A is analyzed by X-ray diffraction. In the region from ⅛t (t: sheet thickness) to ⅜ t (t: sheet thickness) from the surface in the sheet thickness of the test piece, the surface parallel to the steel sheet surface is finished to be a mirror surface, and the area fraction of FCC iron is analyzed by X-ray diffraction method. The area fraction is used as the volume fraction of the residual austenite.

The diameter of the carbide contained in the tempered martensite is measured in the same view field as in the measurement of the structure fraction by FE-SEM. In at least one view field, the tempered martensite with a total area of at least $1.0\times10^{-10}$ $m^2$ is observed at a magnification of 20,000 times, the equivalent circle diameter is measured for any 30 carbides, and the simple average is regarded as the average diameter of carbides in tempered martensite in the material.

Fine carbides that cannot be detected at a magnification of 20,000 times are ignored in the derivation of the average diameter because such carbides do not act as a propagation path for brittle fracture. Specifically, carbides that are judged to have an equivalent circle diameter of less than 0.1 μm are ignored when calculating the average diameter of carbides.

The present steel sheet A may be a steel sheet having a galvanized layer or a zinc alloy plated layer on one or both surfaces of the steel sheet (the present steel sheet A1), or may be a steel sheet having an alloyed plated layer obtained by alloying the galvanized layer or the zinc alloy plated layer (the present steel sheet A2). Description will be made below.

Galvanized Layer and Zinc Alloy Plated Layer

The plated layer formed on one or both surfaces of the present steel sheet A is preferably a galvanized layer or a zinc alloy plated layer containing zinc as a main component. The zinc alloy plated layer preferably contains Ni as an alloy component.

The galvanized layer and the zinc alloy plated layer are formed by a hot-dip plating method or an electroplating method. When the Al amount of the galvanized layer increases, the adhesion between the steel sheet surface and the galvanized layer decreases. Therefore, the Al amount of the galvanized layer is preferably 0.5 mass % or less. When the galvanized layer is a hot-dip galvanized layer, an Fe amount of the hot-dip galvanized layer is preferably 3.0 mass % or less in order to improve the adhesion between the steel sheet surface and the galvanized layer.

When the galvanized layer is an electrogalvanized layer, an Fe amount of the electrogalvanized layer is preferably 5.0 mass % or less in order to improve corrosion resistance.

The galvanized layer and the zinc alloy plated layer may contain one or more of Ag, B, Be, Bi, Ca, Cd, Co, Cr, Cs, Cu, Ge, Hf, Zr, I, K, La, Li, Mg, Mn, Mo, Na, Nb, Ni, Pb, Rb, Sb, Si, Sn, Sr, Ta, Ti, V, W, Zr, and REM as long as corrosion resistance and formability are not inhibited. Especially, Ni, Al, and Mg are effective for improving corrosion resistance.

Alloyed Plated Layer

The galvanized layer or zinc alloy plated layer is subjected to the alloying treatment to form an alloyed plated layer on the steel sheet surface. When a hot-dip galvanized layer or hot-dip zinc alloy plated layer is subjected to the alloying treatment, an Fe amount of the hot-dip galvanized layer or hot-dip zinc alloy plated layer is preferably in a range from 7.0 to 13.0 mass % in order to improve adhesion between the steel sheet surface and the alloyed plated layer.

The sheet thickness of the present steel sheet A, which is not particularly limited to a specific range of the sheet thickness, is preferably in a range from 0.4 to 5.0 mm in consideration of applicability and productivity. When the sheet thickness is less than 0.4 mm, the shape of the steel sheet is difficult to keep flat and dimensional and shape accuracy is lowered. Accordingly, the sheet thickness is 0.4 mm or more, more preferably 0.8 mm or more.

On the other hand, when the sheet thickness exceeds 5.0 mm, it becomes difficult to control the heating conditions and the cooling conditions during the manufacturing process, and a homogeneous microstructure may not be obtained in the sheet thickness direction. Accordingly, the sheet thickness is preferably 5.0 mm or less, more preferably 4.5 mm or less.

Next, the manufacturing methods a1 and a2 of the steel sheet a, and the manufacturing methods A, Ala, Alb, and A2 of the invention will be described.

Firstly, the manufacturing method a1 and the manufacturing method a2 of the steel sheet for heat treatment (steel sheet a) that is a material of the present steel sheet A will be described.

The manufacturing method a1 includes:

subjecting a steel piece having the chemical composition of the steel sheet a to hot rolling, completing the hot rolling at a temperature in a range from 850 degrees C. to 1050 degrees C. to provide a steel sheet after the hot rolling, cooling the steel sheet after the hot rolling at an average cooling rate of at least 30 degrees C. per second in a range from 850 degrees C. to 550 degrees C., winding the steel sheet after the hot rolling at a temperature equal to or less than Bs point that is a bainite transformation start point defined according to a formula below, cooling the steel sheet in a range from the Bs point to a point of (the Bs point−80 degrees C.) under conditions satisfying a formula (1) below to provide a hot-rolled steel sheet, and subjecting or not subjecting the hot-rolled steel sheet to cold rolling with a rolling reduction of 10% or less, thereby providing a steel sheet for heat treatment.

Bs point (degrees C.)=611−33·[Mn]−17·[Cr]
−17·[Ni]−21·[Mo]−11·[Si]
+30·[Al]+(24·[Cr]+15·[Mo]
+5500·[B]+240·[Nb])/(8·[C])
[element]: mass % of each element

[Numerical Formula 18]

$$\sum_{n=1}^{g}\Big\{5.37\times10^{-1}\cdot\big(10n+925-Bs-57W_{Cr}-78W_{Mn}-39W_{Si}+56W_{Al}-41W_{Ni}-1598\sqrt{W_B}\big)^{2.5}\cdot\exp\left(\frac{1.44\times10^{4}}{10n-Bs-278}\right)\cdot\exp(-5.5W_{Nb}-2.0W_{Ti}-0.2W_{Cr}-1.1W_{Mo})\cdot\Delta t(n)^{1/3}+1.81\times10^{1}\cdot(10n-5)^{1.3}\cdot\exp\left(\frac{1.73\times10^{4}}{10n-Bs-278}\right)\cdot\exp\big(-1.1W_{Mo}-0.6W_{Cr}-9.0\sqrt{W_B}\big)\cdot\Delta t(n)^{1/2}\Big\}\leq1.50 \quad (1)$$

In the formula (1), Bs represents the Bs point (degrees C.), $W_M$ represents a chemical composition (mass %) of each element, and Δt(n) represents an elapsed time (second) from (Bs−10×(n−1)) degrees C. to (Bs−10×n) degrees C. in a duration from cooling after hot rolling through winding to cooling to 400 degrees C.

The manufacturing method a2 includes: subjecting or not subjecting the hot-rolled steel sheet manufactured by the same steps as those of the manufacturing steps of the hot-rolled steel sheet according to the above manufacturing method a1 to a first cold rolling to manufacture a steel sheet for intermediate heat treatment, heating the steel sheet for intermediate heat treatment with the chemical composition of the steel sheet a up to a temperature equal to or more than (Ac3−20) degrees C. at an average heating rate satisfying a formula (2) below, according to which an elapsed time in a temperature region from 700 degrees C. to (Ac3−20) degrees C. is divided into 10 parts, subsequently, cooling the steel sheet for intermediate heat treatment from the heating temperature at an average cooling rate of at least 30 degrees C. per second in a temperature region from 700 degrees C. to 550 degrees C., cooling the steel sheet at the average cooling rate of at least 20 degrees C. per second in a temperature region from the Bs point to (Bs−80) degrees C., leaving the steel sheet from (Bs−80) degrees C. to Ms point for a dwell time of at most 1000 seconds and from the Ms point to (Ms−50) degrees C. at the average cooling rate of at most 100 degrees C. per second (hereinafter, also referred to as the "intermediate heat treatment"), and subjecting or not subjecting the cooled intermediate-heated steel sheet to a second cold rolling at the rolling reduction of 10% or less, thereby manufacturing the steel sheet for heat treatment.

Bs point (degrees C.)=611−33·[Mn]−17·[Cr]
−17·[Ni]−21·[Mo]−11·[Si]
+30·[Al]+(24·[Cr]+15·[Mo]
+5500·[B]+240·[Nb])/(8·[C])
Ms point (degrees C.)=561−474[C]−33·[Mn]
−17·[Cr]−17·[Ni]−21·[Mo]
−11·[Si]+30·[Al]
[element]: mass % of each element

[Numerical Formula 19]

$$\sum_{n=1}^{10}5.92\times10^{2}\cdot f_{\gamma}(n)^{0.3}\cdot(1-f_{\gamma}(n))^{1.4}\cdot\exp\left(-\frac{9.00\times10^{3}}{T(n)+273}\right)\cdot\Delta t^{0.5}\leq1.0 \quad (2)$$

The above formula (2) is a calculation formula of dividing the elapsed time in a temperature region from 700 degrees C. to (Ac3-20) degrees C. in the heating process into 10 parts. Δt represents one tenth (second) of the elapsed time. $f_{\gamma}(n)$ represents an average reverse transformation ratio in the n-th section. T(n) represents an average temperature (degrees C.) in the n-th section.

Process conditions of the manufacturing method a1 will be described.

Hot Rolling

Molten steel having the chemical composition of the steel sheet a is cast according to a typical method such as continuous casting or thin slab casting to manufacture a steel piece intended for hot rolling. When the steel piece is once cooled to the room temperature and then subjected to hot rolling, the heating temperature is preferably in a range from 1080 degrees C. to 1300 degrees C.

When the heating temperature is less than 1080 degrees C., coarse inclusions due to casting do not melt and the hot-rolled steel sheet may crack in the process after hot rolling. Accordingly, the heating temperature is preferably 1080 degrees C. or more, more preferably 1150 degrees C. or more.

When the heating temperature exceeds 1300 degrees C., a large amount of heat energy is required. Accordingly, the heating temperature is preferably 1300 degrees C. or less, more preferably 1230 degrees C. or less. After casting the molten steel, the steel piece in the temperature region from 1080 degrees C. to 1300 degrees C. may be directly subjected to hot rolling.

Hot Rolling Completion Temperature: From 850 Degrees C. to 1050 Degrees C.

Hot rolling is completed at the temperature in a range from 850 degrees C. to 1050 degrees C. When the hot rolling completion temperature is less than 850 degrees C., a rolling reaction force increases and it becomes difficult to stably secure a dimensional accuracy of a shape and a sheet thickness. Therefore, the hot rolling completion temperature is defined as 850 degrees C. or more, preferably 870 degrees C. or more.

On the other hand, when the hot rolling completion temperature exceeds 1050 degrees C., a steel sheet-heating device is required, resulting in an increase in a rolling cost. Therefore, the hot rolling completion temperature is defined as 1050 degrees C. or less, more preferably 1000 degrees C. or less.

Average Cooling Rate From 850 Degrees C. To 550 Degrees C.: At Least 30 Degrees C. Per Second The steel sheet obtained after the completion of the hot rolling is cooled starting from 850 degrees C. to reach at most 550 degrees C. at the average cooling rate of at least 30 degrees C. per second. When the average cooling rate is less than 30 degrees C. per second, ferrite transformation proceeds and polygonal ferrite is formed not to obtain a sufficient lath structure in the steel sheet a. Therefore, the average cooling rate of the steel sheet, which is obtained after the hot rolling is completed, starting from 850 degrees C. to reach 550 degrees C. is defined as at least 30 degrees C. per second. In order to reduce the polygonal ferrite in the present steel sheet A, the average cooling rate in a range from 850 degrees C. to 550 degrees C. is preferably at least 40 degrees C. per second.

Winding Temperature: Equal to or Less than Bs Point

The steel sheet obtained after the hot rolling is cooled to at most 550 degrees C. at the average cooling rate of at least 30 degrees C. per second in a range from 850 degrees C. to 550 degrees C., and is wound at a temperature equal to or less than the Bs point that is a bainite transformation start point defined according to a formula below.

Bs point (degrees C.)=611−33·[Mn]−17·[Cr]
−17·[Ni]−21·[Mo]−11·[Si]
+30·[Al]+(24·[Cr]+15·[Mo]
+5500·[B]+240·[Nb])/(8·[C])

[element]: mass % of each element

When the steel sheet obtained after the hot rolling is wound at a temperature higher than the Bs point (degrees C.), ferrite transformation proceeds excessively during winding, and polygonal ferrite is formed to obtain no lath structure in the microstructure. Also, an Mn-concentrated structure is formed at exceeding 2.0 volume %. The winding temperature is preferably equal to or less than (Bs point−80) degrees C.

Temperature History from Bs Point to (Bs Point−80 Degrees C.): Formula (1)

During the period from cooling after hot rolling through winding to cooling, especially in the temperature region from the Bs point to (Bs point−80) degrees C., the bainite transformation tends to proceed locally from some austenite grain boundary, and diffusion of Mn atoms tends to proceed in the temperature region of 400 degrees C. or more. Accordingly, concentration of Mn in the hot-rolled steel sheet from the region where the transformation is completed tends to proceed to the untransformed austenite.

Since the bainite transformation proceeds locally in this hot-rolled steel sheet, untransformed austenite in which Mn is concentrated is also localized, and a part of the concentrated portion of Mn becomes coarse aggregated residual austenite.

The formula (1) represents a tendency of Mn concentration in the temperature region, and is a formula in empirically considering a progress rate of bainite transformation, a rate of Mn concentration, and the degree of uneven distribution of bainite. When the left side of the formula (1) exceeds 1.50, the phase transformation in the hot-rolled steel sheet progresses locally and excessively, and Mn concentration to untransformed austenite progresses excessively, so that the hot-rolled steel sheet has many Mn-concentrated parts and coarse aggregated residual austenite.

Therefore, the value of the formula (1) in the temperature region from the Bs point to (Bs point−80) degrees C. is limited to 1.50 or less. As the value of the formula (1) is smaller, it is more difficult for the Mn concentration to proceed. Therefore, the value of the formula (1) is preferably 1.20 or less, and more preferably 1.00 or less. In the temperature region below (Bs point−80) degrees C., the rate of progress of bainite transformation is sufficiently higher than the rate of Mn concentration, and the concentration of Mn in the untransformed part can be ignored. Moreover, since the bainite transformation also starts from a lot of austenite grain boundaries, the localization of untransformed austenite does not proceed in the hot-rolled steel sheet.

Winding may be performed at the temperature in a range from the Bs point to (Bs point−80 degrees C.). The temperature measurement at that time is performed as follows.

The temperature before winding is measured on the sheet surface at the center of the steel sheet from a vertical direction of the sheet surface. A radiation thermometer is used for the measurement. In the temperature history after winding, a point at the center of the ring-shaped circumferential cross section wound in a coil is defined as a representative point. The temperature history at this representative point is used.

When winding the coil, a contact-type temperature system (thermocouple) is wound around a position corresponding to the representative point, and direct measurement is performed.

Alternatively, heat transfer calculation may be performed to obtain the temperature history of the coil after winding at the representative point. In this case, a radiation thermometer and/or a contact-type temperature system is used for the measurement, and the temperature history on a lateral side and/or a surface of the coil is measured.

[Numerical Formula 20]

$$\sum_{n=1}^{g}\Big\{5.37\times10^{-1}\cdot\big(10n+925-Bs-57W_{Cr}-78W_{Mn}-39W_{Si}+56W_{Al}-41W_{Ni}-1598\sqrt{W_B}\big)^{2.5}\cdot\exp\left(\frac{1.44\times10^{4}}{10n-Bs-278}\right)\cdot\exp(-5.5W_{Nb}-2.0W_{Ti}-0.2W_{Cr}-1.1W_{Mo})\cdot\Delta t(n)^{1/3}+1.81\times10^{1}\cdot(10n-5)^{1.3}\cdot\exp\left(\frac{1.73\times10^{4}}{10n-Bs-278}\right)\cdot\exp\big(-1.1W_{Mo}-0.6W_{Cr}-9.0\sqrt{W_B}\big)\cdot\Delta t(n)^{1/2}\Big\}\leq1.50 \quad (1)$$

The above formula (1) is used for a calculation in the temperature region from the Bs point to (Bs point−80) degrees C. in a duration from cooling after hot rolling through winding to cooling. In the formula (1), Bs represents the Bs point (degrees C.), $W_M$ represents the composition (mass %) of each element, and Δt(n) represents the elapsed time (seconds) from (Bs−10×(n−1)) degrees C. to (Bs−10×n) degrees C. 1 to 8 are assigned for n in the calculation. However, since the diffusion rate of Mn is low and the concentration of Mn does not proceed in the temperature region of 400 degrees C. or less, the calculation using the subsequent n is not included in the total when (Bs−10×n) degrees C. is below 400 degrees C. For instance, when Bs is 455 degrees C., the formula (1) indicates the total of the calculation using from n=1 to n=6.

As the cooling rate in the temperature region from the Bs point to (Bs point−80) degrees C. is higher, the value of the formula (1) becomes smaller, thereby inhibiting the concentration of Mn. However, when the steel sheet wound in a coil is cooled rapidly, the shape of the steel sheet collapses, making it difficult to temper and pickle the steel sheet. Accordingly, the average cooling rate after winding the steel sheet in a coil is preferably equal to or less than 10 degrees C. per second. From the viewpoint of the shape of the steel sheet, it is preferable to allow the coil after winding to cool as long as the formula (1) can be satisfied.

In particular, when the above formula (1) is not satisfied in the cooling process in the temperature region from the Bs point to (Bs point−80) degrees C., the bainite transformation starts locally from some austenite grain boundaries and aggregated untransformed austenite remains in the steel sheet a, resulting in aggregated residual austenite. The value of the formula (1) in the temperature region is preferably 1.20 or less, and more preferably 1.00 or less.

Tempering of Hot-Rolled Steel Sheet

Since the wound hot-rolled steel sheet has high strength, the hot-rolled steel sheet may be subjected to a tempering treatment at an appropriate temperature and time in order to increase productivity in a cutting process before a final heat treatment.

In the manufacturing method a1, the hot-rolled steel sheet may be cold-rolled with the rolling reduction of 10% or less to provide a steel sheet for heat treatment. However, when the rolling reduction at cold rolling exceeds 10%, the grain boundaries of the lath structure are excessively distorted. When the steel sheet is heated here, a part of the lath structure is recrystallized during heating to become polygonal ferrite, so that acicular ferrite cannot be obtained by the heat treatment.

Process conditions of the manufacturing method a2 will be described.

Hot-Rolled Steel Sheet Further Subjected to Cold Rolling and Heat Treatment

The manufacturing method a2 includes: subjecting or not subjecting the hot-rolled steel sheet manufactured by the same steps as those of the manufacturing steps of the hot-rolled steel sheet according to the above manufacturing method a1: to the cold rolling (hereinafter, sometimes referred to as the "first cold rolling") to manufacture the steel sheet for the intermediate heat treatment, to the heat treatment (hereinafter, sometimes referred to as the "intermediate heat treatment") for suppressing the cold rolling from affecting the structure; and as needed, for instance, further to the cold rolling with the rolling reduction of 10% or less (hereinafter, sometimes referred to as a "second cold rolling") to manufacture the steel sheet a. The hot-rolled steel sheet to be subjected to the first cold rolling and the intermediate heat treatment may be any hot-rolled steel sheet having the chemical composition of the steel sheet a and manufactured according to the same process as the hot-rolled steel sheet manufacturing process of the manufacturing method a1. Since the following intermediate heat treatment is performed, the rolling reduction for the first cold rolling can be more than 10%.

The hot-rolled steel sheet may be pickled at least once before the intermediate heat treatment. When oxides on the surface of the hot-rolled steel sheet are removed and cleaned by pickling, plating properties of the steel sheet are improved.

The hot-rolled steel sheet after pickling is subjected or not subjected to the first cold rolling before the intermediate heat treatment to obtain a steel sheet for intermediate heat treatment. The first cold rolling improves the shape and dimensional accuracy of the steel sheet. However, if the total rolling reduction exceeds 85%, the ductility of the steel sheet decreases and the steel sheet may crack during the cold rolling. Therefore, the total rolling reduction is preferably 80% or less, more preferably 75% or less.

When the cold rolling with the rolling reduction exceeding 10% is applied to the lath structure, the grain boundaries of the lath structure are excessively distorted. When the steel sheet is heated here, a part of the lath structure is recrystallized during heating to become polygonal ferrite, so that acicular ferrite cannot be obtained by the heat treatment. When the cold rolling with the rolling reduction exceeding 10% is performed to obtain a steel sheet having the required sheet thickness and/or shape, a heat treatment for obtaining a lath structure is required prior to the heat treatment for obtaining acicular ferrite.

When the total rolling reduction is less than 0.05%, the shape and dimensional accuracy of the steel sheet do not improve, and the steel sheet temperature becomes non-uniform during the subsequent heat treatment and cooling treatment, resulting in a reduced ductility and a poor appearance of the steel sheet. Therefore, the total rolling reduction is preferably 0.05% or more, more preferably 0.10% or more. The total rolling reduction is preferably 20% or more in order to make the structure finer by recrystallization in the subsequent heat treatment process. When the rolling reduction in the cold rolling is 10% or less as described above, the following heat treatment may or may not be performed thereafter, and in that case, the manufacturing method is equivalent to that of the manufacturing method a1.

When the hot-rolled steel sheet is cold-rolled, the steel sheet may be heated before rolling or between rolling passes. This heating softens the steel sheet, reduces the rolling reaction force during rolling, and improves the shape and dimensional accuracy of the steel sheet. The heating temperature is preferably 700 degrees C. or less. When the heating temperature exceeds 700 degrees C., a part of the microstructure becomes aggregated austenite, Mn segregation proceeds, and a coarse aggregated Mn concentrated region is formed. Therefore, the structure of the steel sheet a falls out of the predetermined structure, and the structure is not suitable as the steel sheet for heat treatment.

This aggregated Mn-concentrated region becomes untransformed austenite and remains aggregated even in a firing process, and an aggregated and coarse hard structure is formed in the steel sheet, resulting in deterioration in ductility. When the heating temperature is less than 300 degrees C., a sufficient softening effect cannot be obtained. Accordingly, the heating temperature is preferably 300 degree C. or more. The pickling may be performed before or after the heating.

Steel-sheet-heating temperature: (Ac3−20) degrees C. or more

Temperature region with limited heating rate: from 700 degrees C. to (Ac3−20) degrees C.

Heating in above temperature region: Formula (2) below

The cold-rolled steel sheet (also the hot-rolled steel sheet may be used) is heated to (Ac3−20) degrees C. or more. When the steel-sheet-heating temperature (i.e., the heating temperature of the steel sheet) is less than (Ac3−20) degrees C., coarse ferrite remains during heating and isotropically grows to form polygonal ferrite during the subsequent cooling, resulting in a significant decline of mechanical characteristics of the high-strength steel sheet of the invention. Therefore, the steel-sheet-heating temperature is defined as (Ac3−20) degrees C. or more, preferably (Ac3−15) degrees C. or more, more preferably (Ac3+5) degrees C. or more.

Further, Ac3 and later-described Ac1 of the invention are obtained by: cutting out small pieces from the steel sheet before various heat treatments; removing an oxide layer on the surface of the steel sheet by polishing or pickling with hydrochloric acid, subsequently heating the small pieces up to 1200 degrees C. at the heating rate of 10 degrees C. per second in a vacuum environment of 10-1 MPa or less; and measuring a volume change behavior during heating using a laser displacement meter.

The upper limit of the steel-sheet-heating temperature is not particularly specified, but from the viewpoint of inhibiting the coarsening of crystal grains and reducing the heating cost, the upper limit is 1050 degrees C., and 1000 degrees C. or less is preferable.

Regarding the treatment time, a dwell time in the section from (maximum heating temperature−10) degrees C. to the maximum heating temperature may be short and may be less than 1 second, but if it is cooled immediately after heating, temperature unevenness may occur inside the steel sheet to deteriorate the shape of the steel sheet. Therefore, the treatment time is preferably 1 second or more.

On the other hand, if the dwell time in this temperature section becomes excessively long, the structure may become coarse and toughness of the final product may be deteriorated. From this viewpoint, the dwell time is preferably 10000 seconds or less. Since prolonging the dwell time increases the heat treatment cost, the dwell time is preferably 1000 seconds or less.

In heating, the steel sheet (the steel sheet for intermediate heat treatment) is heated under conditions satisfying the formula (2) below in a temperature region from 700 degrees C. to (Ac3−20) degrees C. By this heating, a base structure for forming the microstructure of the steel sheet a into a lath structure can be formed.

If the formula (2) is not satisfied, Mn segregation proceeds during heating, a coarse aggregated Mn-concentrated region is formed, and the mechanical characteristics after the heat treatment are deteriorated. The heating conditions need to satisfy the formula (2). The value of the formula (2) is preferably limited to 0.8 or less.

[Numerical Formula 21]

$$\sum_{n=1}^{10} 5.92\times10^{2}\cdot f_{\gamma}(n)^{0.3}\cdot(1-f_{\gamma}(n))^{1.4}\cdot\exp\left(-\frac{9.00\times10^{3}}{T(n)+273}\right)\cdot\Delta t^{0.5}\leq 1.0 \quad (2)$$

The above formula (2) is a calculation formula of dividing the elapsed time in a temperature region from 700 degrees C. to (Ac3-20) degrees C. in the heating process into 10 parts. Δt represents one tenth (second) of the elapsed time. $f_{\gamma}(n)$ represents an average reverse transformation ratio in the n-th section. T(n) represents an average temperature (degrees C.) in the n-th section.

The above formula (2) is a formula expressing the Mn concentration behavior in a region where a BCC phase represented by ferrite and an FCC phase represented by austenite coexist. As the value on the left side of the formula is larger, Mn is more concentrated. The reverse transformation rate $f_{\gamma}(n)$ during heating can be obtained by cutting out small pieces from the material before the heat treatment, performing a heat treatment test in advance, and measuring a volume expansion behavior during heating.

Average Cooling Rate from 700 Degrees C. to 550 Degrees C.: At Least 30 Degrees C. Per Second The steel sheet for intermediate heat treatment (cold-rolled steel sheet or hot-rolled steel sheet) is heated up to (Ac3−20) degrees C. or more, and subsequently, cooled at the average cooling rate of at least 30 degrees C. per second in the temperature region from 700 degrees C. to 550 degrees C. When the average cooling rate is less than 30 degrees C. per second, ferrite transformation proceeds and coarse polygonal ferrite is formed, so that the lath structure cannot be obtained in the steel sheet a. The average cooling rate is preferably at least 40 degrees C. per second. Although a desired steel sheet for heat treatment can be obtained without setting the upper limit of the cooling rate, at most 200 degrees C. per second is preferable from the viewpoint of cost.

Average Cooling Rate from Bs Point to (Bs−80) Degrees C.: At Least 20 Degrees C. Per Second In the cooling process in the manufacturing method a2, the particle diameter of a mother phase is finer than that in the cooling process in the manufacturing method a1, and the transformation is likely to proceed at or less than the Bs point. Since the time required for transformation is short, Mn concentration is unlikely to occur, but on the other hand, transformation in the temperature region proceeds locally even in the heat treatment, so that aggregated untransformed austenite tends to remain. From the latter point of view, the cooling rate at or less than the Bs point in the manufacturing method a2 has a smaller tolerance than that in the manufacturing method a1.

When the average cooling rate is less than 20 degrees C. per second in the cooling process in the temperature region from the Bs point to (Bs point−80) degrees C., the bainite transformation starts locally from some austenite grain boundaries and aggregated untransformed austenite remains, resulting in aggregated residual austenite. Therefore, the average cooling rate is set at at least 20 degrees C. per second in the above temperature region. The average cooling rate is preferably at least 30 degrees C. per second. Although a desired steel sheet for heat treatment can be obtained without setting the upper limit of the cooling rate, at most 200 degrees C. per second is preferable from the viewpoint of cost.

Dwell Time from (Bs−80) Degrees C. to Ms Point: 1000 Seconds or Less

In the manufacturing method a2, the particle diameter of the mother phase is fine, and transformation easily proceeds at or less than the Bs point as compared with the manufacturing method a1. Therefore, if the dwell time from (Bs−80) degrees C. to the Ms point is long, bainite transformation locally progresses, and aggregated untransformed austenite may remain, resulting in aggregated residual austenite. The dwell time referred to here also includes a time during which the temperature is maintained within the temperature region of (Bs−80) degrees C. to the Ms point by reheating, isothermal maintenance, or the like.

Therefore, the dwell time is limited to 1000 degrees C. or less in the above temperature region. The dwell time is preferably 500 seconds or less, further preferably 200 seconds or less. The shorter dwell time is preferable. However, since a very large cooling rate is required to allow less than 1 second of the dwell time, 1 second or more is preferable from the viewpoint of cost.

Average Cooling Rate From Ms Point To (Ms−50) Degrees C.: At Most 100 Degrees C. Per Second In the manufacturing method a2, the cooling rate is high and a lot of untransformed regions remain at the time of reaching the Ms point as compared with the manufacturing method a1. Therefore, if the cooling rate from the Ms point to (Ms−50) degrees C. is excessively high, aggregated untransformed austenite is likely to remain.

The average cooling rate from the Ms point to (Ms−50) degrees C. is limited to at most 100 degrees C. per second in order to sufficiently proceed with the martensitic transformation from the Ms point to (Ms−50) degrees C. and reduce untransformed austenite. The average cooling rate in the above temperature region is preferably at most 70 degrees C. per second, and more preferably at most 40 degrees C. per second.

By controlling the average cooling rate within this range, untransformed austenite can be sufficiently transformed into martensite and its fraction can be reduced. Therefore, generation of coarse aggregated residual austenite is reducible.

The lower cooling rate is preferable in the above temperature region. However, a large-scale heating device is required to make the cooling rate less than 0.1 degrees C. per second. Therefore, the cooling rate is preferably at least 0.1 degrees C. per second from the viewpoint of cost.

Ms point (degrees C.)=561−474[C]−33·[Mn]
−17·[Cr]−17·[Ni]−21·[Mo]
−11·[Si]+30·[Al]

In the manufacturing method a2, the intermediate heat-treated steel sheet after cooling of the intermediate heat treatment may be subjected to a second cold rolling with a rolling reduction of 10% or less, the intermediate heat-treated steel sheet after cooling may be pickled, or the intermediate heat-treated steel sheet after cooling may be tempered to the extent that Mn concentration in the carbide does not proceed.

Further, after the same heat treatment as the above intermediate heat treatment is performed without performing the first cold rolling, the second cold rolling with a rolling reduction of 10% or less may be performed. Alternatively, the hot-rolled steel sheet after being subjected to the same heat treatment as the above intermediate heat treatment may be pickled. Alternatively, the hot-rolled steel sheet after being subjected to the same heat treatment as the above intermediate heat treatment may be tempered to the extent that the Mn concentration to carbide does not proceed. However, since the above intermediate heat treatment is not performed after the second cold rolling, when the rolling reduction at the second cold rolling exceeds 10%, grain boundaries of the lath structure are excessively distorted in the same manner as in the first cold rolling. When the steel sheet is heated here, a part of the lath structure is recrystallized during heating to become polygonal ferrite, so that acicular ferrite cannot be obtained by the heat treatment.

Next, the manufacturing methods A, A1*a*, A1*b*, and A2 of the invention will be described.

The present manufacturing method A is a manufacturing method of the present steel sheet A using the steel sheet for heat treatment (steel sheet a) manufactured by the method a1 or a2 of the invention.

The present manufacturing method A includes: heating the steel sheet for heat treatment to a temperature in a range from (Ac1+25) degrees C. to an Ac3 point under conditions satisfying a formula (3) below for calculating by dividing an elapsed time in a temperature region from 700 degrees C. to an end point that is a lower one of a maximum heating temperature or (Ac3−20) degrees C. into 10 parts, and retaining the steel sheet for 150 seconds or less in a temperature region from the maximum heating temperature minus 10 degrees C. to the maximum heating temperature;

cooling the steel sheet from a heating retention temperature at an average cooling rate of at least 25 degrees C. per second in a temperature region from 700 degrees C. to 550 degrees C., and cooling the steel sheet in a limited range satisfying formulae (4) and (5) below for calculating by dividing a dwell time in a temperature region from a start point that is a lower one of 550 degrees C. or the Bs point to 300 degrees C. into 10 parts (also referred to as "the final heat treatment").

The present manufacturing method Ala is a manufacturing method of the present steel sheet A1.

The present manufacturing method Ala includes: immersing the high-strength steel sheet excellent in formability, toughness, and weldability manufactured by the present manufacturing method A in a plating bath including zinc as a main component to form a galvanized layer or a zinc alloy plated layer on one surface or both surfaces of the high-strength steel sheet.

The present manufacturing method Alb is a manufacturing method of the present steel sheet A1.

The present manufacturing method Alb includes: forming a galvanized layer or a zinc alloy plated layer by electroplating on one surface or both surfaces of the high-strength steel sheet excellent in formability, toughness, and weldability manufactured by the present manufacturing method A.

The present manufacturing method A2 is a manufacturing method of the present steel sheet A2.

The present manufacturing method A2 includes: heating the galvanized layer or the zinc alloy plated layer to a temperature in a range from 450 degrees C. to 550 degrees C. in the tempering treatment to perform an alloying treatment on the galvanized layer or the zinc alloy plated layer.

Process conditions of the manufacturing method A will be described.

Steel-sheet-heating temperature: (Ac1+25) degrees C. to Ac3 point

Temperature region with limited heating rate: from 700 degrees C. to (Ac3-20) degrees C.

Heating Conditions: Formula (3) Below

The steel sheet a is heated from (Ac1+25) degrees C. to Ac3 point. For heating, in the temperature region from 700 degrees C. to (Ac3−20) degrees C., the average heating rate of at least 1 degree C. per second or the heating conditions satisfying the formula (3) below are set.

When the steel-sheet-heating temperature is less than (Ac1+25) degrees C., it is concerned that cementite in the steel sheet may remain undissolved to deteriorate mechanical characteristics. Accordingly, the steel-sheet-heating temperature is determined to be equal to or more than (Ac1+25) degrees C., preferably equal to or more than (Ac1+40) degrees C.

On the other hand, the upper limit of the steel-sheet-heating temperature is determined to be equal to or less than Ac3 point. When the steel-sheet-heating temperature exceeds the Ac3 point, the lath structure of the steel sheet a is not inherited, which makes it difficult to obtain acicular ferrite. Moreover, since acicular ferrite is not obtained, martensite is shaped to be coarse, aggregated and island-shaped martensite.

Accordingly, when the steel-sheet-heating temperature exceeds the Ac3 point, properties required for the steel sheet of the invention cannot be achieved. When the steel-sheet-heating temperature approaches the Ac3 point, a majority of the microstructure becomes austenite and the lath structure disappears. Accordingly, in order to inherit the lath structure of the steel sheet a and further improve the mechanical characteristics, the steel-sheet-heating temperature is preferably equal to or less than (Ac3−10) degrees C., more preferably equal to or less than (Ac3−20) degrees C.

When the temperature history in the temperature region from 700 degrees C. to (Ac3−20) degrees C. in the heating step does not satisfy the formula (3), a lot of coarse and aggregated martensite is formed in the microstructure of the present steel sheet A, thereby not satisfying the formula (A) to deteriorate toughness. Accordingly, the temperature history in the temperature region in the heating step is determined to meet the heating conditions satisfying the formula (3).

In order to reduce the amount of coarse and aggregated martensite and sufficiently improve toughness, it is further preferable to limit the value of the left side of the formula (3) to 1.5 or less.

[Numerical Formula 22]

$$\sum_{n=1}^{10} 8.65\times10^{2}\cdot(W_{Mn}+0.51W_{Cr}+0.51W_{Ni}-0.64W_{Mo}-0.33W_{Si}+0.90W_{Al})^{0.5}\cdot f_{\gamma}(n)^{0.5}\cdot(1-f_{\gamma}(n))^{1.8}\cdot\exp\left(-\frac{9.00\times10^{3}}{T(n)+273}\right)\cdot\Delta t^{0.33}\leq 2.0 \quad (3)$$

The above formula (3) is a calculation formula of dividing the elapsed time in a temperature region from 700 degrees C. to an end point, that is, the lower one of the maximum heating temperature or (Ac3−20) degrees C. in the heating process into 10 parts. Δt represents one tenth (second) of the elapsed time. $W_M$ represents a composition (mass %) of each element species. $f_\gamma(n)$ represents an average reverse transformation ratio in the n-th section. T(n) represents an average temperature (degrees C.) in the n-th section.

The formula (3) is an empirical formula in consideration of the generation frequency, stabilization behavior and growth rate of isotropic austenite grains caused by reverse transformation. In the formula (3), a term containing the chemical composition represents the generation frequency of the isotropic austenite grains. As the term becomes larger, more isotropic austenite grains are formed. When the formed isotropic austenite is chemically unstable, other acicular austenite encroaches on the formed isotropic austenite or the formed isotropic austenite is transformed into a phase other than martensite in the subsequent heat treatment, so that formation of coarse isotropic austenite is inhibited and toughness is not impaired. On the other hand, when concentration of alloy elements into isotropic austenite progresses during heating, the isotropic austenite is chemically stabilized and remains untransformed until a low temperature, and is transformed into martensite during cooling to impair toughness.

As the reverse transformation ratio represented by $f_\gamma(n)$ is smaller, a driving force applied to distribution of the alloy elements is increased. Alternatively, as the temperature becomes higher, atomic diffusion becomes more active and a distribution rate of the alloy elements is higher.

The isotropic austenite grows at the driving force increased especially in a region where the reverse transformation ratio is large, whereas the isotropic austenite can grow more without being affected by the surrounding acicular austenite in a region where the reverse transformation ratio is smaller.

From the above viewpoint, the empirical formula in which coefficients and indexes of the formula consisting of the chemical composition, reverse transformation rate, temperature and time are organized is the formula (3). As the value of the formula (3) is smaller, formation of the isotropic and coarse martensite is more inhibited.

Heating Retention Temperature Region: From Maximum Heating Temperature Minus 10 Degrees C. to Maximum Heating Temperature Heating retention time: 150 seconds or less The steel sheet a is heated under the above conditions and retained for 150 seconds or less at the temperature in the temperature region from the maximum heating temperature minus 10 degrees C. to the maximum heating temperature. When the heating retention time exceeds 150 seconds, the microstructure may become austenite and the lath structure may disappear. Accordingly, the heating retention time is defined as 150 seconds or less, preferably 120 seconds or less.

Temperature Region With Limited Cooling Rate: From 700 Degrees C. To 550 Degrees C.

Average Cooling Rate: At Least 25 Degrees C. Per Second

When the average cooling rate is less than 25 degrees C. per second, acicular ferrite excessively grows to become polygonal ferrite, resulting in an excessively low fraction of acicular ferrite. Moreover, since polygonal ferrite are also newly formed in addition to growth of acicular ferrite, a fraction of polygonal ferrite is increased.

Therefore, the average cooling rate is defined as at least 25 degrees C. per second, preferably at least 35 degrees C. per second, more preferably at least 40 degrees C. per second in the temperature region from 700 degrees C. to 550 degrees C.

The upper limit of the average cooling rate is not particularly determined. Excessively increasing the cooling rate requires special equipment and a refrigerant, which increases the cost and makes it difficult to control the cooling stop temperature. Therefore, it is preferable to keep the cooling rate at at most 200 degrees C. per second.

In the calculation in the formulae (4) and (5), the dwell time in the temperature region from the lower one (i.e., start point) of 550 degrees C., and the Bs point to 300 degrees C. is divided into 10 parts.

The steel sheet a, which has been cooled at the average cooling rate of at least 25 degrees C. per second in the temperature region from 700 degrees C. to 550 degrees C., is limited to the range satisfying the formulae (4) and (5) for calculating by dividing the dwell time in the temperature region from the lower one (i.e., start point) of 550 degrees C., and the Bs point to 300 degrees C. into 10 parts.

Unless the formulae (4) and (5) are not satisfied, bainite transformation and/or pearlite transformation excessively progresses and untransformed austenite is consumed, so that a sufficient amount of martensite cannot be obtained. Therefore, the left side of the formula (4) is limited to 1.0 or less.

In order to sufficiently obtain untransformed austenite in terms of high strength, the left side of the formula (4) is preferably 0.8 or less, further preferably 0.6 or less.

When the formula (5) is not satisfied although the formula (4) is satisfied, it is concerned that carbon may be excessively concentrated in untransformed austenite to generate residual austenite. By limiting the left side of the formula (5) to 1.0 or less, concentration of carbons to untransformed austenite is restricted, so that the majority of the untransformed austenite can be transformed into martensite in the subsequent cooling process. In order to reduce residual austenite, the left side of the formula (5) is preferably 0.8 or less, further preferably 0.6 or less.

[Numerical Formula 23]

$$\sum_{n=1}^{10}\left\{1.39\times10^{1}\cdot(Bs-T(n))^{3}\cdot\exp\left(-\frac{1.44\times10^{4}}{T(n)+273}\right)\Delta t^{0.5}\right\}\leq 1.0 \quad (4)$$

-continued

[Numerical Formula 24]

$$\sum_{n=1}^{10}\left\{1.56\times10^{2}\cdot\left(W_{Si}+0.9W_{Al}\cdot\left(\frac{T(n)}{550}\right)^{2}+0.3(W_{Cr}+W_{Mo})\cdot\frac{T(n)}{550}\right)\cdot\exp\left(-6.7\cdot\left(1-\frac{T(n)}{550}\right)\right)\cdot\left(\frac{T(n)-250}{300}\right)^{0.5}\cdot(Bs-T(n))^{3}\cdot\exp\left(-\frac{1.44\times10^{4}}{T(n)+273}\right)\cdot\Delta t^{0.5}\right\}\leq1.0 \quad (5)$$

The formulae (4) and (5) are calculation formulae by dividing the dwell time in the temperature region from the lower one (i.e., start point) of 550 degrees C., and the Bs point to 300 degrees C. into 10 parts. Δt represents one tenth (second) of the elapsed time. Bs represents the Bs point (degrees C.). T(n) represents an average temperature (degrees C.) in each step. $W_M$ represents the composition (mass %) of each element.

The formula (4) is an index for evaluating a progress degree of bainite transformation in this temperature region. When the formula (4) is not satisfied, bainite transformation excessively progresses. The term consisting of the supercooling degree from Bs in the formula (4) represents a driving force of the bainite transformation, and increases as the temperature decreases. Meanwhile, the exponential function term represents a progress rate of bainite transformation by a thermal activation mechanism, and increases as the temperature rises.

The formula (5) is an index showing a behavior of carbide formation from untransformed austenite in the temperature region. When the formula (5) is not satisfied, a large amount of pearlite and/or iron carbides are formed from untransformed austenite, the untransformed austenite is excessively consumed, and a sufficient amount of martensite cannot be obtained. Since carbons are concentrated in untransformed austenite along with bainite transformation and carbides are easily formed, the left side of the formula (5) becomes larger as the term consisting of Bs and the temperature common to the formula (4) becomes larger, which increases a risk of forming carbides. The exponential function term that is not common to the formula (4) represents the rate of carbide formation by thermal activation mechanism. The exponential function term increases as the temperature rises. The term consisting of other chemical compositions and temperatures represents the driving force of forming carbides, and increases as the temperature decreases or decreases by adding elements (Si, Al, Cr, Mo) inhibiting formation of carbides.

When both of the formula (4) and the formula (5) are satisfied, a sufficient amount of untransformed austenite remains until after dwelling in the temperature region and an amount of solid solution carbon in the untransformed austenite remains in an appropriate range, a sufficient amount of martensite can be obtained by subsequent cooling.

When the average cooling rate from 300 degrees C. to the room temperature is excessively low, carbons may be distributed from partially formed martensite to untransformed austenite, and austenite may remain. From this viewpoint, the average cooling rate in the above temperature region is preferably at least 0.1 degrees C. per second, and more preferably at least 0.5 degrees C. per second.

In the manufacturing method A, the wound steel sheet may be subjected to skin pass rolling with a rolling reduction of 2.0% or less. By subjecting the wound steel sheet to skin pass rolling with a rolling reduction of 2.0% or less, the material, shape, and dimensional accuracy of the steel sheet can be improved.

Further, in the production method A of the invention, the wound steel sheet may be tempered by being heated to a temperature in a range from 200 degrees C. to 600 degrees C. Toughness of martensite can be improved by this tempering. When the tempering temperature is less than 200 degrees C., toughness of martensite is not sufficiently improved. Therefore, the tempering temperature is preferably 200 degrees C. or more, more preferably 300 degrees C. or more.

On the other hand, when the tempering temperature exceeds 600 degrees C., austenite may be decomposed into carbides and the lath structure may disappear. Therefore, the tempering temperature is preferably 600 degrees C. or less, more preferably 550 degrees C. or less. The tempering time is not particularly limited to a specific range. The tempering time may be appropriately set according to the chemical composition and the heat history of the steel sheet.

When the tempering time is excessively long, a tempering embrittlement phenomenon may occur in which coarse carbides are formed in the tempered martensite to embrittle the steel sheet. Therefore, the tempering time is preferably 10000 seconds or less. In order to avoid the embrittlement, the tempering time is more preferably 3600 seconds or less, further preferably 1000 seconds or less.

When the tempering time is excessively short, temperature unevenness may occur inside the steel sheet and the shape of the steel sheet may be deteriorated. Therefore, the tempering time is preferably 1 second or more. In order to sufficiently obtain the toughness improving effect by the tempering, the tempering time is preferably 3 seconds or more, and more preferably 6 seconds or more.

Further, in the manufacturing method A of the invention, the tempering may be performed after the skin pass rolling, and conversely, the skin pass rolling may be performed after the tempering. Alternatively, the skin pass rolling may be performed before and after the tempering.

Galvanized Layer and Zinc Alloy Plated Layer

A galvanized layer or a zinc alloy plated layer is formed on one surface or both surfaces of the present steel sheet A by the manufacturing method Ala and the manufacturing method Alb of the invention. The plating method is preferably a hot-dip galvanizing method or an electroplating method.

Process conditions of the manufacturing method Ala will be described.

In the manufacturing method Ala of the invention, the present steel sheet A is immersed in a plating bath including zinc as a main component to form a galvanized layer or a zinc alloy plated layer on one surface or both surfaces of the present steel sheet A.

Temperature of Plating Bath

The temperature of the plating bath is preferably from 450 degrees C. to 470 degrees C. When the temperature of the plating bath is less than 450 degrees C., the viscosity of the plating solution increases, it becomes difficult to control the thickness of the plated layer accurately, and the appearance of the steel sheet is impaired. Therefore, the temperature of the plating bath is preferably 450 degrees C. or more. On the other hand, when the temperature of the plating bath exceeds 470 degrees C., a large amount of fume is formed from the plating bath and the working environment is deteriorated to lower the work safety. Therefore, the temperature of the plating bath is preferably 470 degrees C. or less.

The temperature of the present steel sheet A immersed in the plating bath is preferably in a range from 400 degrees C. to 530 degrees C. When the temperature of the steel sheet is less than 400 degrees C., a large amount of heat is required to stably maintain the temperature of the plating bath at 450 degrees C. or more, and the plating cost increases. Therefore, the temperature of the steel sheet is preferably 400 degrees C. or more, more preferably 430 degrees C. or more.

On the other hand, when the temperature of the steel sheet exceeds 530 degrees C., a large amount of heat must be removed to keep the temperature of the plating bath stable at 470 degrees C. or less, thereby increasing the plating cost. Therefore, the temperature of the steel sheet is preferably 530 degrees C. or less, more preferably 500 degrees C. or less.

Composition of Plating Bath

The plating bath mainly contains zinc and preferably has an effective Al amount of 0.01 to 0.30 mass % which is obtained by subtracting the entire Fe amount from the entire Al amount. When the effective Al amount of the galvanizing bath is less than 0.01 mass %, Fe excessively invades into the galvanized layer or the zinc alloy plated layer, and the plating adhesion is lowered. Therefore, the effective Al amount of the galvanizing bath is 0.01 mass % or more, more preferably 0.04 mass % or more.

On the other hand, when the effective Al amount of the galvanizing bath exceeds 0.30 mass %, Al oxides are excessively formed at the interface between the base iron and the galvanized layer or the zinc alloy plated layer, and the plating adhesion is significantly deteriorated. Therefore, the effective Al amount of the galvanizing bath is preferably 0.30 mass % or less. Since the Al oxides hinder movement of Fe atoms and Zn atoms to inhibit formation of the alloy phase in the subsequent alloying treatment, the effective Al amount of the plating bath is more preferably 0.20 mass % or less.

The plating bath may contain one or more of Ag, B, Be, Bi, Ca, Cd, Co, Cr, Cs, Cu, Ge, Hf, Zr, I, K, La, Li, Mg, Mn, Mo, Na, Nb, Ni, Pb, Rb, Sb, Si, Sn, Sr, Ta, Ti, V, W, Zr, and REM in order to improve corrosion resistance and formability.

The adhesion amount of plating is adjusted by pulling the steel sheet out of the plating bath and then spraying a high-pressure gas mainly including nitrogen on the surface of the steel sheet to remove excessive plating solution.

Process conditions of the manufacturing method A1*b* will be described.

In the manufacturing method A1*b*, a galvanized layer or a zinc alloy plated layer is formed on one surface or both surfaces of the present steel sheet A by electroplating.

Electroplating

In the manufacturing method A1*b*, a galvanized layer or a zinc alloy plated layer is formed on one surface or both surfaces of the present steel sheet A under typical electroplating conditions.

Alloying of Galvanized Layer and Zinc Alloy Plated Layer

In the manufacturing method A2, it is preferable to heat a galvanized layer or a zinc alloy plated layer, which is formed on one surface or both surfaces of the present steel sheet A by the manufacturing method Ala or the manufacturing method Alb, to a temperature in a range from 450 degrees C. to 550 degrees C. for alloying. The heating time is preferably in a range from 2 to 100 seconds.

When the heating temperature is less than 450 degrees C. or the heating time is less than 2 seconds, alloying does not proceed sufficiently and the plating adhesion is not improved. Therefore, it is preferable that the heating temperature is 450 degrees C. or more and the heating time is 2 seconds or more.

On the other hand, when the heating temperature exceeds 550 degrees C. or the heating time exceeds 100 seconds, alloying excessively proceeds and the plating adhesion is lowered. Therefore, it is preferable that the heating temperature is 550 degrees C. or less and the heating time is 100 seconds or less.

EXAMPLES

Next, Examples of the invention will be described. Conditions used in Examples are exemplarily adopted for checking the feasibility and effect of the invention. The invention is not limited to the exemplary conditions. Various conditions are applicable to the invention as long as the conditions are not contradictory to the gist of the invention and are compatible with an object of the invention.

Example 1: Manufacture of Steel Sheet for Heat Treatment

Steel pieces were manufactured by casting molten steel with the chemical compositions shown in Tables 1 and 2. Next, the steel pieces were subjected to hot rolling under conditions shown in Tables 3 and 4.

TABLE 1

| Chemical component | Chemical component (mass %) | | | | | | | | | | | | | | |
|---|---|---|---|---|---|---|---|---|---|---|---|---|---|---|---|
| | C | Si | Mn | P | S | Al | N | O | Ti | Nb | V | Cr | Ni | Cu | |
| A | 0.148 | 0.82 | 2.50 | 0.009 | 0.0022 | 0.037 | 0.0025 | 0.0009 | | | | | | | Example |
| B | 0.085 | 0.43 | 1.87 | 0.012 | 0.0047 | 0.182 | 0.0056 | 0.0007 | 0.008 | 0.010 | | 0.18 | | | Example |
| C | 0.201 | 1.63 | 2.31 | 0.006 | 0.0030 | 0.079 | 0.0013 | 0.0015 | | | | | | | Example |
| D | 0.058 | 0.21 | 1.56 | 0.012 | 0.0055 | 0.071 | 0.0064 | 0.0018 | 0.067 | | | | | | Example |
| E | 0.264 | 0.35 | 1.29 | 0.009 | 0.0010 | 0.038 | 0.0075 | 0.0008 | | | | | | | Example |
| F | 0.221 | 0.86 | 2.10 | 0.013 | 0.0011 | 0.201 | 0.0028 | 0.0016 | | | | | | | Example |
| G | 0.149 | 0.02 | 2.80 | 0.014 | 0.0020 | 0.022 | 0.0056 | 0.0006 | | 0.053 | | | | | Example |
| H | 0.138 | 0.56 | 3.32 | 0.009 | 0.0016 | 0.860 | 0.0037 | 0.0013 | | | | | | | Example |
| I | 0.137 | 0.05 | 2.85 | 0.011 | 0.0017 | 1.165 | 0.0031 | 0.0016 | | | 0.063 | | | | Example |
| J | 0.194 | 0.16 | 2.09 | 0.013 | 0.0017 | 0.075 | 0.0027 | 0.0014 | | | | | | 0.14 | Example |
| K | 0.096 | 0.71 | 1.68 | 0.019 | 0.0028 | 0.133 | 0.0048 | 0.0017 | 0.162 | | | | | | Example |
| L | 0.077 | 1.44 | 2.17 | 0.016 | 0.0019 | 0.076 | 0.0047 | 0.0013 | | 0.067 | | | | | Example |
| M | 0.107 | 2.24 | 1.05 | 0.002 | 0.0001 | 0.098 | 0.0050 | 0.0013 | | | | 0.15 | 0.22 | | Example |
| N | 0.199 | 1.47 | 0.88 | 0.042 | 0.0006 | 0.031 | 0.0055 | 0.0009 | | | | 1.06 | | | Example |
| O | 0.137 | 2.05 | 0.57 | 0.033 | 0.0041 | 0.013 | 0.0037 | 0.0008 | | | | | 1.23 | 0.32 | Example |
| P | 0.146 | 1.91 | 0.84 | 0.016 | 0.0071 | 0.029 | 0.0051 | 0.0003 | | | 0.207 | | | | Example |

TABLE 1-continued

| Chemical component | Chemical component (mass %) C | Si | Mn | P | S | Al | N | O | Ti | Nb | V | Cr | Ni | Cu | |
|---|---|---|---|---|---|---|---|---|---|---|---|---|---|---|---|
| Q | 0.068 | 1.64 | 1.94 | 0.017 | 0.0014 | 0.228 | 0.0043 | 0.0016 | 0.011 | 0.021 | | | | | Example |
| R | 0.124 | 0.74 | 1.33 | 0.009 | 0.0012 | 0.002 | 0.0058 | 0.0017 | | | | 0.64 | | | Example |
| S | 0.133 | 0.82 | 1.84 | 0.003 | 0.0051 | 0.080 | 0.0044 | 0.0003 | 0.115 | | | | | | Example |
| T | 0.122 | 0.35 | 2.36 | 0.001 | 0.0048 | 0.084 | 0.0108 | 0.0003 | 0.023 | | | | | | Example |
| U | 0.128 | 0.18 | 2.84 | 0.008 | 0.0059 | 1.710 | 0.0026 | 0.0008 | | | | | | | Example |
| V | 0.124 | 1.32 | 1.23 | 0.006 | 0.0030 | 0.018 | 0.0030 | 0.0007 | | 0.030 | | | 0.31 | | Example |
| W | 0.136 | 0.28 | 1.52 | 0.003 | 0.0022 | 0.082 | 0.0026 | 0.0015 | 0.043 | | | | | | Example |
| X | 0.188 | 0.31 | 2.08 | 0.019 | 0.0037 | 0.005 | 0.0028 | 0.0017 | | | | | | | Example |
| Y | 0.163 | 0.99 | 1.94 | 0.023 | 0.0036 | 0.041 | 0.0031 | 0.0013 | | | | | | | Example |
| Z | 0.191 | 1.83 | 1.36 | 0.018 | 0.0079 | 0.097 | 0.0027 | 0.0013 | | | | | | | Example |
| AA | 0.034 | 0.94 | 1.99 | 0.009 | 0.0062 | 0.036 | 0.0060 | 0.0009 | | | | | | | Comparative |
| AB | 0.357 | 0.93 | 2.05 | 0.008 | 0.0063 | 0.073 | 0.0071 | 0.0003 | | | | | | | Comparative |
| AC | 0.167 | 3.05 | 1.96 | 0.010 | 0.0074 | 0.089 | 0.0027 | 0.0004 | | | | | | | Comparative |
| AD | 0.162 | 0.88 | 6.11 | 0.011 | 0.0063 | 0.059 | 0.0049 | 0.0015 | | | | | | | Comparative |
| AE | 0.167 | 0.87 | 0.31 | 0.008 | 0.0017 | 0.052 | 0.0061 | 0.0018 | | | | | | | Comparative |
| AF | 0.164 | 0.93 | 2.01 | 0.115 | 0.0061 | 0.098 | 0.0075 | 0.0011 | | | | | | | Comparative |
| AG | 0.169 | 0.89 | 1.96 | 0.009 | 0.0214 | 0.089 | 0.0056 | 0.0008 | | | | | | | Comparative |
| AH | 0.158 | 0.91 | 2.03 | 0.010 | 0.0010 | 2.222 | 0.0027 | 0.0007 | | | | | | | Comparative |
| AI | 0.158 | 0.78 | 1.90 | 0.011 | 0.0010 | 0.076 | 0.0218 | 0.0014 | | | | | | | Comparative |
| AJ | 0.171 | 0.94 | 2.05 | 0.011 | 0.0011 | 0.014 | 0.0071 | 0.0195 | | | | | | | Comparative |
| AK | 0.148 | 0.81 | 2.49 | 0.013 | 0.0009 | 0.009 | 0.0034 | 0.0009 | | | | | | | Example |
| AL | 0.200 | 1.62 | 2.31 | 0.010 | 0.0013 | 0.083 | 0.0024 | 0.0012 | | | | | | | Example |

※A value with underline indicates that the value is out of the scope of the invention.

TABLE 2

| Chemical component | Chemical component (mass %) Mo | B | W | Ca | Ce | Mg | Zr | La | REM | Sn | Sb | Temperature (° C.) Bs point | Ms point | |
|---|---|---|---|---|---|---|---|---|---|---|---|---|---|---|
| A | | | | | | | | | | | | 521 | 400 | Example |
| B | 0.09 | 0.0004 | | | | | | | 0.0008 | | | 560 | 455 | Example |
| C | | | | | | | | | | | | 519 | 374 | Example |
| D | | 0.0013 | | | | | | | | | | 575 | 482 | Example |
| E | | | | | | | | | | | | 566 | 391 | Example |
| F | | | | | | | | | | | | 538 | 384 | Example |
| G | | | | | | | | | | | | 530 | 398 | Example |
| H | | | | | | | | | | | | 521 | 406 | Example |
| I | | | | | | | | | | | | 551 | 436 | Example |
| J | | | | | 0.0017 | | | | | | | 543 | 401 | Example |
| K | | | | | | | | | | | | 552 | 456 | Example |
| L | | | | 0.0014 | | | | | | | | 552 | 439 | Example |
| M | | | | | | | | | | | | 553 | 448 | Example |
| N | | | | | | | | | | | | 565 | 404 | Example |
| O | | | | | | | | | | | | 549 | 434 | Example |
| P | | | | | | | | | | | | 563 | 444 | Example |
| Q | | 0.0033 | | | | | | | | | | 578 | 454 | Example |
| R | | | | | | | 0.0009 | | | | | 564 | 439 | Example |
| S | | | | | | | | | | | | 544 | 431 | Example |
| T | | | | 0.0009 | | | | | | | | 532 | 424 | Example |
| U | 0.13 | | | | | | | | | | | 566 | 453 | Example |
| V | | | | | | 0.0022 | | | | | | 558 | 442 | Example |
| W | 0.28 | | | | | | | | | | | 558 | 440 | Example |
| X | | 0.0005 | | | | | | 0.0013 | | | | 541 | 400 | Example |
| Y | | | 0.14 | | | | | | | | | 537 | 410 | Example |
| Z | | | | 0.0029 | | | | | | | | 549 | 408 | Example |
| M | | | | | | | | | | | | 536 | 470 | Comparative |
| AB | | | | | | | | | | | | 535 | 316 | Comparative |
| AC | | | | | | | | | | | | 515 | 386 | Comparative |
| AD | | | | | | | | | | | | 401 | 275 | Comparative |
| AE | | | | | | | | | | | | 593 | 464 | Comparative |
| AF | | | | | | | | | | | | 537 | 410 | Comparative |
| AG | | | | | | | | | | | | 539 | 409 | Comparative |
| AH | | | | | | | | | | | | 601 | 476 | Comparative |
| AI | | | | | | | | | | | | 542 | 417 | Comparative |
| AJ | | | | | | | | | | | | 533 | 402 | Comparative |
| AK | | | | | | | | | | 0.109 | | 521 | 400 | Example |
| AL | | | | | | | | | | | 0.051 | 519 | 374 | Example |

※A value with underline indicates that the value is out of the scope of the invention.

TABLE 3

| Hot-rolled steel sheet | Chemical component | Hot rolling conditions: Heating temperature ° C. | Rolling completion temperature ° C. | Average cooling rate 1 ° C./sec | Winding temperature ° C. | Bs—winding temperature ° C. | Bs ° C. | Left side of Formula (1) | |
|---|---|---|---|---|---|---|---|---|---|
| 1 | A | 1220 | 874 | 49 | 490 | 31 | 521 | 0.68 | Example |
| 2 | A | 1175 | 930 | <1 | 607 | −86 | 521 | 0.82 | Comparative |
| 3 | B | 1220 | 922 | 54 | 491 | 69 | 560 | 1.05 | Example |
| 5 | C | 1195 | 868 | 47 | 529 | −10 | 519 | 0.66 | Comparative |
| 6 | C | 1210 | 988 | 54 | 515 | 4 | 519 | 0.74 | Example |
| 7 | D | 1200 | 942 | 45 | 501 | 74 | 575 | 1.03 | Example |
| 8 | D | 1205 | 928 | 32 | 545 | 30 | 575 | 1.42 | Example |
| 9 | E | 1195 | 980 | 44 | 545 | 21 | 566 | 1.83 | Comparative |
| 10 | E | 1210 | 978 | 44 | 506 | 60 | 566 | 1.05 | Example |
| 11 | F | 1245 | 922 | 45 | 533 | 5 | 538 | 1.18 | Example |
| 12 | F | 1265 | 918 | 46 | 98 | 440 | 538 | 0.00 | Example |
| 13 | G | 1215 | 868 | 54 | 515 | 15 | 530 | 0.81 | Example |
| 14 | G | 1240 | 974 | 44 | 488 | 42 | 530 | 0.45 | Example |
| 15 | H | 1190 | 920 | 51 | 498 | 23 | 521 | 0.57 | Example |
| 16 | H | 1245 | 920 | 39 | 520 | 1 | 521 | 0.78 | Example |
| 17 | I | 1210 | 870 | 60 | 526 | 25 | 551 | 0.67 | Example |
| 18 | I | 1235 | 876 | 32 | 512 | 39 | 551 | 1.31 | Example |
| 19 | J | 1235 | 936 | 50 | 523 | 20 | 543 | 0.44 | Example |
| 20 | J | 1210 | 990 | 55 | 492 | 51 | 543 | 0.69 | Example |
| 21 | K | 1190 | 932 | 42 | 535 | 17 | 552 | 0.70 | Example |
| 22 | K | 1205 | 986 | 37 | 521 | 31 | 552 | 1.02 | Example |
| 23 | L | 1200 | 970 | 41 | 523 | 29 | 552 | 1.00 | Example |
| 24 | L | 1210 | 922 | 39 | 490 | 62 | 552 | 0.55 | Example |
| 25 | M | 1245 | 884 | 54 | 526 | 27 | 553 | 1.14 | Example |
| 26 | M | 1240 | 986 | 56 | 500 | 53 | 553 | 0.85 | Example |
| 27 | N | 1210 | 880 | 49 | 533 | 32 | 565 | 1.09 | Example |
| 28 | N | 1175 | 886 | 52 | 500 | 65 | 565 | 0.53 | Example |
| 29 | O | 1175 | 936 | 44 | 528 | 21 | 549 | 1.17 | Example |
| 30 | O | 1180 | 878 | 39 | 539 | 10 | 549 | 1.01 | Example |
| 31 | P | 1190 | 932 | 42 | 512 | 51 | 563 | 0.96 | Example |
| 32 | P | 1190 | 882 | 46 | 529 | 34 | 563 | 1.63 | Comparative |
| 33 | Q | 1200 | 866 | 36 | 538 | 40 | 578 | 0.61 | Example |
| 34 | Q | 1180 | 866 | 41 | 501 | 77 | 578 | 0.43 | Example |

※A value with underline indicates that the value is out of the scope of the invention.

TABLE 4

| Hot-rolled steel sheet | Chemical component | Hot rolling conditions: Heating temperature ° C. | Rolling completion temperature ° C. | Average cooling rate 1 ° C./sec | Winding temperature ° C. | Bs—winding temperature ° C. | Bs ° C. | Left side of Formula (1) | |
|---|---|---|---|---|---|---|---|---|---|
| 35 | R | 1175 | 936 | 56 | 492 | 72 | 564 | 0.69 | Example |
| 36 | R | 1225 | 932 | 39 | 491 | 73 | 564 | 0.12 | Example |
| 37 | S | 1235 | 980 | 42 | 509 | 35 | 544 | 0.80 | Example |
| 38 | S | 1180 | 884 | 53 | 525 | 19 | 544 | 1.17 | Example |
| 39 | T | 1245 | 992 | 36 | 503 | 29 | 532 | 0.78 | Example |
| 40 | T | 1200 | 986 | 41 | 501 | 31 | 532 | 0.23 | Example |
| 41 | U | 1180 | 966 | 53 | 532 | 34 | 566 | 1.45 | Example |
| 42 | U | 1240 | 978 | 43 | 537 | 29 | 566 | 1.04 | Example |
| 43 | V | 1260 | 974 | 39 | 532 | 26 | 558 | 1.15 | Example |
| 44 | V | 1200 | 992 | 49 | 509 | 49 | 558 | 0.84 | Example |
| 45 | W | 1175 | 986 | 55 | 506 | 52 | 558 | 0.79 | Example |
| 46 | W | 1235 | 918 | 41 | 545 | 13 | 558 | 1.25 | Example |
| 47 | X | 1265 | 966 | 53 | 524 | 17 | 541 | 0.71 | Example |
| 48 | X | 1235 | 928 | 43 | 499 | 42 | 541 | 0.73 | Example |
| 49 | Y | 1255 | 992 | 48 | 507 | 30 | 537 | 0.85 | Example |
| 50 | Y | 1235 | 922 | 57 | 541 | −4 | 537 | 1.01 | Comparative |
| 51 | Z | 1245 | 932 | 45 | 519 | 30 | 549 | 1.10 | Example |
| 52 | Z | 1175 | 880 | 46 | 390 | 159 | 549 | 0.00 | Example |
| 53 | AA | 1200 | 934 | 58 | 526 | 10 | 536 | 1.00 | Comparative |
| 54 | AB | 1260 | 994 | 44 | 512 | 23 | 535 | 0.91 | Comparative |
| 55 | AC | Test was terminated due to being cracked during casting process. | | | | | | | Comparative |
| 56 | AD | Test was terminated due to being cracked during casting process. | | | | | | | Comparative |
| 57 | AE | 1255 | 886 | 54 | 505 | 88 | 593 | 1.12 | Comparative |
| 58 | AF | Test was terminated due to being cracked during casting process. | | | | | | | Comparative |
| 59 | AG | 1205 | 936 | 54 | 504 | 35 | 539 | 0.85 | Comparative |

TABLE 4-continued

| Hot-rolled steel sheet | Chemical component | Hot rolling conditions: Heating temperature ° C. | Rolling completion temperature ° C. | Average cooling rate 1 ° C./sec | Winding temperature ° C. | Bs—winding temperature ° C. | Bs ° C. | Left side of Formula (1) | |
|---|---|---|---|---|---|---|---|---|---|
| 60 | AH | Test was terminated due to being cracked during casting process. | | | | | | | Comparative |
| 61 | AI | 1255 | 928 | 46 | 492 | 50 | 542 | 0.67 | Comparative |
| 62 | AJ | 1175 | 892 | 50 | 511 | 22 | 533 | 0.71 | Comparative |
| 63 | AK | 1220 | 907 | 47 | 485 | 36 | 521 | 0.63 | Example |
| 64 | AL | 1205 | 956 | 51 | 505 | 14 | 519 | 0.64 | Example |
| 65 | I | 1225 | 917 | 22 | 533 | 18 | 551 | 1.01 | Comparative |
| 66 | K | 1200 | 913 | 17 | 525 | 27 | 552 | 1.05 | Comparative |
| 67 | O | 1195 | 900 | 9 | 524 | 25 | 549 | 1.11 | Comparative |
| 68 | W | 1215 | 925 | 11 | 530 | 28 | 558 | 1.12 | Comparative |

※A value with underline indicates that the value is out of the scope of the invention.

The hot-rolled steel sheets were treated under conditions shown in Tables 5 to 9 to provide steel sheets for heat treatment.

Examples with an indication of "to manufacturing method A" in Tables 5 to 9 are manufacturing examples by the manufacturing method a1 (without the intermediate heat treatment). The hot-rolled steel sheets with the mark "-" for the cold rolling ratio 2 were directly used as the steel sheets for heat treatment. For instance, a hot-rolled steel sheet 10 was directly used as a steel sheet 10 for heat treatment. Moreover, the steel sheets with the indication of "to manufacturing method A" in Tables 5 to 9 and with numerical values entered in the cold rolling ratio 2 were used as steel sheets for heat treatment after subjecting the hot-rolled steel sheets to cold rolling with the rolling reduction of the cold rolling ratio 2.

On the other hand, Examples with the indication of the intermediate heat treatment conditions in Tables 5 to 9 are manufacturing examples by the manufacturing method a2 (with the intermediate heat treatment). The cold rolling ratio 1 is a rolling ratio in the first cold rolling. The cold rolling ratio 2 is a rolling ratio in the second cold rolling. When each rolling ratio is denoted by the mark "-", the corresponding cold rolling was not performed.

TABLE 5

| Steel sheet for heat treatment | Hot-rolled steel sheet | Chemical component | Cold rolling ratio 1 % | Intermediate heat treatment: Left side of Formula (2) | Maximum heating temperature ° C. | Maximum heating temperature—Ac3 ° C. | Ac3 ° C. | Cooling rate 1 ° C./sec | Cooling rate 2 ° C./sec | Dwell time sec | Cooling rate 3 ° C./sec | Cold rolling ratio 2 ° C. | Plate thickness mm | Bs ° C. | Ms ° C. | |
|---|---|---|---|---|---|---|---|---|---|---|---|---|---|---|---|---|
| 1a | 1 | A | | | | to manufacturing method A | | | | | | 3.2 | 3.0 | 521 | 400 | Example |
| 1b | 1 | A | 40 | 0.83 | 860 | 23 | 837 | 103 | 62 | 195 | 54 | — | 1.8 | 521 | 400 | Example |
| 1c | 1 | A | 40 | 1.15 | 853 | 16 | 837 | 58 | 28 | 56 | 26 | — | 1.8 | 521 | 400 | Comparative |
| 1d | 1 | A | 40 | 0.83 | 812 | −25 | 837 | 41 | 30 | 69 | 22 | — | 1.8 | 521 | 400 | Comparative |
| 1e | 1 | A | — | 0.69 | 862 | 17 | 845 | 47 | 43 | 344 | 16 | 1.4 | 3.0 | 521 | 400 | Example |
| 2a | 2 | A | | | | to manufacturing method A | | | | | | — | 2.0 | 521 | 400 | Comparative |
| 3a | 3 | B | | | | to manufacturing method A | | | | | | 1.4 | 2.4 | 560 | 455 | Example |
| 3b | 3 | B | — | 0.75 | 876 | 14 | 862 | 37 | 29 | 54 | 42 | 4.5 | 2.4 | 560 | 455 | Example |
| 3c | 3 | B | 67 | 0.54 | 885 | 19 | 866 | 52 | 29 | 24 | 9 | 0.7 | 0.8 | 560 | 455 | Example |
| 5a | 5 | C | | | | to manufacturing method A | | | | | | 1.7 | 3.1 | 519 | 374 | Comparative |
| 6a | 6 | C | 60 | 0.78 | 830 | −17 | 847 | 65 | 28 | 47 | 11 | 2.3 | 1.2 | 519 | 374 | Example |
| 6b | 6 | C | | | | to manufacturing method A | | | | | | 2.4 | 3.0 | 519 | 374 | Example |
| 7a | 7 | D | 0.5 | 0.51 | 865 | 7 | 858 | 62 | 32 | 27 | 12 | 3.4 | 4.5 | 575 | 482 | Example |
| 7b | 7 | D | | | | to manufacturing method A | | | | | | 0.5 | 4.5 | 575 | 482 | Example |
| 8a | 8 | D | 70 | 0.83 | 890 | 28 | 862 | 43 | 32 | 46 | 6 | 2.9 | 0.9 | 575 | 482 | Example |
| 8b | 8 | D | | | | to manufacturing method A | | | | | | 0.3 | 3.0 | 575 | 482 | Example |
| 9c | 9 | E | | | | to manufacturing method A | | | | | | 0.6 | 2.4 | 566 | 391 | Comparative |
| 10 | 10 | E | | | | to manufacturing method A | | | | | | — | 2.1 | 566 | 391 | Example |
| 11 | 11 | F | | | | to manufacturing method A | | | | | | 2.8 | 1.8 | 538 | 384 | Example |
| 12 | 12 | F | | | | to manufacturing method A | | | | | | 2.7 | 2.3 | 538 | 384 | Example |
| 13 | 13 | G | | | | to manufacturing method A | | | | | | 3.3 | 3.2 | 530 | 398 | Example |
| 14 | 14 | G | | | | to manufacturing method A | | | | | | 2.7 | 3.0 | 530 | 398 | Example |
| 15 | 15 | H | | | | to manufacturing method A | | | | | | 0.2 | 2.3 | 521 | 406 | Example |
| 16 | 16 | H | | | | to manufacturing method A | | | | | | 2.4 | 2.7 | 521 | 406 | Example |

※A value with underline indicates that the value is out of the scope of the invention.

TABLE 6

| Steel sheet for heat treatment | Hot-rolled steel sheet | Chemical component | Cold rolling ratio1 % | Intermediate heat treatment: Left side of Formula (2) | Maximum heating temperature ° C. | Maximum heating temperature—Ac3 ° C. | Ac3 ° C. | Cooling rate 1 ° C./sec | Cooling rate 2 ° C./sec | Dwell time sec | Cooling rate 3 ° C./sec | Cold rolling ratio 2 ° C. | Plate thickness mm | Bs ° C. | Ms ° C. | |
|---|---|---|---|---|---|---|---|---|---|---|---|---|---|---|---|---|
| 17 | 17 | I | | | | to manufacturing method A | | | | | | 3.7 | 2.4 | 551 | 436 | Example |
| 18a | 18 | I | 50 | 0.79 | 960 | 25 | 935 | 34 | 26 | 166 | 151 | — | 1.2 | 551 | 436 | Comparative |
| 18b | 18 | I | 50 | 0.83 | 928 | −7 | 935 | 80 | 33 | 36 | 4 | 0.5 | 1.2 | 551 | 436 | Example |
| 18c | 18 | I | 75 | 0.81 | 944 | 19 | 925 | 58 | 43 | 525 | 14 | 1.7 | 0.6 | 551 | 436 | Example |
| 19a | 19 | J | 25 | 0.79 | 815 | 1 | 814 | 103 | 32 | 328 | 32 | — | 3.0 | 543 | 401 | Example |
| 19b | 19 | J | | | | to manufacturing method A | | | | | | 3.7 | 4.0 | 543 | 401 | Example |
| 20a | 20 | J | 8 | 0.38 | 833 | 14 | 819 | 37 | 60 | 51 | 29 | — | 2.0 | 543 | 401 | Example |
| 20b | 20 | J | | | | to manufacturing method A | | | | | | — | 2.1 | 543 | 401 | Example |
| 21a | 21 | K | 6 | 0.88 | 873 | 7 | 866 | 85 | 59 | 41 | 15 | 6.5 | 2.0 | 552 | 456 | Example |
| 21b | 21 | K | | | | to manufacturing method A | | | | | | 1.3 | 2.1 | 552 | 456 | Example |
| 22a | 22 | K | 15 | 0.91 | 860 | −4 | 864 | 57 | 59 | 22 | 6 | 3.4 | 1.8 | 552 | 456 | Example |
| 23 | 23 | L | | | | to manufacturing method A | | | | | | 2.7 | 2.2 | 552 | 439 | Example |
| 24a | 24 | L | 60 | 0.88 | 880 | 10 | 870 | 44 | 46 | 15 | 15 | 2.4 | 2.0 | 552 | 439 | Example |
| 24b | 24 | L | 60 | 0.81 | 816 | −54 | 870 | 83 | 48 | 30 | 5 | 2.4 | 2.0 | 552 | 439 | Comparative |
| 24c | 24 | L | | | | to manufacturing method A | | | | | | 3.1 | 5.0 | 552 | 439 | Example |
| 25a | 25 | M | 73 | 0.88 | 950 | 8 | 942 | 97 | 32 | 32 | 15 | 2.6 | 0.8 | 553 | 448 | Example |
| 25b | 25 | M | 73 | 0.83 | 951 | 9 | 942 | 39 | 10 | 40 | 32 | 2.7 | 0.8 | 553 | 448 | Comparative |
| 25c | 25 | M | | | | to manufacturing method A | | | | | | 6.2 | 3.0 | 553 | 448 | Example |
| 26 | 26 | M | | | | to manufacturing method A | | | | | | 1.6 | 2.5 | 553 | 448 | Example |
| 27a | 27 | N | 37 | 0.64 | 870 | 10 | 860 | 101 | 60 | 16 | 27 | 3.5 | 1.9 | 565 | 404 | Example |
| 27b | 27 | N | 37 | 0.55 | 870 | 10 | 860 | 54 | 33 | 1279 | 14 | 2.6 | 1.9 | 565 | 404 | Comparative |
| 27c | 27 | N | | | | to manufacturing method A | | | | | | 0.3 | 3.0 | 565 | 404 | Example |
| 28 | 28 | N | | | | to manufacturing method A | | | | | | 3.7 | 3.0 | 565 | 404 | Example |
| 29 | 29 | O | | | | to manufacturing method A | | | | | | 8.7 | 3.5 | 549 | 434 | Example |

※A value with underline indicates that the value is out of the scope of the invention.

TABLE 7

| Steel sheet for heat treatment | Hot-rolled steel sheet | Chemical component | Cold rolling ratio 1 % | Intermediate heat treatment: Left side of Formula (2) | Maximum heating temperature ° C. | Maximum heating temperature—Ac3 ° C. | Ac3 ° C. | Cooling rate 1 ° C./sec | Cooling rate 2 ° C./sec | Dwell time sec | Cooling rate 3 ° C./sec | Cold rolling ratio 2 ° C. | Plate thickness mm | Bs ° C. | Ms ° C. | |
|---|---|---|---|---|---|---|---|---|---|---|---|---|---|---|---|---|
| 30a | 30 | O | 80 | 0.79 | 873 | 15 | 858 | 79 | 29 | 45 | 12 | 1.6 | 0.8 | 549 | 434 | Example |
| 30b | 30 | O | 50 | 0.80 | 880 | 16 | 864 | 38 | 28 | 348 | 46 | 3.3 | 2.0 | 549 | 434 | Example |
| 30c | 30 | O | 50 | 0.79 | 879 | 15 | 864 | 8 | 33 | 58 | 4 | 0.6 | 2.0 | 549 | 434 | Comparative |
| 31 | 31 | P | | | | to manufacturing method A | | | | | | — | 1.8 | 563 | 444 | Example |
| 32d | 32 | P | | | | to manufacturing method A | | | | | | — | 2.0 | 563 | 444 | Comparative |
| 33a | 33 | Q | 50 | 0.90 | 935 | 15 | 920 | 61 | 33 | 152 | 3 | 0.7 | 1.5 | 578 | 454 | Example |
| 33b | 33 | Q | | | | to manufacturing method A | | | | | | 1.5 | 3.0 | 578 | 454 | Example |
| 34a | 34 | Q | 50 | 0.75 | 928 | 12 | 916 | 38 | 28 | 60 | 4 | 3.3 | 1.5 | 578 | 454 | Example |
| 34b | 34 | Q | | | | to manufacturing method A | | | | | | 3.6 | 3.0 | 578 | 454 | Example |
| 35a | 35 | R | 50 | 0.77 | 940 | 92 | 848 | 105 | 29 | 22 | 6 | — | 1.2 | 564 | 439 | Example |
| 35b | 35 | R | | | | to manufacturing method A | | | | | | — | 2.4 | 564 | 439 | Example |
| 36a | 36 | R | 50 | 0.84 | 843 | −4 | 847 | 78 | 28 | 399 | 14 | 0.1 | 1.0 | 564 | 439 | Example |
| 36b | 36 | R | | | | to manufacturing method A | | | | | | 1.4 | 2.0 | 564 | 439 | Example |
| 37a | 37 | S | 0.6 | 0.66 | 875 | 25 | 850 | 103 | 60 | 319 | 25 | 6.1 | 3.0 | 544 | 431 | Example |
| 37b | 37 | S | | | | to manufacturing method A | | | | | | 3.4 | 3.0 | 544 | 431 | Example |
| 38a | 38 | S | 13 | 0.76 | 840 | −13 | 853 | 57 | 32 | 42 | 11 | 3.3 | 3.5 | 544 | 431 | Example |
| 38b | 38 | S | | | | to manufacturing method A | | | | | | 3.8 | 4.0 | 544 | 431 | Example |
| 39a | 39 | T | 25 | 0.67 | 850 | 16 | 834 | 63 | 47 | 19 | 29 | 2.6 | 3.0 | 532 | 424 | Example |
| 39b | 39 | T | | | | to manufacturing method A | | | | | | 3.3 | 4.0 | 532 | 424 | Example |
| 40a | 40 | T | 25 | 0.80 | 860 | 27 | 833 | 46 | 31 | 53 | 13 | 3.4 | 1.2 | 532 | 424 | Example |

TABLE 7-continued

| Steel sheet for heat treatment | Hot-rolled steel sheet | Chemical component | Cold rolling ratio 1 % | Intermediate heat treatment: Left side of Formula (2) | Maximum heating temperature ° C. | Maximum heating temperature—Ac3 ° C. | Ac3 ° C. | Cooling rate 1 ° C./sec | Cooling rate 2 ° C./sec | Dwell time sec | Cooling rate 3 ° C./sec | Cold rolling ratio 2 ° C. | Plate thickness mm | Bs ° C. | Ms ° C. | |
|---|---|---|---|---|---|---|---|---|---|---|---|---|---|---|---|---|
| 40b | 40 | T | | | | to manufacturing method A | | | | | | 3.6 | 1.6 | 532 | 424 | Example |
| 41a | 41 | U | 75 | 0.94 | 1012 | 22 | 990 | 47 | 29 | 330 | 19 | 3.9 | 0.6 | 566 | 453 | Example |
| 41b | 41 | U | | | | to manufacturing method A | | | | | | 6.4 | 2.4 | 566 | 453 | Example |

※A value with underline indicates that the value is out of the scope of the invention.

15

TABLE 8

| Steel sheet for heat treatment | Hot-rolled steel sheet | Chemical component | Cold rolling ratio 1 % | Intermediate heat treatment: Left side of Formula (2) | Maximum heating temperature ° C. | Maximum heating temperature—Ac3 ° C. | Ac3 ° C. | Cooling rate 1 ° C./sec | Cooling rate 2 ° C./sec | Dwell time sec | Cooling rate 3 ° C./sec | Cold rolling ratio 2 ° C. | Plate thickness mm | Bs ° C. | Ms ° C. | |
|---|---|---|---|---|---|---|---|---|---|---|---|---|---|---|---|---|
| 42a | 42 | U | 75 | 0.83 | 990 | 3 | 987 | 40 | 60 | 23 | 16 | 3.6 | 0.6 | 566 | 453 | Example |
| 42b | 42 | U | | | | to manufacturing method A | | | | | | 2.8 | 2.4 | 566 | 453 | Example |
| 43a | 43 | V | 70 | 0.84 | 919 | 51 | 868 | 97 | 32 | 41 | 10 | 2.1 | 2.1 | 558 | 442 | Example |
| 43b | 43 | V | | | | to manufacturing method A | | | | | | 2.7 | 7.0 | 558 | 442 | Example |
| 44a | 44 | V | 70 | 0.87 | 860 | −4 | 864 | 101 | 32 | 65 | 5 | — | 0.9 | 558 | 442 | Example |
| 44b | 44 | V | | | | to manufacturing method A | | | | | | — | 3.0 | 558 | 442 | Example |
| 45a | 45 | W | 50 | 0.83 | 871 | 25 | 846 | 66 | 31 | 308 | 6 | 3.4 | 1.0 | 558 | 440 | Example |
| 45b | 45 | W | | | | to manufacturing method A | | | | | | 2.7 | 2.0 | 558 | 440 | Example |
| 46a | 46 | W | 50 | 0.78 | 831 | −9 | 840 | 67 | 33 | 24 | 14 | 0.5 | 1.0 | 558 | 440 | Example |
| 47a | 47 | X | 60 | 0.69 | 824 | 14 | 810 | 39 | 62 | 18 | 10 | 3.0 | 1.2 | 541 | 400 | Example |
| 47b | 47 | X | 60 | 0.64 | 825 | 15 | 810 | 61 | 30 | 41 | 28 | 3.6 | 1.2 | 541 | 400 | Example |
| 47c | 47 | X | 40 | 0.68 | 820 | 8 | 812 | 38 | 5 | 47 | 3 | 3.5 | 1.8 | 541 | 400 | Comparative |
| 47d | 47 | X | | | | to manufacturing method A | | | | | | — | 3.0 | 541 | 400 | Example |
| 48a | 48 | X | 40 | 0.56 | 825 | 11 | 814 | 37 | 28 | 56 | 6 | — | 1.2 | 541 | 400 | Example |
| 48b | 48 | X | | | | to manufacturing method A | | | | | | 1.5 | 2.0 | 541 | 400 | Example |
| 49a | 49 | Y | 50 | 0.83 | 850 | 4 | 846 | 43 | 24 | 325 | 11 | 4.4 | 0.9 | 537 | 410 | Example |
| 49b | 49 | Y | | | | to manufacturing method A | | | | | | 4.4 | 1.8 | 537 | 410 | Example |
| 50b | 50 | Y | | | | to manufacturing method A | | | | | | 0.4 | 3.0 | 537 | 410 | Comparative |
| 51a | 51 | Z | 72 | 0.80 | 891 | 7 | 884 | 57 | 33 | 192 | 14 | 3.5 | 1.1 | 549 | 408 | Example |
| 51b | 51 | Z | | | | to manufacturing method A | | | | | | 3.3 | 3.9 | 549 | 408 | Example |
| 52a | 52 | Z | 50 | 0.93 | 895 | 9 | 886 | 62 | 33 | 52 | 5 | 0.3 | 1.0 | 549 | 408 | Example |
| 52b | 52 | Z | | | | to manufacturing method A | | | | | | 3.3 | 2.0 | 549 | 408 | Example |

※A value with underline indicates that the value is out of the scope of the invention.

TABLE 9

| Steel sheet for heat treatment | Hot-rolled steel sheet | Chemical component | Cold rolling ratio 1 % | Intermediate heat treatment: Left side of Formula (2) | Maximum heating temperature ° C. | Maximum heating temperature—Ac3 ° C. | Ac3 ° C. | Cooling rate 1 ° C./sec | Cooling rate 2 ° C./sec | Dwell time sec | Cooling rate 3 ° C./sec | Cold rolling ratio 2 ° C. | Plate thickness mm | Bs ° C. | Ms ° C. | |
|---|---|---|---|---|---|---|---|---|---|---|---|---|---|---|---|---|
| 53 | 53 | AA | | | | to manufacturing method A | | | | | | 0.6 | 2.5 | 536 | 470 | Example |
| 54 | 54 | AB | | | | to manufacturing method A | | | | | | 5.3 | 2.5 | 535 | 316 | Example |
| 55 | 55 | AC | | | | Test was terminated due to being cracked during casting process. | | | | | | | | | | Example |
| 56 | 56 | AD | | | | Test was terminated due to being cracked during casting process. | | | | | | | | | | Example |
| 57 | 57 | AE | | | | to manufacturing method A | | | | | | 3.7 | 2.5 | 593 | 464 | Example |
| 58 | 58 | AF | | | | Test was terminated due to being cracked during casting process. | | | | | | | | | | Example |

TABLE 9-continued

| Steel sheet for heat treatment | Hot-rolled steel sheet | Chemical component | Cold rolling ratio 1 % | Intermediate heat treatment: Left side of Formula (2) | Maximum heating temperature ° C. | Maximum heating temperature—Ac3 ° C. | Ac3 ° C. | Cooling rate 1 ° C./sec | Cooling rate 2 ° C./sec | Dwell time sec | Cooling rate 3 ° C./sec | Cold rolling ratio 2 ° C. | Plate thickness mm | Bs ° C. | Ms ° C. | |
|---|---|---|---|---|---|---|---|---|---|---|---|---|---|---|---|---|
| 59 | 59 | AG | | | | to manufacturing method A | | | | | | 1.3 | 2.5 | 539 | 409 | Example |
| 60 | 60 | AH | | | | Test was terminated due to being cracked during casting process. | | | | | | | | | | Example |
| 61 | 61 | AI | | | | to manufacturing method A | | | | | | 0.6 | 2.5 | 542 | 417 | Example |
| 62 | 62 | AJ | | | | to manufacturing method A | | | | | | 2.4 | 2.5 | 533 | 402 | Example |
| 63 | 63 | AK | 40 | 0.79 | 870 | 32 | 838 | 100 | 59 | 180 | 25 | 0.2 | 1.8 | 521 | 400 | Comparative |
| 64 | 64 | AL | 60 | 0.75 | 840 | 6 | 834 | 62 | 30 | 50 | 15 | 0.3 | 1.2 | 519 | 374 | Comparative |
| 65 | 65 | I | | | | to manufacturing method A | | | | | | 3.4 | 2.4 | 551 | 436 | Example |
| 66 | 66 | K | | | | to manufacturing method A | | | | | | 2.6 | 2.1 | 552 | 456 | Example |
| 67 | 67 | O | | | | to manufacturing method A | | | | | | 3.5 | 4.0 | 549 | 434 | Example |
| 68 | 68 | W | | | | to manufacturing method A | | | | | | 2.6 | 2.0 | 558 | 440 | Example |
| 1f | 1 | A | | | | to manufacturing method A | | | | | | 40 | 1.8 | 521 | 400 | Example |
| 3d | 3 | B | — | 0.75 | 876 | 14 | 862 | 37 | 29 | 54 | 42 | 16 | 2.1 | 560 | 455 | Example |

※A value with underline indicates that the value is out of the scope of the invention.

Tables 10 to 14 show microstructures of the obtained steel sheets for heat treatment. In the microstructures, M refers to martensite, tempered M represents tempered martensite, B refers to bainite, BF refers to bainitic ferrite, polygonal α refers to polygonal ferrite, and residual γ refers to residual austenite.

TABLE 10

| Steel sheet for heat treatment | Hot-rolled steel sheet | Chemical component | Steel sheet for heat treatment: Volume fraction: Lath structure: M % | Tempered M % | B % | BF % | SUM % | Aggregated α % | Residual γ % | Others % | Coarse aggregated residual γ % | Mn-concentrated region % | |
|---|---|---|---|---|---|---|---|---|---|---|---|---|---|
| 1a | 1 | A | 1 | 13 | 49 | 25 | 88 | 12 | 0.1 | 0 | 0.0 | 0.2 | Example |
| 1b | 1 | A | 40 | 0 | 34 | 17 | 91 | 7 | 0 | 2 | 0.0 | 0.5 | Example |
| 1c | 1 | A | 45 | 7 | 25 | 19 | 96 | 0 | 1 | 3 | 0.5 | 4 | Comparative |
| 1d | 1 | A | 21 | 0 | 15 | 28 | 64 | 36 | 0 | 0 | 0.0 | 1 | Comparative |
| 1e | 1 | A | 32 | 0 | 35 | 17 | 84 | 13 | 0.3 | 3 | 0.0 | 0.4 | Example |
| 2a | 2 | A | 0 | 0 | 0 | 0 | 0 | 78 | 0 | 22 | 0.0 | 6 | Comparative |
| 3a | 3 | B | 0 | 6 | 67 | 20 | 93 | 7 | 0.1 | 0 | 0.0 | 0.6 | Example |
| 3b | 3 | B | 49 | 0 | 30 | 6 | 85 | 12 | 0 | 3 | 0.0 | 0.4 | Example |
| 3c | 3 | B | 51 | 0 | 32 | 7 | 90 | 9 | 0 | 1 | 0.0 | 0.4 | Example |
| 5a | 5 | C | 8 | 3 | 10 | 47 | 68 | 26 | 5 | 1 | 1.6 | 4 | Comparative |
| 6a | 6 | C | 34 | 20 | 10 | 20 | 84 | 13 | 0.7 | 2 | 0.0 | 0.6 | Example |
| 6b | 6 | C | 8 | 2 | 41 | 33 | 84 | 16 | 0.4 | 0 | 0.0 | 0.5 | Example |
| 7a | 7 | D | 45 | 0 | 36 | 3 | 84 | 15 | 0.1 | 1 | 0.0 | 0.3 | Example |
| 7b | 7 | D | 5 | 6 | 71 | 8 | 90 | 8 | 0.0 | 2 | 0.0 | 0.5 | Example |
| 8a | 8 | D | 47 | 0 | 38 | 4 | 89 | 9 | 0.1 | 2 | 0.0 | 0.9 | Example |
| 8b | 8 | D | 2 | 0 | 83 | 0 | 85 | 14 | 1.0 | 0 | 0.3 | 1.6 | Example |
| 9c | 9 | E | 0 | 0 | 80 | 7 | 87 | 3 | 4 | 6 | 2.9 | 5 | Comparative |
| 10 | 10 | E | 2 | 15 | 65 | 4 | 86 | 13 | 0.0 | 1 | 0.0 | 0.4 | Example |
| 11 | 11 | F | 7 | 13 | 23 | 45 | 88 | 9 | 0.7 | 2 | 0.0 | 0.5 | Example |
| 12 | 12 | F | 26 | 54 | 0 | 14 | 94 | 4 | 0.0 | 2 | 0.0 | 0.0 | Example |
| 13 | 13 | G | 5 | 0 | 67 | 25 | 97 | 0 | 0.0 | 3 | 0.0 | 0.3 | Example |
| 14 | 14 | G | 0 | 0 | 99 | 0 | 99 | 0 | 0.5 | 1 | 0.0 | 0.6 | Example |
| 15 | 15 | H | 17 | 0 | 38 | 42 | 97 | 3 | 0.0 | 0 | 0.0 | 0.0 | Example |
| 16 | 16 | H | 8 | 5 | 54 | 25 | 92 | 7 | 0.8 | 0 | 0.0 | 0.3 | Example |

※A value with underline indicates that the value is out of the favorable scope of the invention.

TABLE 11

| Steel sheet for heat treatment | | | | | | | | | | | | | |
|---|---|---|---|---|---|---|---|---|---|---|---|---|---|
| | | | Volume fraction | | | | | | | | | | |
| | | | Lath structure | | | | | | | | Coarse | Mn- | |
| Steel sheet for heat treatment | Hot-rolled steel sheet | Chemical component | M % | Tempered M % | B % | BF % | SUM % | Aggregated α % | Residual γ % | Others % | aggregated residual γ % | concentrated region % | |
| 17 | 17 | I | 0 | 0 | 90 | 5 | 95 | 3 | 0.0 | 2 | 0.0 | 0.0 | Example |
| 18a | 18 | I | 27 | 0 | 29 | 39 | 95 | 1 | 4 | 0 | 3.0 | 0.4 | Comparative |
| 18b | 18 | I | 51 | 0 | 38 | 10 | 99 | 0 | 0 | 1 | 0.0 | 0.6 | Example |
| 18c | 18 | I | 34 | 0 | 57 | 8 | 99 | 0 | 0 | 1 | 0.0 | 0.4 | Example |
| 19a | 19 | J | 32 | 0 | 53 | 4 | 89 | 10 | 0 | 1 | 0.0 | 0.6 | Example |
| 19b | 19 | J | 6 | 0 | 78 | 0 | 84 | 16 | 0.0 | 0 | 0.0 | 0.0 | Example |
| 20a | 20 | J | 39 | 5 | 35 | 2 | 81 | 16 | 0 | 3 | 0.0 | 0.1 | Example |
| 20b | 20 | J | 8 | 7 | 76 | 0 | 91 | 7 | 0.3 | 2 | 0.0 | 0.5 | Example |
| 21a | 21 | K | 44 | 0 | 31 | 12 | 87 | 11 | 0 | 2 | 0.0 | 0.6 | Example |
| 21b | 21 | K | 4 | 0 | 55 | 26 | 85 | 14 | 0.3 | 1 | 0.0 | 0.5 | Example |
| 22a | 22 | K | 49 | 0 | 26 | 11 | 86 | 12 | 0.1 | 2 | 0.0 | 0.9 | Example |
| 23 | 23 | L | 14 | 5 | 4 | 65 | 88 | 10 | 1.1 | 1 | 0.2 | 1.0 | Example |
| 24a | 24 | L | 51 | 0 | 14 | 20 | 85 | 14 | 0.7 | 0 | 0.0 | 0.7 | Example |
| 24b | 24 | L | 18 | 2 | 16 | 1 | 37 | 63 | 0 | 0 | 0.0 | 0 | Comparative |
| 24c | 24 | L | 10 | 0 | 26 | 54 | 90 | 9 | 0.1 | 1 | 0.0 | 0.1 | Example |
| 25a | 25 | M | 41 | 0 | 5 | 43 | 89 | 9 | 0 | 2 | 0.0 | 0.7 | Example |
| 25b | 25 | M | 27 | 3 | 5 | 48 | 83 | 12 | 5 | 0 | 3.5 | 1.5 | Comparative |
| 25c | 25 | M | 13 | 0 | 5 | 66 | 84 | 13 | 1.4 | 2 | 0.2 | 1.3 | Example |
| 26 | 26 | M | 7 | 12 | 15 | 55 | 89 | 10 | 0.8 | 0 | 0.0 | 0.7 | Example |
| 27a | 27 | N | 44 | 0 | 17 | 25 | 86 | 11 | 0.4 | 3 | 0.0 | 0.3 | Example |
| 27b | 27 | N | 12 | 0 | 1 | 83 | 96 | 0 | 4 | 0 | 0.5 | 3 | Comparative |
| 27c | 27 | N | 6 | 9 | 25 | 43 | 83 | 17 | 0.4 | 0 | 0.0 | 0.6 | Example |
| 28 | 28 | N | 16 | 0 | 0 | 81 | 97 | 3 | 0.1 | 0 | 0.0 | 0.1 | Example |
| 29 | 29 | O | 2 | 0 | 13 | 73 | 88 | 6 | 1.6 | 4 | 1.3 | 1.4 | Example |

※A value with underline indicates that the value is out of the favorable scope of the invention.

TABLE 12

| Steel sheet for heat treatment | | | | | | | | | | | | | |
|---|---|---|---|---|---|---|---|---|---|---|---|---|---|
| | | | Volume fraction | | | | | | | | | | |
| | | | Lath structure | | | | | | | | Coarse | Mn- | |
| Steel sheet for heat treatment | Hot-rolled steel sheet | Chemical component | M % | Tempered M % | B % | BF % | SUM % | Aggregated α % | Residual γ % | Others % | aggregated residual γ % | concentrated region % | |
| 30a | 30 | O | 36 | 0 | 13 | 49 | 98 | 0 | 0.6 | 1 | 0.0 | 0.7 | Example |
| 30b | 30 | O | 15 | 0 | 12 | 57 | 84 | 14 | 0 | 2 | 0.0 | 0.7 | Example |
| 30c | 30 | O | 12 | 0 | 15 | 14 | 41 | 58 | 0 | 1 | 0.0 | 1 | Comparative |
| 31 | 31 | P | 2 | 0 | 13 | 70 | 85 | 13 | 0.8 | 1 | 0.0 | 0.9 | Example |
| 32d | 32 | P | 12 | 15 | 11 | 51 | 89 | 3 | 7 | 1 | 4.1 | 6 | Comparative |
| 33a | 33 | Q | 38 | 0 | 18 | 35 | 91 | 8 | 0 | 1 | 0.0 | 1 | Example |
| 33b | 33 | Q | 5 | 0 | 31 | 56 | 92 | 6 | 0.0 | 2 | 0.0 | 0.0 | Example |
| 34a | 34 | Q | 43 | 0 | 14 | 26 | 83 | 15 | 0 | 2 | 0.0 | 0.4 | Example |
| 34b | 34 | Q | 15 | 0 | 11 | 69 | 95 | 4 | 0.1 | 1 | 0.0 | 0.2 | Example |
| 35a | 35 | R | 49 | 0 | 31 | 13 | 93 | 5 | 0 | 2 | 0.0 | 0.5 | Example |
| 35b | 35 | R | 0 | 32 | 45 | 12 | 89 | 10 | 0.0 | 1 | 0.0 | 0.5 | Example |
| 36a | 36 | R | 0 | 23 | 45 | 18 | 86 | 12 | 0 | 2 | 0.0 | 1 | Example |
| 36b | 36 | R | 8 | 0 | 72 | 5 | 85 | 13 | 0.0 | 2 | 0.0 | 0.0 | Example |
| 37a | 37 | S | 33 | 0 | 42 | 19 | 94 | 3 | 0 | 3 | 0.0 | 0.2 | Example |
| 37b | 37 | S | 2 | 13 | 65 | 10 | 90 | 8 | 0.5 | 2 | 0.2 | 0.3 | Example |
| 38a | 38 | S | 35 | 15 | 23 | 11 | 84 | 14 | 0.1 | 2 | 0.0 | 0.5 | Example |
| 38b | 38 | S | 1 | 32 | 43 | 16 | 92 | 7 | 0.2 | 1 | 0.0 | 0.7 | Example |
| 39a | 39 | T | 55 | 0 | 40 | 5 | 100 | 0 | 0 | 0 | 0.0 | 0.2 | Example |
| 39b | 39 | T | 9 | 27 | 34 | 24 | 94 | 6 | 0.0 | 0 | 0.0 | 0.3 | Example |
| 40a | 40 | T | 49 | 0 | 36 | 6 | 91 | 7 | 0 | 2 | 0.0 | 0.7 | Example |
| 40b | 40 | T | 36 | 11 | 25 | 13 | 85 | 15 | 0.0 | 0 | 0.0 | 0.0 | Example |
| 41a | 41 | U | 35 | 0 | 46 | 4 | 85 | 13 | 0.1 | 2 | 0.0 | 0.8 | Example |
| 41b | 41 | U | 2 | 0 | 93 | 0 | 95 | 4 | 0.7 | 0 | 0.5 | 1.1 | Example |

※A value with underline indicates that the value is out of the favorable scope of the invention.

TABLE 13

| Steel sheet for heat treatment | | | Steel sheet for heat treatment | | | | | | | | | | |
|---|---|---|---|---|---|---|---|---|---|---|---|---|---|
| | | | Volume fraction | | | | | | | | Coarse | Mn- | |
| Steel sheet | | | Lath structure | | | | | Aggregated | Residual | | aggregated | concentrated | |
| for heat treatment | Hot-rolled steel sheet | Chemical component | M % | Tempered M % | B % | BF % | SUM % | α % | γ % | Others % | residual γ % | region % | |
| 42a | 42 | U | 50 | 0 | 33 | 3 | 86 | 12 | 0 | 2 | 0.0 | 0.5 | Example |
| 42b | 42 | U | 5 | 5 | 68 | 12 | 90 | 10 | 0.0 | 0 | 0.0 | 1.1 | Example |
| 43a | 43 | V | 0 | 61 | 37 | 0 | 98 | 2 | 0.3 | 0 | 0.0 | 0.6 | Example |
| 43b | 43 | V | 2 | 0 | 83 | 0 | 85 | 13 | 1.0 | 1 | 0.0 | 1.3 | Example |
| 44a | 44 | V | 30 | 0 | 32 | 20 | 82 | 16 | 1 | 1 | 0.3 | 0.9 | Example |
| 44b | 44 | V | 10 | 4 | 67 | 11 | 92 | 7 | 0.2 | 1 | 0.0 | 0.3 | Example |
| 45a | 45 | W | 25 | 6 | 46 | 6 | 83 | 14 | 1 | 2 | 0.2 | 0.8 | Example |
| 45b | 45 | W | 2 | 23 | 55 | 9 | 89 | 11 | 0.0 | 0 | 0.0 | 0.3 | Example |
| 46a | 46 | W | 45 | 0 | 34 | 4 | 83 | 16 | 0.1 | 1 | 0.0 | 0.7 | Example |
| 47a | 47 | X | 47 | 0 | 30 | 4 | 81 | 18 | 0.1 | 1 | 0.0 | 0.4 | Example |
| 47b | 47 | X | 44 | 0 | 34 | 5 | 83 | 16 | 0.1 | 1 | 0.0 | 0.5 | Example |
| 47c | 47 | X | 12 | 0 | 31 | 38 | 81 | 13 | 6 | 0 | 3.0 | 0.9 | Comparative |
| 47d | 47 | X | 9 | 0 | 70 | 9 | 88 | 12 | 0.0 | 0 | 0.0 | 0.5 | Example |
| 48a | 48 | X | 34 | 0 | 51 | 4 | 89 | 11 | 0.1 | 0 | 0.0 | 0.3 | Example |
| 48b | 48 | X | 9 | 11 | 40 | 26 | 86 | 14 | 0.0 | 0 | 0.0 | 0.2 | Example |
| 49a | 49 | Y | 0 | 31 | 35 | 22 | 88 | 10 | 0 | 2 | 0.0 | 0.5 | Example |
| 49b | 49 | Y | 2 | 20 | 53 | 18 | 93 | 6 | 0.9 | 0 | 0.3 | 0.7 | Example |
| 50b | 50 | Y | 0 | 0 | 35 | 25 | 60 | 30 | 3 | 7 | 1.3 | 4 | Comparative |
| 51a | 51 | Z | 28 | 0 | 14 | 39 | 81 | 16 | 0.3 | 3 | 0.0 | 0.3 | Example |
| 51b | 51 | Z | 14 | 4 | 67 | 0 | 85 | 13 | 0.5 | 2 | 0.1 | 0.6 | Example |
| 52a | 52 | Z | 44 | 0 | 16 | 32 | 92 | 8 | 0 | 0 | 0.0 | 1 | Example |
| 52b | 52 | Z | 7 | 63 | 13 | 5 | 88 | 10 | 0.0 | 2 | 0.0 | 0.0 | Example |

※A value with underline indicates that the value is out of the favorable scope of the invention.

TABLE 14

| Steel sheet for heat treatment | | | Steel sheet for heat treatment | | | | | | | | | | |
|---|---|---|---|---|---|---|---|---|---|---|---|---|---|
| | | | Volume fraction | | | | | | | | Coarse | Mn- | |
| Steel sheet | | | Lath structure | | | | | Aggregated | Residual | | aggregated | concentrated | |
| for heat treatment | Hot-rolled steel sheet | Chemical component | M % | Tempered M % | B % | BF % | SUM % | α % | γ % | Others % | residual γ % | region % | |
| 53 | 53 | AA | 0 | 0 | 1 | 5 | 6 | 93 | 0 | 1 | 0.0 | 0 | Comparative |
| 54 | 54 | AB | 3 | 5 | 54 | 33 | 95 | 2 | 1 | 2 | 0.2 | 1 | Comparative |
| 55 | 55 | AC | Test was terminated due to being cracked during casting process. | | | | | | | | | | Comparative |
| 56 | 56 | AD | Test was terminated due to being cracked during casting process. | | | | | | | | | | Comparative |
| 57 | 57 | AE | 6 | 0 | 0 | 10 | 16 | 72 | 1 | 11 | 0.3 | 6 | Comparative |
| 58 | 58 | AF | Test was terminated due to being cracked during casting process. | | | | | | | | | | Comparative |
| 59 | 59 | AG | 18 | 5 | 35 | 27 | 85 | 8 | 0 | 7 | 0.0 | 0 | Comparative |
| 60 | 60 | AH | Test was terminated due to being cracked during casting process. | | | | | | | | | | Comparative |
| 61 | 61 | AI | 9 | 7 | 54 | 18 | 88 | 7 | 1 | 4 | 0.0 | 1 | Comparative |
| 62 | 62 | AJ | 16 | 0 | 46 | 30 | 92 | 5 | 1 | 2 | 0.2 | 0 | Comparative |
| 63 | 63 | AK | 32 | 0 | 35 | 21 | 88 | 11 | 0.3 | 1 | 0.0 | 0.3 | Example |
| 64 | 64 | AL | 35 | 20 | 10 | 19 | 84 | 14 | 0.2 | 2 | 0.0 | 0.6 | Example |
| 65 | 65 | I | 5 | 0 | 41 | 17 | 63 | 37 | 0 | 0 | 0.0 | 0 | Comparative |
| 66 | 66 | K | 10 | 0 | 63 | 0 | 73 | 25 | 1 | 1 | 0.2 | 1 | Comparative |
| 67 | 67 | O | 15 | 0 | 8 | 25 | 48 | 45 | 6 | 1 | 1.3 | 1.5 | Comparative |
| 68 | 68 | W | 0 | 0 | 60 | 7 | 67 | 33 | 0 | 0 | 0.0 | 1.4 | Comparative |
| 1f | 1 | A | 0 | 0 | 0 | 0 | 0 | 15 | 0 | 85 | 0.0 | 0.2 | Comparative |
| 3d | 3 | B | 29 | 0 | 15 | 6 | 50 | 13 | 0 | 37 | 0.0 | 0.4 | Comparative |

※A value with underline indicates that the value is out of the scope of the invention.

Example 2: Manufacture of High-Strength Steel Sheet

By subjecting the steel sheets for heat treatment shown in Tables 10 to 14 to heat treatment (final heat treatment) under the conditions shown in Tables 15 to 20, high-strength steel sheets having excellent formability, toughness, and weldability can be obtained.

TABLE 15

| | | | | Final heat treatment | | | | | | |
|---|---|---|---|---|---|---|---|---|---|---|
| | | | | Heating | | | | | | |
| Experiment | Steel sheet for heat treatment | Hot-rolled steel sheet | Chemical component | Left side of Formula (3) | Maximum heating temperature ° C. | Maximum heating temperature-Ac1 ° C. | Ac1 ° C. | Ac3-Maximum heating temperature ° C. | Ac3 ° C. | Dwell time 1 sec |
| 1 | 1a | 1 | A | 1.0 | 788 | 72 | 716 | 40 | 828 | 91 |
| 2 | 1a | 1 | A | 2.3 | 771 | 55 | 716 | 57 | 828 | 108 |
| 3 | 1b | 1 | A | 1.0 | 762 | 43 | 719 | 76 | 838 | 92 |
| 4 | 1b | 1 | A | 1.2 | 733 | 14 | 719 | 105 | 838 | 104 |
| 5 | 1b | 1 | A | 1.0 | 845 | 126 | 719 | −7 | 838 | 94 |
| 6 | 1c | 1 | A | 1.2 | 808 | 86 | 722 | 27 | 835 | 57 |
| 7 | 1d | 1 | A | 0.8 | 795 | 75 | 720 | 43 | 838 | 44 |
| 8 | 1e | 1 | A | 0.9 | 761 | 47 | 714 | 79 | 840 | 106 |
| 9 | 1e | 1 | A | 1.5 | 791 | 77 | 714 | 49 | 840 | 42 |
| 10 | 2a | 2 | A | 0.8 | 813 | 95 | 718 | 25 | 838 | 106 |
| 16 | 3a | 3 | B | 1.1 | 788 | 61 | 727 | 78 | 866 | 62 |
| 17 | 3a | 3 | B | 0.8 | 821 | 94 | 727 | 45 | 866 | 60 |
| 18 | 3h | 3 | B | 1.2 | 841 | 116 | 725 | 20 | 861 | 90 |
| 19 | 3h | 3 | B | 0.8 | 834 | 109 | 725 | 27 | 861 | 73 |
| 20 | 3c | 3 | B | 0.8 | 829 | 108 | 721 | 41 | 870 | 60 |
| 21 | 3c | 3 | B | 0.8 | 804 | 83 | 721 | 66 | 870 | 88 |
| 24 | 5a | 5 | C | 1.0 | 786 | 55 | 731 | 60 | 846 | 45 |
| 28 | 6a | 6 | C | 1.1 | 808 | 72 | 736 | 38 | 846 | 87 |
| 29 | 6b | 6 | C | 0.9 | 776 | 40 | 736 | 70 | 846 | 72 |
| 30 | 7a | 7 | D | 0.8 | 829 | 110 | 719 | 29 | 858 | 101 |
| 31 | 7b | 7 | D | 1.0 | 828 | 119 | 709 | 32 | 860 | 48 |
| 32 | 8a | 8 | D | 1.7 | 816 | 94 | 722 | 42 | 858 | 71 |
| 33 | 8b | 8 | D | 1.1 | 779 | 54 | 725 | 74 | 853 | 105 |

| | Final heat treatment | | | | | | | | |
|---|---|---|---|---|---|---|---|---|---|
| | | | | | | Tempering treatment | | | |
| | Cooling | | | | | | | | |
| Experiment | Average cooling rate 1 ° C./sec | Left side of Formula (4) | Left side of Formula (5) | Average cooling rate 2 ° C./sec | Skin pass rolling rate % | Temperature ° C. | Time sec | Skin pass rolling after tempering % | |
| 1 | 105 | 0.32 | 0.22 | 1 | — | 345 | 27 | 0.4 | Example |
| 2 | 62 | 0.29 | 0.19 | 26 | — | — | — | — | Comparative |
| 3 | 83 | 0.55 | 0.38 | 2 | 0.1 | 360 | 1089 | 0.1 | Example |
| 4 | 91 | 0.38 | 0.26 | 16 | — | — | — | — | Comparative |
| 5 | 46 | 0.14 | 0.09 | 6 | 0.3 | — | — | — | Comparative |
| 6 | 57 | 0.50 | 0.34 | 9 | — | — | — | — | Comparative |
| 7 | 40 | 0.24 | 0.16 | 19 | 0.2 | — | — | — | Comparative |
| 8 | 99 | 0.64 | 0.44 | 6 | — | 288 | 192 | — | Example |
| 9 | 100 | 0.58 | 0.40 | 14 | 0.7 | — | — | — | Example |
| 10 | 39 | 0.25 | 0.17 | 2 | — | — | — | — | Comparative |
| 16 | 45 | 0.51 | 0.30 | 9 | 0.2 | 236 | 4 | 0.2 | Example |
| 17 | 44 | 0.87 | 1.08 | 9 | — | — | — | — | Comparative |
| 18 | 39 | 0.26 | 0.15 | 8 | 0.1 | — | — | — | Example |
| 19 | 13 | 0.53 | 0.31 | 22 | 0.1 | — | — | — | Comparative |
| 20 | 60 | 0.84 | 0.49 | 9 | 1.8 | — | — | — | Example |
| 21 | 103 | 1.38 | 0.82 | 4 | 1.8 | — | — | — | Comparative |
| 24 | 42 | 0.22 | 0.07 | 5 | — | — | — | — | Comparative |
| 28 | 68 | 0.29 | 0.09 | 1 | 0.8 | — | — | — | Example |
| 29 | 41 | 0.77 | 0.26 | 4 | 1.1 | — | — | — | Example |
| 30 | 46 | 0.31 | 0.36 | 14 | 0.1 | 310 | 50 | 0.8 | Example |
| 31 | 100 | 0.71 | 0.93 | 77 | 0.7 | — | — | — | Example |
| 32 | 47 | 0.43 | 0.71 | 7 | — | 340 | 36 | 0.2 | Example |
| 33 | 87 | 0.50 | 0.66 | 1 | — | — | — | — | Example |

X A value with underline indicates that the value is out of the scope of the invention.

TABLE 16

| | | | | Final heat treatment | | | | | | |
|---|---|---|---|---|---|---|---|---|---|---|
| | | | | Heating | | | | | | |
| Experiment | Steel sheet for heat treatment | Hot-rolled steel sheet | Chemical component | Left side of Formula (3) | Maximum heating temperature ° C. | Maximum heating temperature-Ac1 ° C. | Ac1 ° C. | Ac3-Maximum heating temperature ° C. | Ac3 ° C. | Dwell time 1 sec |
| 36 | 9c | 9 | E | 0.9 | 760 | 43 | 717 | 55 | 815 | 60 |
| 37 | 10 | 10 | E | 1.2 | 773 | 55 | 718 | 45 | 818 | 58 |
| 38 | 11 | 11 | F | 0.9 | 772 | 42 | 730 | 70 | 842 | 42 |
| 39 | 12 | 12 | F | 1.4 | 812 | 83 | 729 | 34 | 846 | 60 |
| 40 | 13 | 13 | G | 1.2 | 768 | 62 | 706 | 40 | 808 | 72 |
| 41 | 14 | 14 | G | 0.9 | 747 | 47 | 700 | 63 | 810 | 58 |
| 42 | 15 | 15 | H | 0.9 | 794 | 89 | 705 | 76 | 870 | 57 |
| 43 | 16 | 16 | H | 1.2 | 773 | 70 | 703 | 92 | 865 | 90 |
| 44 | 17 | 17 | I | 1.2 | 881 | 165 | 716 | 53 | 934 | 101 |
| 45 | 18a | 18 | I | 0.8 | 898 | 187 | 711 | 40 | 938 | 102 |
| 46 | 18b | 18 | I | 0.8 | 835 | 121 | 714 | 98 | 933 | 47 |
| 47 | 18c | 18 | I | 1.0 | 870 | 159 | 711 | 64 | 934 | 88 |
| 49 | 19a | 19 | J | 0.8 | 731 | 44 | 687 | 83 | 814 | 88 |
| 50 | 19a | 19 | J | 1.0 | 709 | 22 | 687 | 105 | 814 | 102 |
| 51 | 19b | 19 | J | 1.0 | 790 | 111 | 679 | 28 | 818 | 44 |
| 52 | 19b | 19 | J | 0.8 | 786 | 107 | 679 | 32 | 818 | 516 |
| 53 | 20a | 20 | J | 1.1 | 740 | 53 | 687 | 74 | 814 | 60 |
| 54 | 206 | 20 | J | 0.9 | 798 | 113 | 685 | 14 | 812 | 77 |
| 55 | 21a | 21 | K | 1.6 | 772 | 63 | 709 | 94 | 866 | 109 |
| 56 | 21b | 21 | K | 1.2 | 840 | 127 | 713 | 26 | 866 | 63 |
| 57 | 22a | 22 | K | 1.2 | 823 | 116 | 707 | 47 | 870 | 57 |
| 59 | 23 | 23 | L | 1.0 | 848 | 135 | 713 | 22 | 870 | 92 |
| 60 | 23 | 23 | L | 1.0 | 826 | 113 | 713 | 44 | 870 | 63 |

| | Final heat treatment | | | | | | | | |
|---|---|---|---|---|---|---|---|---|---|
| | | | | | | Tempering treatment | | | |
| | Cooling | | | | | | | | |
| Experiment | Average cooling rate 1 ° C./sec | Left side of Formula (4) | Left side of Formula (5) | Average cooling rate 2 ° C./sec | Skin pass rolling rate % | Temperature ° C. | Time sec | Skin pass rolling after tempering % | |
| 36 | 88 | 0.29 | 0.29 | 2 | 0.1 | — | — | — | Comparative |
| 37 | 37 | 0.86 | 0.70 | 21 | — | — | — | — | Example |
| 38 | 83 | 0.74 | 0.43 | 28 | — | — | — | — | Example |
| 39 | 47 | 0.76 | 0.38 | 8 | — | — | — | — | Example |
| 40 | 99 | 0.02 | 0.41 | 3 | — | — | — | — | Example |
| 41 | 43 | 0.01 | 0.18 | 4 | 0.3 | 327 | 224 | — | Example |
| 42 | 44 | 0.63 | 0.32 | 26 | 0.8 | 260 | 18 | 0.7 | Example |
| 43 | 40 | 0.89 | 0.45 | 4 | 0.1 | — | — | — | Example |
| 44 | 90 | 0.69 | 0.43 | 17 | — | — | — | — | Example |
| 45 | 91 | 0.55 | 0.33 | 8 | 0.3 | — | — | — | Comparative |
| 46 | 45 | 0.95 | 0.51 | 19 | | 371 | 4 | — | Example |
| 47 | 69 | 0.76 | 0.45 | 16 | — | — | — | — | Example |
| 49 | 40 | 0.30 | 0.61 | 7 | 0.3 | — | — | — | Example |
| 50 | 102 | 0.29 | 0.65 | 7 | 0.1 | — | — | — | Comparative |
| 51 | 38 | 0.38 | 0.82 | 7 | 1.7 | — | — | — | Example |
| 52 | 46 | 0.23 | 0.48 | 8 | — | — | — | — | Comparative |
| 53 | 72 | 0.07 | 0.17 | 15 | — | — | — | — | Example |
| 54 | 75 | 0.23 | 0.49 | 4 | 0.3 | — | — | — | Example |
| 55 | 38 | 0.82 | 0.42 | 26 | — | — | — | — | Example |
| 56 | 56 | 0.61 | 0.31 | 3 | — | 350 | 32 | 1.2 | Example |
| 57 | 102 | 0.87 | 0.49 | 8 | — | 312 | 7 | 0.2 | Example |
| 59 | 39 | 0.45 | 0.33 | 7 | — | — | — | — | Example |
| 60 | 43 | 1.54 | 0.39 | 2 | — | — | — | — | Comparative |

※A value with underline indicates that the value is out of the scope of the invention.

TABLE 17

| | | | | Final heat treatment | | | | | | |
|---|---|---|---|---|---|---|---|---|---|---|
| | | | | Heating | | | | | | |
| Experiment | Steel sheet for heat treatment | Hot-rolled steel sheet | Chemical component | Left side of Formula (3) | Maximum heating temperature ° C. | Maximum heating temperature-Ac1 ° C. | Ac1 ° C. | Ac3-Maximum heating temperature ° C. | Ac3 ° C. | Dwell time 1 sec |
| 61 | 24a | 24 | L | 0.9 | 794 | 93 | 701 | 71 | 865 | 89 |
| 62 | 24a | 24 | L | 0.8 | 772 | 71 | 701 | 93 | 865 | 56 |
| 63 | 24b | 24 | L | 0.8 | 777 | 67 | 710 | 89 | 866 | 46 |
| 64 | 24c | 24 | L | 0.8 | 788 | 72 | 716 | 84 | 872 | 44 |
| 65 | 25a | 25 | M | 0.9 | 880 | 128 | 752 | 62 | 942 | 59 |
| 66 | 25b | 25 | M | 1.1 | 880 | 130 | 750 | 53 | 933 | 90 |
| 67 | 25c | 25 | M | 0.9 | 899 | 154 | 745 | 36 | 935 | 73 |
| 68 | 26 | 26 | M | 1.2 | 897 | 142 | 755 | 43 | 940 | 89 |
| 69 | 27a | 27 | N | 0.9 | 798 | 45 | 753 | 62 | 860 | 71 |
| 70 | 27b | 27 | N | 1.0 | 800 | 50 | 750 | 61 | 861 | 87 |
| 71 | 27c | 27 | N | 1.0 | 822 | 72 | 750 | 38 | 860 | 45 |
| 72 | 27c | 27 | N | 1.1 | 857 | 107 | 750 | 3 | 860 | 47 |
| 73 | 28 | 28 | N | 0.8 | 813 | 60 | 753 | 47 | 860 | 64 |
| 74 | 29 | 29 | O | 1.0 | 796 | 82 | 714 | 72 | 868 | 109 |
| 75 | 30a | 30 | O | 0.8 | 817 | 107 | 710 | 46 | 863 | 43 |
| 76 | 30a | 30 | O | 1.1 | 840 | 130 | 710 | 23 | 863 | 59 |
| 77 | 30b | 30 | O | 0.9 | 804 | 90 | 714 | 66 | 870 | 77 |
| 78 | 30c | 30 | O | 0.9 | 770 | 59 | 711 | 93 | 863 | 48 |
| 80 | 31 | 31 | P | 1.1 | 885 | 142 | 743 | 27 | 912 | 62 |
| 85 | 32d | 32 | P | 1.0 | 835 | 102 | 733 | 67 | 902 | 63 |
| 86 | 33a | 33 | Q | 1.0 | 832 | 105 | 727 | 88 | 920 | 60 |
| 87 | 33h | 33 | Q | 1.2 | 890 | 163 | 727 | 32 | 922 | 60 |
| 88 | 34a | 34 | Q | 0.9 | 876 | 141 | 735 | 44 | 920 | 94 |

| | Final heat treatment | | | | | | | | |
|---|---|---|---|---|---|---|---|---|---|
| | | | | | | Tempering treatment | | | |
| | Cooling | | | | | | | | |
| Experiment | Average cooling rate 1 ° C./sec | Left side of Formula (4) | Left side of Formula (5) | Average cooling rate 2 ° C./sec | Skin pass rolling rate % | Temperature ° C. | Time sec | Skin pass rolling after tempering % | |
| 61 | 47 | 0.32 | 0.13 | 26 | — | — | — | — | Example |
| 62 | 23 | 0.81 | 0.22 | 5 | 0.7 | — | — | — | Comparative |
| 63 | 46 | 0.70 | 0.23 | 28 | 0.1 | — | — | — | Comparative |
| 64 | 38 | 0.62 | 0.21 | 12 | 0.1 | — | — | — | Example |
| 65 | 43 | 0.47 | 0.08 | 12 | 0.2 | — | — | — | Example |
| 66 | 55 | 0.37 | 0.06 | 24 | — | — | — | — | Comparative |
| 67 | 41 | 0.44 | 0.07 | 11 | — | 514 | 6 | — | Example |
| 68 | 107 | 0.76 | 0.13 | 11 | — | — | — | — | Example |
| 69 | 44 | 0.89 | 0.21 | 8 | — | — | — | — | Example |
| 70 | 46 | 0.88 | 0.19 | 8 | 0.3 | — | — | — | Comparative |
| 71 | 106 | 0.36 | 0.07 | 13 | — | 436 | 24 | 0.1 | Example |
| 72 | 47 | 0.89 | 0.21 | 9 | — | — | — | — | Example |
| 73 | 55 | 0.78 | 0.21 | 29 | 0.6 | — | — | — | Example |
| 74 | 40 | 0.72 | 0.14 | 7 | — | — | — | — | Example |
| 75 | 39 | 0.43 | 0.12 | 4 | — | — | — | — | Example |
| 76 | 71 | 0.49 | 0.10 | 12 | — | — | — | — | Example |
| 77 | 103 | 0.85 | 0.17 | 17 | 0.7 | 421 | 18 | 1.2 | Example |
| 78 | 39 | 0.87 | 0.20 | 6 | — | — | — | — | Comparative |
| 80 | 61 | 0.72 | 0.17 | 14 | — | — | — | — | Example |
| 85 | 38 | 0.66 | 0.20 | 2 | — | — | — | — | Comparative |
| 86 | 54 | 0.75 | 0.28 | 18 | 1.1 | — | — | — | Example |
| 87 | 106 | 0.93 | 0.33 | 16 | — | — | — | — | Example |
| 88 | 47 | 0.54 | 0.21 | 4 | — | 216 | 5663 | 0.2 | Example |

※A value with underline indicates that the value is out of the scope of the invention.

TABLE 18

| | | | | Final heat treatment | | | | | | |
|---|---|---|---|---|---|---|---|---|---|---|
| | | | | Heating | | | | | | |
| Experiment | Steel sheet for heat treatment | Hot-rolled steel sheet | Chemical component | Left side of Formula (3) | Maximum heating temperature ° C. | Maximum heating temperature-Ac1 ° C. | Ac1 ° C. | Ac3-Maximum heating temperature ° C. | Ac3 ° C. | Dwell time 1 sec |
| 89 | 34a | 34 | Q | 1.0 | 870 | 135 | 735 | 50 | 920 | 105 |
| 90 | 34b | 34 | Q | 1.1 | 895 | 170 | 725 | 24 | 919 | 109 |
| 91 | 35a | 35 | R | 1.0 | 790 | 65 | 725 | 58 | 848 | 89 |
| 92 | 35a | 35 | R | 1.1 | 860 | 135 | 725 | −12 | 848 | 87 |
| 93 | 35b | 35 | R | 0.8 | 812 | 92 | 720 | 30 | 842 | 107 |
| 94 | 36a | 36 | R | 0.9 | 785 | 55 | 730 | 65 | 850 | 75 |
| 95 | 36b | 36 | R | 1.3 | 799 | 77 | 722 | 51 | 850 | 58 |
| 96 | 37a | 37 | S | 1.2 | 771 | 64 | 707 | 79 | 850 | 103 |
| 97 | 37a | 37 | S | 1.8 | 764 | 57 | 707 | 86 | 850 | 56 |
| 98 | 37b | 37 | S | 1.0 | 820 | 116 | 704 | 31 | 851 | 61 |
| 99 | 37b | 37 | S | 0.8 | 735 | 31 | 704 | 116 | 851 | 109 |
| 100 | 38a | 38 | S | 1.0 | 781 | 79 | 702 | 64 | 845 | 89 |
| 101 | 38b | 38 | S | 1.1 | 787 | 81 | 706 | 61 | 848 | 75 |
| 102 | 39a | 39 | T | 0.9 | 805 | 121 | 684 | 29 | 834 | 102 |
| 103 | 39b | 39 | T | 0.8 | 808 | 118 | 690 | 30 | 838 | 57 |
| 104 | 40a | 40 | T | 1.1 | 818 | 145 | 673 | 16 | 834 | 62 |
| 105 | 40b | 40 | T | 1.1 | 796 | 106 | 690 | 44 | 840 | 74 |
| 106 | 41a | 41 | U | 1.9 | 896 | 150 | 746 | 94 | 990 | 72 |
| 107 | 41b | 41 | U | 1.2 | 890 | 140 | 750 | 90 | 980 | 56 |
| 108 | 41b | 41 | U | 0.9 | 897 | 147 | 750 | 83 | 980 | 58 |
| 109 | 42a | 42 | U | 1.1 | 920 | 184 | 736 | 65 | 985 | 90 |
| 110 | 42b | 42 | U | 0.8 | 911 | 166 | 745 | 77 | 988 | 75 |
| 111 | 43a | 43 | V | 1.4 | 843 | 126 | 717 | 25 | 868 | 105 |

| | Final heat treatment | | | | | | | | |
|---|---|---|---|---|---|---|---|---|---|
| | | | | | | Tempering treatment | | | |
| | Cooling | | | | | | | | |
| Experiment | Average cooling rate 1 ° C./sec | Left side of Formula (4) | Left side of Formula (5) | Average cooling rate 2 ° C./sec | Skin pass rolling rate % | Temperature ° C. | Time sec | Skin pass rolling after tempering % | |
| 89 | 6 | 0.33 | 0.11 | 28 | — | — | — | — | Comparative |
| 90 | 38 | 0.84 | 0.24 | 4 | — | — | — | — | Example |
| 91 | 89 | 0.59 | 0.31 | 25 | 0.3 | — | — | — | Example |
| 92 | 89 | 0.48 | 0.25 | 22 | — | — | — | — | Comparative |
| 93 | 88 | 0.89 | 0.38 | 13 | 0.2 | 325 | 1979 | — | Example |
| 94 | 85 | 0.85 | 0.41 | 18 | 0.1 | 420 | 105 | 0.2 | Example |
| 95 | 47 | 0.70 | 0.38 | 2 | 0.3 | — | — | — | Example |
| 96 | 54 | 0.37 | 0.23 | 22 | 0.1 | — | — | — | Example |
| 97 | 86 | 0.64 | 0.35 | 23 | — | — | — | — | Example |
| 98 | 85 | 0.75 | 0.38 | 17 | — | 363 | 16 | 0.2 | Example |
| 99 | 70 | 0.83 | 0.47 | 3 | — | — | — | — | Example |
| 100 | 72 | 0.67 | 0.34 | 11 | 0.2 | 455 | 10 | — | Example |
| 101 | 83 | 0.68 | 0.51 | 19 | — | — | — | — | Example |
| 102 | 100 | 0.34 | 0.42 | 5 | — | 379 | 112 | 0.2 | Example |
| 103 | 42 | 0.23 | 0.27 | 25 | 0.1 | 298 | 80 | 0.1 | Example |
| 104 | 56 | 0.46 | 0.62 | 14 | 0.1 | — | — | — | Example |
| 105 | 55 | 0.71 | 0.94 | 1 | 0.2 | — | — | — | Example |
| 106 | 44 | 0.66 | 0.19 | 2 | 0.8 | — | — | — | Example |
| 107 | 41 | 0.92 | 0.25 | 19 | — | — | — | — | Example |
| 108 | 76 | 0.64 | 0.32 | 7 | — | — | — | — | Example |
| 109 | 40 | 0.46 | 0.21 | 18 | 0.3 | 252 | 17 | 0.3 | Example |
| 110 | 43 | 0.36 | 0.18 | 7 | — | — | — | — | Example |
| 111 | 42 | 0.47 | 0.19 | 126 | — | — | — | — | Example |

※A value with underline indicates that the value is out of the scope of the invention.

TABLE 19

| | | | | Final heat treatment | | | | | | |
|---|---|---|---|---|---|---|---|---|---|---|
| | | | | Heating | | | | | | |
| Experiment | Steel sheet for heat treatment | Hot-rolled steel sheet | Chemical component | Left side of Formula (3) | Maximum heating temperature ° C. | Maximum heating temperature-Ac1 ° C. | Ac1 ° C. | Ac3-Maximum heating temperature ° C. | Ac3 ° C. | Dwell time 1 sec |
| 112 | 43a | 43 | V | 1.1 | 823 | 106 | 717 | 45 | 868 | 61 |
| 113 | 43b | 43 | V | 1.2 | 809 | 79 | 730 | 49 | 858 | 58 |
| 114 | 44a | 44 | V | 1.1 | 845 | 122 | 723 | 22 | 867 | 59 |
| 115 | 44a | 44 | V | 1.1 | 798 | 75 | 723 | 69 | 867 | 143 |
| 116 | 44b | 44 | V | 1.1 | 803 | 88 | 715 | 67 | 870 | 63 |
| 117 | 45a | 45 | W | 0.9 | 816 | 116 | 700 | 30 | 846 | 73 |
| 118 | 45b | 45 | W | 1.2 | 792 | 92 | 700 | 54 | 846 | 57 |
| 119 | 46a | 46 | W | 1.2 | 797 | 92 | 705 | 45 | 842 | 106 |
| 121 | 47a | 47 | X | 1.1 | 753 | 69 | 684 | 57 | 810 | 109 |
| 122 | 47b | 47 | X | 0.8 | 790 | 100 | 690 | 20 | 810 | 87 |
| 123 | 47c | 47 | X | 0.9 | 726 | 43 | 683 | 82 | 808 | 102 |
| 124 | 47d | 47 | X | 1.2 | 737 | 47 | 690 | 65 | 802 | 136 |
| 125 | 48a | 48 | X | 1.1 | 749 | 66 | 683 | 62 | 811 | 76 |
| 126 | 48a | 48 | X | 1.0 | 777 | 94 | 683 | 34 | 811 | 103 |
| 127 | 48b | 48 | X | 1.2 | 790 | 100 | 690 | 20 | 810 | 42 |
| 128 | 49a | 49 | Y | 0.9 | 778 | 72 | 706 | 78 | 856 | 124 |
| 129 | 49b | 49 | Y | 1.2 | 803 | 87 | 716 | 37 | 840 | 71 |
| 131 | 50b | 50 | Y | 0.8 | 823 | 103 | 720 | 23 | 846 | 94 |
| 132 | 51a | 51 | Z | 0.9 | 792 | 53 | 739 | 92 | 884 | 59 |
| 133 | 51a | 51 | Z | 1.0 | 855 | 116 | 739 | 29 | 884 | 90 |
| 134 | 51b | 51 | Z | 1.5 | 793 | 49 | 744 | 87 | 880 | 56 |
| 135 | 52a | 52 | Z | 1.0 | 775 | 35 | 740 | 95 | 870 | 86 |
| 136 | 52b | 52 | Z | 0.9 | 800 | 65 | 735 | 85 | 885 | 105 |

| | Final heat treatment | | | | | | | | |
|---|---|---|---|---|---|---|---|---|---|
| | | | | | | Tempering treatment | | | |
| | Cooling | | | | | | | | |
| Experiment | Average cooling rate 1 ° C./sec | Left side of Formula (4) | Left side of Formula (5) | Average cooling rate 2 ° C./sec | Skin pass rolling rate % | Temperature ° C. | Time sec | Skin pass rolling after tempering % | |
| 112 | 40 | 0.67 | 0.24 | 26 | — | — | — | — | Example |
| 113 | 41 | 0.60 | 0.23 | 23 | 0.3 | 320 | 638 | — | Example |
| 114 | 58 | 0.76 | 0.21 | 124 | — | 405 | 135 | 0.1 | Example |
| 115 | 84 | 0.30 | 0.08 | 2 | — | — | — | — | Example |
| 116 | 45 | 0.88 | 0.31 | 8 | 0.2 | — | — | — | Example |
| 117 | 83 | 0.71 | 0.61 | 26 | — | 320 | 50 | — | Example |
| 118 | 70 | 0.88 | 0.78 | 3 | 0.1 | — | — | — | Example |
| 119 | 59 | 0.14 | 0.12 | 11 | 0.2 | 271 | 126 | — | Example |
| 121 | 31 | 0.41 | 0.56 | 5 | 0.7 | — | — | — | Example |
| 122 | 60 | 0.31 | 0.47 | 18 | 0.3 | 450 | 2 | 1.2 | Example |
| 123 | 38 | 0.33 | 0.43 | 9 | — | — | — | — | Comparative |
| 124 | 61 | 0.28 | 0.39 | 1 | — | — | — | — | Example |
| 125 | 39 | 0.19 | 0.34 | 29 | — | — | — | — | Example |
| 126 | 42 | 0.87 | 1.05 | 4 | 1.8 | — | — | — | Comparative |
| 127 | 92 | 0.35 | 0.62 | 15 | 1.7 | — | — | — | Example |
| 128 | 41 | 0.32 | 0.31 | 14 | 0.3 | — | — | — | Example |
| 129 | 45 | 0.72 | 0.55 | 5 | — | 381 | 24 | — | Example |
| 131 | 105 | 0.45 | 0.37 | 19 | 0.1 | — | — | — | Comparative |
| 132 | 38 | 0.23 | 0.13 | 12 | — | 471 | 40 | — | Example |
| 133 | 99 | 0.92 | 0.52 | 26 | — | — | — | — | Example |
| 134 | 106 | 0.44 | 0.30 | 25 | 1.8 | — | — | — | Example |
| 135 | 47 | 0.68 | 0.43 | 14 | 0.1 | — | — | — | Example |
| 136 | 72 | 0.44 | 0.27 | 4 | 1.3 | 399 | 27 | 1.8 | Example |

※A value with underline indicates that the value is out of the scope of the invention.

TABLE 20

| | | | | Final heat treament | | | | | | |
|---|---|---|---|---|---|---|---|---|---|---|
| | | | | Heating | | | | | | |
| Experiment | Steel sheet for heat treatment | Hot-rolled steel sheet | Chemical component | Left side of Formula (3) | Maximum heating temperature ° C. | Maximum heating temperature-Ac1 ° C. | Ac1 ° C. | Ac3-Maximum heating temperature ° C. | Ac3 ° C. | Dwell time 1 sec |
| 137 | 53 | 53 | AA | 1.0 | 784 | 43 | 741 | 88 | 872 | 90 |
| 138 | 54 | 54 | AB | 0.9 | 761 | 54 | 707 | 41 | 802 | 104 |
| 139 | 55 | 55 | AC | | | | | | | |
| 140 | 56 | 56 | AD | | | | | | | |
| 141 | 57 | 57 | AE | 1.2 | 867 | 132 | 735 | 61 | 928 | 109 |
| 142 | 58 | 58 | AF | | | | | | | |
| 143 | 59 | 59 | AG | 0.9 | 813 | 109 | 704 | 31 | 844 | 106 |
| 144 | 60 | 60 | AH | | | | | | | |
| 145 | 61 | 61 | AI | 1.2 | 768 | 65 | 703 | 78 | 846 | 104 |
| 146 | 62 | 62 | AJ | 1.1 | 757 | 55 | 702 | 81 | 838 | 92 |
| 147 | 63 | 63 | AK | 1.1 | 798 | 79 | 719 | 40 | 838 | 45 |
| 148 | 64 | 64 | AL | 0.9 | 810 | 57 | 753 | 50 | 860 | 60 |
| 149 | 65 | 65 | I | 0.8 | 860 | 144 | 716 | 75 | 935 | 74 |
| 150 | 66 | 66 | K | 1.1 | 798 | 94 | 704 | 70 | 868 | 109 |
| 151 | 67 | 67 | O | 1.2 | 844 | 132 | 712 | 23 | 867 | 43 |
| 152 | 68 | 68 | W | 1.0 | 817 | 115 | 702 | 28 | 845 | 101 |
| 153 | 1f | 1 | A | 1.1 | 790 | 77 | 713 | 34 | 824 | 81 |
| 154 | 3d | 3 | B | 1.1 | 840 | 120 | 720 | 27 | 867 | 75 |

| | Final heat treatment | | | | | | | | |
|---|---|---|---|---|---|---|---|---|---|
| | | | | | | Tempering treatment | | | |
| | Cooling | | | | | | | Skin | |
| Experiment | Average cooling rate 1 ° C./sec | Left side of Formula (4) | Left side of Formula (5) | Average cooling rate 2 ° C./sec | Skin pass rolling rate % | Temperature ° C. | Time sec | pass rolling after tempering % | |
| 137 | 41 | 0.48 | 0.23 | 19 | — | — | — | — | Comparative |
| 138 | 46 | 0.54 | 0.26 | 18 | — | — | — | — | Comparative |
| 139 | | | | | | | | | Comparative |
| 140 | | | | | | | | | Comparative |
| 141 | 47 | 0.92 | 0.24 | 2 | — | — | — | — | Comparative |
| 142 | | | | | | | | | Comparative |
| 143 | 40 | 0.44 | 0.23 | 17 | — | — | — | — | Comparative |
| 144 | | | | | | | | | Comparative |
| 145 | 41 | 0.39 | 0.22 | 3 | — | — | — | — | Comparative |
| 146 | 72 | 0.43 | 0.17 | 8 | — | — | — | — | Comparative |
| 147 | 80 | 0.55 | 0.39 | 13 | 0.2 | — | — | — | Example |
| 148 | 55 | 0.75 | 0.23 | 27 | 0.1 | — | — | — | Example |
| 149 | 85 | 0.19 | 0.12 | 7 | — | — | — | — | Comparative |
| 150 | 41 | 0.83 | 0.47 | 27 | 0.1 | — | — | — | Comparative |
| 151 | 46 | 0.89 | 0.24 | 25 | — | — | — | — | Comparative |
| 152 | 44 | 0.36 | 0.33 | 7 | 0.6 | — | — | — | Comparative |
| 153 | 95 | 0.31 | 0.17 | 5 | — | — | — | — | Comparative |
| 154 | 41 | 0.23 | 0.22 | 10 | — | — | — | — | Comparative |

※A value with underline indicates that the value is out of the scope of the invention.

Some of the steel sheets for heat treatment were subjected to the plating treatment under conditions shown in Table 21 in addition to the heat treatment shown in Tables 15 to 20. In Table 21, GA represents an alloyed hot-dip galvanized steel sheet, GI represents a non-alloyed hot-dip galvanized steel sheet, and EG represents an electroplated steel sheet.

TABLE 21

| Experiment | Steel sheet for heat treatment | Hot-rolled steel sheet | Chemical component | Surface | Hot dip galvanizing: Plating bath temperature ° C. | Hot dip galvanizing: Steel sheet temperature ° C. | Hot dip galvanizing: Effective amount of Al in plating bath % | Alloying treatment: Temperature ° C. | Alloying treatment: Time sec | |
|---|---|---|---|---|---|---|---|---|---|---|
| 3 | 1b | 1 | A | GA | 453 | 437 | 0.09 | 561 | 12 | Example |
| 9 | 1e | 1 | A | GI | 459 | 449 | 0.25 | — | — | Example |
| 20 | 3c | 3 | B | GI | 456 | 451 | 0.13 | — | — | Example |
| 31 | 7b | 7 | D | EG | — | — | — | — | — | Example |
| 32 | 8a | 8 | D | GI | 456 | 461 | 0.21 | — | — | Example |
| 54 | 20b | 20 | J | GA | 458 | 440 | 0.07 | 561 | 5 | Example |
| 55 | 21a | 21 | K | GI | 464 | 471 | 0.25 | — | — | Example |
| 67 | 25c | 25 | M | GA | 466 | 472 | 0.07 | 514 | 6 | Example |
| 72 | 27c | 27 | N | GA | 461 | 454 | 0.07 | 550 | 35 | Example |
| 75 | 30a | 30 | O | GA | 452 | 453 | 0.12 | 549 | 12 | Example |
| 87 | 33b | 33 | Q | GA | 464 | 461 | 0.07 | 494 | 19 | Example |
| 91 | 35a | 35 | R | GI | 452 | 468 | 0.20 | — | — | Example |
| 93 | 35b | 35 | R | EG | — | — | — | — | — | Example |
| 94 | 36a | 36 | R | GA | 461 | 446 | 0.12 | 560 | 23 | Example |
| 99 | 37b | 37 | S | EG | — | — | — | — | — | Example |
| 100 | 38a | 38 | S | GA | 456 | 457 | 0.12 | 508 | 28 | Example |
| 102 | 39a | 39 | T | GI | 459 | 459 | 0.28 | — | — | Example |
| 103 | 39b | 39 | T | EG | — | — | — | — | — | Example |
| 106 | 41a | 41 | U | GA | 466 | 449 | 0.08 | 532 | 24 | Example |
| 116 | 44b | 44 | V | EG | — | — | — | — | — | Example |
| 118 | 45b | 45 | W | GI | 456 | 461 | 0.09 | — | — | Example |
| 119 | 46a | 46 | W | EG | — | — | — | — | — | Example |
| 121 | 47a | 47 | X | GA | 452 | 459 | 0.10 | 555 | 14 | Example |
| 125 | 48a | 48 | X | GA | 453 | 458 | 0.11 | 571 | 17 | Example |
| 132 | 51a | 51 | Z | GA | 454 | 444 | 0.04 | 471 | 40 | Example |

X A value with underline indicates that the value is out of the scope of the invention.

Tables 22 to 27 show microstructures and properties of the obtained high-strength steel sheets. In the microstructures, acicular a represents acicular ferrite, polygonal α represents polygonal ferrite, M represents martensite, tempered M represents tempered martensite, B represents bainite, BF represents bainitic ferrite, and residual γ represents residual austenite.

TABLE 22

| | | | | | High-strength steel sheet | | | | | | | | | | | | | | | | | | | |
|---|---|---|---|---|---|---|---|---|---|---|---|---|---|---|---|---|---|---|---|---|---|---|---|---|
| | | | | | Microstructure fraction | | | | | | | | | | Mechanical characteristics | | | | | | | | | |
| | Steel sheet | Hot-rolled | Chemical | | Acicular | Aggregated | | (Percentage of Tempered M) | | | Residual | | Left side of | Average diameter of carbides in | | | | Left side of Formula | Impact characteristics | | Spot weldability | | | |
| Experiment | for heat treatment | steel sheet | component | Plating | α % | α % | M % | % | B % | BF % | γ % | Others % | Formula (A) | Tempered M μm | TS MPa | El % | λ % | (6) × $10^6$ | $T_{TR}$ ° C. | $E_B/E_{RT}$ | $E_C$ kN | $E_T$ kN | $E_C/E_T$ | |
| 1 | 1a | 1 | A | — | 57 | 7 | 24 | 67 | 8 | 4 | 0.1 | 0 | 5.9 | 0.4 | 961 | 19 | 51 | 4.0 | −90 | 0.29 | 20.7 | 46.2 | 0.45 | Example |
| 2 | 1a | 1 | A | — | 47 | 5 | 37 | 12 | 6 | 3 | 1.1 | 0 | 12.8 | 0.2 | 1207 | 14 | 42 | 3.8 | −20 | 0.10 | 19.8 | 47.2 | 0.42 | Comparative |
| 3 | 1b | 1 | A | GA | 44 | 3 | 30 | 100 | 10 | 12 | 1.0 | 0 | 8.1 | 0.7 | 969 | 19 | 55 | 4.3 | −70 | 0.31 | 9.3 | 24.0 | 0.39 | Example |
| 4 | 1b | 1 | A | — | 26 | 1 | 39 | 21 | 13 | 8 | 0.7 | 12 | 6.2 | 0.1 | 748 | 18 | 27 | 1.9 | −50 | 0.28 | 6.8 | 18.9 | 0.36 | Comparative |
| 5 | 1b | 1 | A | — | 0 | 43 | 22 | 0 | 25 | 10 | 0.3 | 0 | 10.9 | — | 962 | 15 | 24 | 2.2 | −30 | 0.10 | 5.0 | 18.6 | 0.27 | Comparative |
| 6 | 1c | 1 | A | — | 65 | 0 | 19 | 0 | 12 | 0 | 4.0 | 0 | 6.5 | — | 1054 | 19 | 32 | 3.7 | −40 | 0.08 | 7.7 | 20.3 | 0.38 | Comparative |
| 7 | 1d | 1 | A | — | 14 | 51 | 15 | 0 | 9 | 10 | 0.6 | 0 | 10.8 | — | 873 | 18 | 22 | 2.2 | −20 | 0.24 | 5.5 | 18.8 | 0.29 | Comparative |
| 8 | 1e | 1 | A | — | 43 | 5 | 26 | 55 | 8 | 15 | 1.0 | 2 | 5.8 | 0.2 | 948 | 17 | 62 | 3.9 | −40 | 0.33 | 18.1 | 43.0 | 0.42 | Example |
| 9 | 1e | 1 | A | GI | 54 | 8 | 19 | 0 | 8 | 9 | 0.6 | 1 | 8.4 | — | 927 | 18 | 56 | 3.8 | −40 | 0.29 | 22.5 | 51.0 | 0.44 | Example |
| 10 | 2a | 2 | A | — | 0 | 53 | 16 | 0 | 13 | 14 | 3.5 | 1 | 11.1 | — | 906 | 18 | 28 | 2.6 | 20 | 0.35 | 5.1 | 21.2 | 0.24 | Comparative |
| 16 | 3a | 3 | B | — | 48 | 4 | 32 | 36 | 8 | 7 | 0.5 | 1 | 7.2 | <0.1 | 892 | 18 | 66 | 3.9 | −70 | 0.31 | 13.2 | 28.8 | 0.46 | Example |
| 17 | 3a | 3 | B | — | 57 | 5 | 3 | 0 | 11 | 12 | 1.4 | 11 | <5.0 | — | 563 | 28 | 61 | 2.9 | — | — | — | — | — | Comparative |
| 18 | 3b | 3 | B | — | 61 | 11 | 23 | 0 | 2 | 1 | 0.4 | 2 | 6.0 | — | 931 | 17 | 61 | 3.8 | −60 | 0.34 | 15.3 | 33.9 | 0.45 | Example |
| 19 | 3b | 3 | B | — | 18 | 46 | 18 | 0 | 10 | 7 | 0.9 | 0 | 8.1 | — | 894 | 18 | 28 | 2.5 | −40 | 0.26 | 10.1 | 31.7 | 0.32 | Comparative |
| 20 | 3c | 3 | B | GI | 63 | 7 | 14 | 0 | 1 | 12 | 0.9 | 2 | 5.9 | — | 705 | 25 | 72 | 4.0 | −40 | 0.30 | 2.9 | 5.9 | 0.48 | Example |
| 21 | 3c | 3 | B | — | 46 | 5 | 11 | 0 | 0 | 33 | 5.4 | 0 | 7.1 | — | 713 | 34 | 32 | 3.6 | −50 | 0.12 | 2.4 | 5.9 | 0.41 | Comparative |
| 24 | 5a | 5 | C | — | 10 | 61 | 14 | 0 | 0 | 10 | 4.8 | 0 | 11.5 | — | 1124 | 16 | 15 | 2.3 | 10 | 0.12 | 13.7 | 42.8 | 0.32 | Comparative |
| 28 | 6a | 6 | C | — | 59 | 9 | 29 | 0 | 2 | 0 | 0.5 | I | 4.8 | — | 1372 | 11 | 48 | 3.9 | −60 | 0.31 | 5.9 | 16.8 | 0.35 | Example |
| 29 | 6b | 6 | C | — | 40 | 8 | 39 | 8 | 3 | 10 | 0.4 | 0 | 5.0 | 0.1 | 1334 | 12 | 41 | 3.7 | −40 | 0.23 | 19.7 | 56.2 | 0.35 | Example |
| 30 | 7a | 7 | D | — | 54 | 13 | 16 | 54 | 9 | 6 | 0.6 | 1 | 6.7 | 0.4 | 667 | 24 | 83 | 3.8 | −60 | 0.27 | 31.8 | 72.4 | 0.44 | Example |
| 31 | 7b | 7 | D | EG | 50 | 6 | 12 | 0 | 11 | 18 | 1.0 | 2 | 5.2 | — | 625 | 28 | 76 | 3.8 | −50 | 0.22 | 25.2 | 58.8 | 0.43 | Example |
| 32 | 8a | 8 | D | GI | 53 | 7 | 11 | 62 | 15 | 13 | 1.0 | 0 | 8.2 | 0.4 | 590 | 27 | 97 | 3.8 | −60 | 0.22 | 3.5 | 7.5 | 0.47 | Example |
| 33 | 8b | 8 | D | — | 47 | 6 | 12 | 0 | 13 | 20 | 1.4 | 0 | 4.8 | — | 650 | 25 | 83 | 3.8 | −60 | 0.19 | 14.0 | 34.5 | 0.41 | Example |

※A value with underline indicates that the value is out of the scope of the invention.

TABLE 23

| | | | | | High-strength steel sheet | | | | | | | | | | | | | | | | | | | |
|---|---|---|---|---|---|---|---|---|---|---|---|---|---|---|---|---|---|---|---|---|---|---|---|---|
| | | | | | Microstructure fraction | | | | | | | | | | Mechanical characteristics | | | | | | | | | |
| Experiment | Steel sheet for heat treatment | Hot-rolled steel sheet | Chemical component | Plating | Acicular α % | Aggregated α % | M % | (Percentage of Tempered M) % | B % | BF % | Residual γ % | Others % | Left side of Formula (A) | Average diameter of carbides in Tempered M μm | TS MPa | El % | λ % | Left side of Formula (6) × $10^6$ | Impact characteristics $T_{TR}$ ° C. | Impact characteristics $E_B/E_{RT}$ | Spot weldability $E_C$ kN | Spot weldability $E_T$ kN | Spot weldability $E_C/E_T$ | |
| 36 | 9c | 9 | E | — | 32 | 8 | 25 | 10 | 20 | 11 | 2.5 | 2 | 11.5 | 0.2 | 1208 | 16 | 29 | 3.6 | −20 | 0.08 | 10.5 | 30.1 | 0.35 | Comparative |
| 37 | 10 | 10 | E | — | 54 | 9 | 10 | 0 | 2 | 23 | 0.6 | 1 | <5.0 | — | 842 | 20 | 58 | 3.7 | −50 | 0.26 | 11.9 | 30.6 | 0.39 | Example |
| 38 | 11 | 11 | F | — | 46 | 3 | 23 | 0 | 10 | 17 | 0.5 | 1 | 5.8 | — | 1091 | 15 | 49 | 3.8 | −70 | 0.22 | 10.2 | 24.3 | 0.42 | Example |
| 39 | 12 | 12 | F | — | 66 | 3 | 20 | 0 | 4 | 7 | 0.1 | 0 | 9.2 | — | 1150 | 15 | 47 | 4.0 | −80 | 0.35 | 13.1 | 30.7 | 0.43 | Example |
| 40 | 13 | 13 | G | — | 63 | 0 | 24 | 0 | 13 | 0 | 0.1 | 0 | 6.5 | — | 1095 | 16 | 48 | 4.0 | −50 | 0.30 | 21.6 | 51.5 | 0.42 | Example |
| 41 | 14 | 14 | G | — | 54 | 0 | 38 | 63 | 8 | 0 | 0.0 | 0 | 7.3 | 0.3 | 1150 | 13 | 67 | 4.1 | −60 | 0.33 | 21.7 | 51.6 | 0.42 | Example |
| 42 | 15 | 15 | H | — | 58 | 2 | 22 | 39 | 8 | 8 | 0.7 | 1 | 7.7 | 0.2 | 937 | 18 | 61 | 4.0 | −80 | 0.20 | 16.0 | 36.4 | 0.44 | Example |
| 43 | 16 | 16 | H | — | 49 | 4 | 22 | 0 | 2 | 20 | 0.8 | 2 | 7.7 | — | 901 | 20 | 51 | 3.9 | −60 | 0.32 | 16.0 | 41.2 | 0.39 | Example |
| 44 | 17 | 17 | I | — | 70 | 2 | 15 | 0 | 2 | 8 | 0.7 | 2 | 6.5 | — | 888 | 19 | 63 | 4.0 | −80 | 0.30 | 14.3 | 31.1 | 0.46 | Example |
| 45 | 18a | 18 | I | — | 75 | 0 | 14 | 17 | 6 | 4 | 1.3 | 0 | 12.0 | <0.1 | 763 | 26 | 45 | 3.7 | −10 | 0.28 | 4.4 | 11.2 | 0.39 | Comparative |
| 46 | 18b | 18 | I | — | 61 | 0 | 19 | 54 | 0 | 18 | 1.5 | 1 | 7.8 | 0.5 | 923 | 17 | 73 | 4.1 | −70 | 0.23 | 5.6 | 13.5 | 0.42 | Example |
| 47 | 18c | 18 | I | — | 72 | 0 | 14 | 0 | 3 | 9 | 0.4 | 2 | 5.5 | — | 894 | 19 | 67 | 4.2 | −80 | 0.21 | 2.8 | 5.8 | 0.47 | Example |
| 49 | 19a | 19 | J | — | 36 | 5 | 24 | 0 | 19 | 15 | 0.3 | 1 | 4.5 | — | 1067 | 15 | 49 | 3.7 | −40 | 0.25 | 16.5 | 41.1 | 0.40 | Example |
| 50 | 19a | 19 | J | — | 27 | 2 | 25 | 0 | 22 | 13 | 0.4 | 11 | 6.9 | — | 816 | 12 | 16 | 1.1 | −40 | 0.27 | 15.4 | 40.4 | 0.38 | Comparative |
| 51 | 19b | 19 | J | — | 55 | 14 | 13 | 0 | 12 | 6 | 0.2 | 0 | 5.7 | — | 1004 | 19 | 36 | 3.6 | −50 | 0.22 | 28.2 | 71.8 | 0.39 | Example |
| 52 | 19b | 19 | J | — | 15 | 33 | 32 | 8 | 19 | 1 | 0.0 | 0 | 11.5 | 0.1 | 1270 | 10 | 18 | 1.9 | 10 | 0.32 | 20.6 | 68.8 | 0.30 | Comparative |
| 53 | 20a | 20 | J | — | 46 | 7 | 39 | 20 | 6 | 1 | 0.1 | 1 | 6.0 | 0.4 | 1363 | 11 | 46 | 3.8 | −60 | 0.22 | 10.6 | 27.8 | 0.38 | Example |
| 54 | 20b | 20 | J | GA | 70 | 6 | 12 | 0 | 8 | 1 | 0.6 | 2 | 6.2 | — | 1013 | 18 | 44 | 3.8 | −80 | 0.20 | 15.4 | 31.7 | 0.49 | Example |
| 55 | 21a | 21 | K | GI | 46 | 6 | 24 | 0 | 4 | 17 | 0.8 | 2 | 9.1 | — | 796 | 22 | 57 | 3.7 | −70 | 0.21 | 9.6 | 23.1 | 0.42 | Example |
| 56 | 21b | 21 | K | — | 47 | 14 | 11 | 72 | 12 | 15 | 0.6 | 0 | 7.8 | 0.5 | 686 | 29 | 55 | 3.9 | −70 | 0.33 | 11.5 | 26.2 | 0.44 | Example |
| 57 | 22a | 22 | K | — | 62 | 9 | 14 | 43 | 1 | 11 | 1.2 | 2 | 6.5 | 0.1 | 765 | 23 | 67 | 4.0 | −70 | 0.24 | 11.0 | 25.2 | 0.44 | Example |
| 59 | 23 | 23 | L | — | 71 | 9 | 14 | 0 | 3 | 2 | 0.7 | 0 | 8.1 | — | 803 | 25 | 44 | 3.8 | −70 | 0.32 | 16.1 | 32.4 | 0.50 | Example |
| 60 | 23 | 23 | L | — | 65 | 8 | 11 | 0 | 2 | 10 | 3.0 | 1 | <5.0 | — | 638 | 34 | 42 | 3.6 | −60 | 0.12 | 12.5 | 24.6 | 0.51 | Comparative |

※A value with underline indicates that the value is out of the scope of the invention.

TABLE 24

| | | | | | High-strength steel sheet | | | | | | | | | | | | | | | | | | | |
|---|---|---|---|---|---|---|---|---|---|---|---|---|---|---|---|---|---|---|---|---|---|---|---|---|
| | | | | | Microstructure fraction | | | | | | | | | | Mechanical characteristics | | | | | | | | | |
| Experiment | Steel sheet for heat treatment | Hot-rolled steel sheet | Chemical component | Plating | Acicular α % | Aggregated α % | M % | (Percentage of Tempered M) % | B % | BF % | Residual γ % | Others % | Left side of Formula (A) | Average diameter of carbides in Tempered M μm | TS MPa | El % | λ % | Left side of Formula (6) × $10^6$ | Impact characteristics $T_{TR}$ ° C. | Impact characteristics $E_B/E_{RT}$ | Spot weldability $E_C$ kN | Spot weldability $E_T$ kN | Spot weldability $E_C/E_T$ | |
| 61 | 24a | 24 | L | — | 52 | 8 | 35 | 41 | 3 | 1 | 0.5 | 1 | 6.6 | 0.3 | 904 | 16 | 74 | 3.7 | −80 | 0.34 | 11.6 | 25.9 | 0.45 | Example |
| 62 | 24a | 24 | L | — | 14 | 30 | 34 | 18 | 9 | 12 | 1.3 | 0 | 8.2 | 0.6 | 910 | 14 | 28 | 2.0 | −40 | 0.21 | 7.1 | 24.6 | 0.29 | Comparative |
| 63 | 24b | 24 | L | — | 6 | 81 | 6 | 0 | 7 | 0 | 0.2 | 0 | 10.5 | — | 654 | 31 | 37 | 3.2 | −20 | 0.10 | 8.2 | 25.7 | 0.32 | Comparative |
| 64 | 24c | 24 | L | — | 53 | 6 | 32 | 10 | 3 | 4 | 0.5 | 2 | 4.6 | 0.4 | 838 | 18 | 75 | 3.8 | −60 | 0.26 | 38.2 | 84.8 | 0.45 | Example |
| 65 | 25a | 25 | M | — | 65 | 7 | 25 | 0 | 1 | 1 | 0.8 | 0 | 5.2 | — | 999 | 20 | 40 | 4.0 | −60 | 0.24 | 3.6 | 7.8 | 0.47 | Example |
| 66 | 25b | 25 | M | — | 49 | 12 | 12 | 0 | 0 | 25 | 1.6 | 0 | 13.1 | — | 704 | 25 | 61 | 3.6 | −10 | 0.31 | 2.5 | 6.4 | 0.39 | Comparative |
| 67 | 25c | 25 | M | GA | 63 | 11 | 22 | 100 | 2 | 1 | 1.1 | 0 | 6.5 | 0.9 | 933 | 21 | 51 | 4.3 | −60 | 0.22 | 24.9 | 53.5 | 0.47 | Example |
| 68 | 26 | 26 | M | — | 64 | 8 | 24 | 0 | 1 | 2 | 0.8 | 0 | 6.8 | — | 976 | 18 | 48 | 3.8 | −70 | 0.18 | 17.2 | 33.7 | 0.51 | Example |
| 69 | 27a | 27 | N | — | 47 | 6 | 34 | 0 | 2 | 10 | 0.4 | I | 7.6 | — | 1292 | 13 | 39 | 3.8 | −60 | 0.24 | 9.5 | 23.4 | 0.41 | Example |
| 70 | 27b | 27 | N | — | 47 | 0 | 24 | 15 | 15 | 12 | 1.1 | I | 11.0 | 0.3 | 867 | 22 | 42 | 3.6 | 10 | 0.25 | 10.0 | 23.3 | 0.43 | Comparative |
| 71 | 27c | 27 | N | — | 58 | 11 | 27 | 100 | 1 | 0 | 0.6 | 2 | 5.2 | 0.7 | 1237 | 14 | 49 | 4.3 | −70 | 0.21 | 21.8 | 53.6 | 0.41 | Example |
| 72 | 27c | 27 | N | GA | 57 | 17 | 23 | 0 | 0 | 1 | 0.7 | 1 | 6.0 | — | 1261 | 15 | 31 | 3.7 | −50 | 0.30 | 21.8 | 53.5 | 0.41 | Example |
| 73 | 28 | 28 | N | — | 59 | 2 | 29 | 0 | 2 | 5 | 0.7 | 2 | 6.1 | — | 1329 | 13 | 39 | 3.9 | −70 | 0.20 | 26.3 | 61.0 | 0.43 | Example |
| 74 | 29 | 29 | O | — | 52 | 4 | 36 | 15 | 2 | 3 | 1.6 | 1 | 5.0 | 0.1 | 1137 | 16 | 38 | 3.8 | −40 | 0.25 | 25.0 | 62.6 | 0.40 | Example |
| 75 | 30a | 30 | O | GA | 67 | 0 | 28 | 0 | 2 | 2 | 1.0 | 0 | 5.2 | — | 1151 | 15 | 44 | 3.9 | −60 | 0.27 | 4.1 | 8.2 | 0.50 | Example |
| 76 | 30a | 30 | O | — | 77 | 0 | 19 | 0 | 2 | 1 | 0.8 | 0 | 5.0 | — | 1072 | 19 | 36 | 4.0 | −80 | 0.24 | 4.0 | 8.7 | 0.46 | Example |
| 77 | 30b | 30 | O | — | 58 | 8 | 26 | 92 | 1 | 4 | 1.4 | 2 | 5.5 | 0.4 | 1020 | 19 | 47 | 4.2 | −80 | 0.18 | 11.2 | 23.9 | 0.47 | Example |
| 78 | 30c | 30 | O | — | 0 | 76 | 12 | 12 | 0 | 11 | 1.2 | 0 | 10.3 | 0.2 | 750 | 18 | 12 | 1.3 | −30 | 0.12 | 5.5 | 18.5 | 0.30 | Comparative |
| 80 | 31 | 31 | P | — | 68 | 11 | 17 | 0 | 1 | 2 | 1.1 | 0 | 6.4 | — | 1140 | 17 | 37 | 4.0 | −50 | 0.23 | 11.7 | 24.9 | 0.47 | Example |
| 85 | 32d | 32 | P | — | 43 | 0 | 18 | 0 | 14 | 19 | 5.6 | 0 | 11.4 | — | 660 | 35 | 47 | 4.1 | −20 | 0.12 | 9.0 | 21.4 | 0.42 | Comparative |
| 86 | 33a | 33 | Q | — | 54 | 5 | 30 | 0 | 2 | 8 | 1.3 | 0 | 6.0 | — | 799 | 22 | 61 | 3.9 | −50 | 0.18 | 7.3 | 17.5 | 0.42 | Example |
| 87 | 33b | 33 | Q | GA | 73 | 5 | 15 | 0 | 0 | 6 | 0.4 | 1 | 5.2 | — | 753 | 24 | 65 | 4.0 | −50 | 0.30 | 19.3 | 42.2 | 0.46 | Example |
| 88 | 34a | 34 | Q | — | 64 | 12 | 16 | 56 | 3 | 4 | 0.6 | 0 | 6.0 | 0.3 | 681 | 29 | 58 | 3.9 | −60 | 0.29 | 7.7 | 16.4 | 0.47 | Example |

※A value with underline indicates that the value is out of the scope of the invention.

TABLE 25

| | | | | | High-strength steel sheet | | | | | | | | | | | | | | | | | | | |
|---|---|---|---|---|---|---|---|---|---|---|---|---|---|---|---|---|---|---|---|---|---|---|---|---|
| | | | | | Microstructure fraction | | | | | | | | | | Mechanical characteristics | | | | | | | | | |
| Experiment | Steel sheet for heat treatment | Hot-rolled steel sheet | Chemical component | Plating | Acicular α % | Aggregated α % | M % | (Percentage of Tempered M) % | B % | BF % | Residual γ % | Others % | Left side of Formula (A) | Average diameter of carbides in Tempered M μm | TS MPa | El % | λ % | Left side of Formula (6) × $10^6$ | Impact characteristics $T_{TR}$ ° C. | $E_B/E_{RT}$ | Spot weldability $E_C$ kN | $E_T$ kN | $E_C/E_T$ | |
| 89 | 34a | 34 | Q | — | 15 | 43 | 17 | 0 | 13 | 10 | 0.4 | 2 | 8.6 | — | 730 | 23 | 31 | 2.5 | −40 | 0.24 | 4.9 | 15.4 | 0.32 | Comparative |
| 90 | 34b | 34 | Q | — | 77 | 4 | 12 | 0 | 1 | 4 | 1.0 | 1 | <5.0 | — | 756 | 25 | 61 | 4.1 | −60 | 0.21 | 20.1 | 43.8 | 0.46 | Example |
| 91 | 35a | 35 | R | GI | 53 | 3 | 27 | 0 | 6 | 10 | 0.6 | 0 | 7.1 | — | 1025 | 17 | 51 | 4.0 | −60 | 0.32 | 6.2 | 13.8 | 0.45 | Example |
| 92 | 35a | 35 | R | — | 0 | 36 | 25 | 15 | 15 | 23 | 0.9 | 0 | 12.5 | 0.4 | 961 | 13 | 26 | 2.0 | −30 | 0.06 | 2.9 | 12.2 | 0.24 | Comparative |
| 93 | 35b | 35 | R | EG | 66 | 7 | 15 | 100 | 1 | 10 | 1.3 | 0 | 6.8 | 0.2 | 818 | 23 | 60 | 4.2 | −70 | 0.22 | 15.9 | 32.2 | 0.49 | Example |
| 94 | 36a | 36 | R | GA | 51 | 6 | 24 | 100 | 4 | 13 | 1.5 | 1 | 6.6 | 0.5 | 838 | 22 | 55 | 4.0 | −80 | 0.23 | 4.6 | 10.3 | 0.44 | Example |
| 95 | 36b | 36 | R | — | 56 | 9 | 20 | 0 | 5 | 8 | 0.0 | 2 | 9.1 | — | 865 | 20 | 56 | 3.8 | −70 | 0.22 | 11.7 | 27.1 | 0.43 | Example |
| 96 | 37a | 37 | S | — | 49 | 1 | 38 | 16 | 9 | 3 | 0.3 | 0 | 5.5 | <0.1 | 1116 | 14 | 54 | 3.8 | −50 | 0.30 | 19.6 | 43.4 | 0.45 | Example |
| 97 | 37a | 37 | S | — | 48 | 1 | 31 | 0 | 7 | 13 | 0.4 | 0 | 9.3 | — | 1077 | 14 | 60 | 3.8 | −50 | 0.33 | 20.5 | 49.9 | 0.41 | Example |
| 98 | 37b | 37 | S | — | 69 | 6 | 14 | 69 | 2 | 8 | 0.9 | 0 | 4.9 | 0.3 | 834 | 21 | 66 | 4.1 | −80 | 0.30 | 19.0 | 44.4 | 0.43 | Example |
| 99 | 37b | 37 | S | EG | 30 | 2 | 39 | 0 | 5 | 23 | 0.8 | 0 | 7.6 | — | 1002 | 14 | 66 | 3.6 | −40 | 0.31 | 18.4 | 44.7 | 0.41 | Example |
| 100 | 38a | 38 | S | GA | 51 | 7 | 26 | 100 | 4 | 10 | 1.0 | 1 | 5.8 | 0.6 | 895 | 21 | 54 | 4.1 | −60 | 0.27 | 26.7 | 61.3 | 0.44 | Example |
| 101 | 38b | 38 | S | — | 61 | 4 | 15 | 0 | 7 | 12 | 0.6 | 0 | 6.4 | — | 858 | 19 | 70 | 4.0 | −70 | 0.22 | 25.2 | 59.4 | 0.42 | Example |
| 102 | 39a | 39 | T | GI | 75 | 0 | 14 | 76 | 6 | 3 | 0.2 | 2 | 6.2 | 0.4 | 844 | 19 | 77 | 4.1 | −80 | 0.32 | 22.9 | 50.8 | 0.45 | Example |
| 103 | 39b | 39 | T | EG | 74 | 5 | 15 | 46 | 5 | 1 | 0.1 | 0 | 6.6 | 0.1 | 938 | 17 | 69 | 4.1 | −90 | 0.23 | 32.4 | 64.9 | 0.50 | Example |
| 104 | 40a | 40 | T | — | 65 | 6 | 12 | 0 | 8 | 8 | 0.8 | 0 | <5.0 | — | 760 | 24 | 61 | 3.9 | −70 | 0.26 | 6.0 | 13.8 | 0.44 | Example |
| 105 | 40b | 40 | T | — | 48 | 11 | 11 | 0 | 10 | 19 | 0.7 | 0 | 7.7 | — | 682 | 29 | 52 | 3.7 | −50 | 0.30 | 7.5 | 18.0 | 0.41 | Example |
| 106 | 41a | 41 | U | GA | 60 | 9 | 23 | 0 | 1 | 6 | 1.0 | 0 | 9.6 | — | 955 | 19 | 47 | 3.8 | −50 | 0.32 | 2.2 | 5.5 | 0.41 | Example |
| 107 | 41b | 41 | U | — | 62 | 3 | 26 | 0 | 1 | 7 | 1.3 | 0 | 5.8 | — | 1083 | 15 | 57 | 4.0 | −80 | 0.22 | 14.6 | 35.6 | 0.41 | Example |
| 108 | 41b | 41 | U | — | 61 | 3 | 27 | 0 | 3 | 5 | 1.4 | 0 | 5.2 | — | 1094 | 17 | 40 | 3.9 | −80 | 0.25 | 17.3 | 37.5 | 0.46 | Example |
| 109 | 42a | 42 | U | — | 60 | 10 | 22 | 33 | 3 | 3 | 0.4 | 2 | 4.8 | 0.3 | 1015 | 16 | 58 | 3.9 | −70 | 0.35 | 2.5 | 5.8 | 0.43 | Example |
| 110 | 42b | 42 | U | — | 62 | 8 | 23 | 0 | 4 | 2 | 1.0 | 0 | 6.9 | — | 1012 | 17 | 50 | 3.9 | −70 | 0.23 | 18.7 | 40.2 | 0.46 | Example |
| 111 | 43a | 43 | V | — | 76 | 2 | 17 | 0 | 2 | 2 | 0.9 | 0 | 8.5 | — | 988 | 16 | 61 | 3.9 | −80 | 0.21 | 15.3 | 33.6 | 0.46 | Example |

※A value with underline indicates that the value is out of the scope of the invention.

TABLE 26

| | | | | | High-strength steel sheet | | | | | | | | | | | | | | | | | | | |
|---|---|---|---|---|---|---|---|---|---|---|---|---|---|---|---|---|---|---|---|---|---|---|---|---|
| | | | | | Microstructure fraction | | | | | | | | | | Mechanical characteristics | | | | | | | | | |
| Experiment | Steel sheet for heat treatment | Hot-rolled steel sheet | Chemical component | Plating | Acicular α % | Aggregated α % | M % | (Percentage of Tempered M) % | B % | BF % | Residual γ % | Others % | Left side of Formula (A) | Average diameter of carbides in Tempered M μm | TS MPa | El % | λ % | Left side of Formula (6) × $10^6$ | Impact characteristics $T_{TR}$ ° C. | $E_B/E_{RT}$ | Spot weldability $E_C$ kN | $E_T$ kN | $E_C/E_T$ | |
| 112 | 43a | 43 | V | — | 69 | 2 | 20 | 0 | 3 | 5 | 0.5 | 1 | 6.7 | — | 962 | 15 | 81 | 4.0 | −60 | 0.21 | 12.8 | 28.9 | 0.44 | Example |
| 113 | 43b | 43 | V | — | 60 | 9 | 22 | 76 | 4 | 3 | 1.2 | 1 | 5.4 | 0.3 | 945 | 18 | 60 | 4.1 | −60 | 0.32 | 62.1 | 153.0 | 0.41 | Example |
| 114 | 44a | 44 | V | — | 65 | 14 | 15 | 100 | 1 | 2 | 1.3 | 2 | 4.8 | 0.4 | 873 | 25 | 45 | 4.3 | −70 | 0.19 | 4.8 | 9.6 | 0.50 | Example |
| 115 | 44a | 44 | V | — | 50 | 9 | 36 | 0 | 3 | 1 | 0.8 | 0 | 7.1 | — | 1115 | 16 | 40 | 3.8 | −40 | 0.22 | 3.3 | 8.3 | 0.40 | Example |
| 116 | 44b | 44 | V | EG | 56 | 5 | 27 | 0 | 2 | 9 | 1.1 | 0 | 7.3 | — | 945 | 18 | 53 | 3.8 | −70 | 0.30 | 22.9 | 49.6 | 0.46 | Example |
| 117 | 45a | 45 | W | — | 58 | 11 | 16 | 39 | 4 | 10 | 0.7 | 0 | 5.9 | 0.2 | 816 | 25 | 45 | 3.9 | −50 | 0.20 | 4.4 | 9.5 | 0.47 | Example |
| 118 | 45b | 45 | W | GI | 56 | 7 | 11 | 0 | 8 | 15 | 0.7 | 2 | 4.6 | — | 771 | 24 | 53 | 3.7 | −60 | 0.32 | 9.9 | 23.2 | 0.42 | Example |
| 119 | 46a | 46 | W | EG | 56 | 11 | 28 | 45 | 4 | 1 | 0.4 | 0 | 8.3 | 0.1 | 1133 | 15 | 46 | 3.9 | −60 | 0.32 | 4.2 | 9.4 | 0.45 | Example |
| 121 | 47a | 47 | X | GA | 50 | 13 | 16 | 0 | 13 | 7 | 0.4 | 1 | 7.7 | — | 1003 | 15 | 59 | 3.7 | −40 | 0.22 | 4.9 | 12.2 | 0.40 | Example |
| 122 | 47b | 47 | X | — | 66 | 13 | 11 | 48 | 7 | 2 | 0.2 | 1 | 3.9 | 0.8 | 905 | 20 | 54 | 4.0 | −90 | 0.21 | 5.6 | 13.6 | 0.41 | Example |
| 123 | 47c | 47 | X | — | 46 | 16 | 13 | 0 | 20 | 2 | 1.5 | 1 | 11.7 | — | 768 | 25 | 44 | 3.5 | 0 | 0.23 | 7.0 | 17.4 | 0.40 | Comparative |
| 124 | 47d | 47 | X | — | 47 | 5 | 29 | 0 | 16 | 3 | 0.4 | 0 | 4.7 | — | 1165 | 15 | 39 | 3.7 | −50 | 0.31 | 15.6 | 39.4 | 0.40 | Example |
| 125 | 48a | 48 | X | GA | 51 | 7 | 25 | 0 | 12 | 3 | 0.4 | 2 | 5.4 | — | 1142 | 15 | 43 | 3.8 | −40 | 0.34 | 5.4 | 13.3 | 0.41 | Example |
| 126 | 48a | 48 | X | — | 66 | 9 | 0 | — | 6 | 7 | 0.8 | 11 | — | — | 526 | 29 | 56 | 2.6 | — | — | — | — | — | Comparative |
| 127 | 48b | 48 | X | — | 62 | 12 | 13 | 0 | 10 | 3 | 0.4 | 0 | 5.7 | — | 1000 | 20 | 37 | 3.8 | −50 | 0.35 | 9.2 | 22.9 | 0.40 | Example |
| 128 | 49a | 49 | Y | — | 55 | 6 | 26 | 0 | 10 | 3 | 0.4 | 0 | 5.5 | — | 1217 | 14 | 42 | 3.9 | −70 | 0.34 | 4.4 | 9.8 | 0.45 | Example |
| 129 | 49b | 49 | Y | — | 60 | 5 | 18 | 66 | 4 | 11 | 1.1 | 1 | 4.6 | 0.2 | 936 | 19 | 57 | 4.1 | −80 | 0.31 | 8.7 | 20.9 | 0.42 | Example |
| 131 | 50b | 50 | Y | — | 12 | 33 | 32 | 0 | 2 | 17 | 4.4 | 0 | 9.0 | — | 1020 | 13 | 6 | 1.0 | 10 | 0.13 | 10.0 | 35.6 | 0.28 | Comparative |
| 132 | 51a | 51 | Z | GA | 42 | 8 | 41 | 100 | 7 | 2 | 0.2 | 0 | 7.8 | 0.5 | 1217 | 11 | 70 | 3.9 | −70 | 0.25 | 5.0 | 12.4 | 0.40 | Example |
| 133 | 51a | 51 | Z | — | 59 | 13 | 13 | 0 | 4 | 11 | 0.3 | 0 | 5.9 | — | 925 | 20 | 43 | 3.7 | −60 | 0.27 | 5.0 | 12.5 | 0.40 | Example |
| 134 | 51b | 51 | Z | — | 45 | 5 | 35 | 23 | 8 | 6 | 0.7 | 0 | 8.7 | 0.1 | 1193 | 12 | 60 | 3.8 | −50 | 0.19 | 25.4 | 66.9 | 0.38 | Example |
| 135 | 52a | 52 | Z | — | 24 | 3 | 34 | 0 | 17 | 20 | 1.4 | 1 | 4.9 | — | 1110 | 14 | 47 | 3.5 | −40 | 0.30 | 4.3 | 11.1 | 0.38 | Example |
| 136 | 52b | 52 | Z | — | 49 | 4 | 35 | 89 | 6 | 6 | 0.2 | 0 | 7.6 | 0.2 | 1231 | 12 | 61 | 4.0 | −80 | 0.23 | 12.1 | 28.9 | 0.42 | Example |

※A value with underline indicates that the value is out of the scope of the invention.

TABLE 27

| | | | | | High-strength steel sheet | | | | | | | | | | | | | | | | | | | |
|---|---|---|---|---|---|---|---|---|---|---|---|---|---|---|---|---|---|---|---|---|---|---|---|---|
| | | | | | Microstructure fraction | | | | | | | | | | Mechanical characteristics | | | | | | | | | |
| Experiment | Steel sheet for heat treatment | Hot-rolled steel sheet | Chemical component | Plating | Acicular α % | Aggregated α % | M % | (Percentage of Tempered M) % | B % | BF % | Residual γ % | Others % | Left side of Formula (A) | Average diameter of carbides in Tempered M μm | TS MPa | El % | λ % | Left side of Formula (6) × $10^6$ | Impact characteristics $T_{TR}$ ° C. | Impact characteristics $E_B/E_{RT}$ | Spot weldability $E_C$ kN | Spot weldability $E_T$ kN | Spot weldability $E_C/E_T$ | |
| 137 | 53 | 53 | AA | — | 0 | 93 | 3 | 0 | 0 | 3 | 0.0 | 1 | <5.0 | — | 465 | 33 | 105 | 3.4 | — | — | — | — | — | Comparative |
| 138 | 54 | 54 | AB | — | 29 | 2 | 51 | 0 | 15 | 2 | 1.0 | 0 | 9.5 | — | 1860 | 11 | 12 | 3.1 | −40 | 0.22 | 3.1 | 30.7 | 0.10 | Comparative |
| 139 | 55 | 55 | AC | — | Test was terminated due to being cracked during casting process. | | | | | | | | | | | | | Test was terminated due to being cracked during casting process. | | | | | | Comparative |
| 140 | 56 | 56 | AD | — | Test was terminated due to being cracked during casting process. | | | | | | | | | | | | | Test was terminated due to being cracked during casting process. | | | | | | Comparative |
| 141 | 57 | 57 | AE | — | 7 | 53 | 6 | 0 | 15 | 7 | 4.1 | 8 | <5.0 | — | 562 | 25 | 67 | 2.7 | — | — | — | — | — | Comparative |
| 142 | 58 | 58 | AF | — | Test was terminated due to being cracked during casting process. | | | | | | | | | | | | | Test was terminated due to being cracked during casting process. | | | | | | Comparative |
| 143 | 59 | 59 | AG | — | 43 | 13 | 27 | 0 | 5 | 10 | 0.0 | 2 | 6.9 | — | 1031 | 7 | 10 | 0.73 | — | — | — | — | — | Comparative |
| 144 | 60 | 60 | AH | — | Test was terminated due to being cracked during casting process. | | | | | | | | | | | | | Test was terminated due to being cracked during casting process. | | | | | | Comparative |
| 145 | 61 | 61 | AI | — | 36 | 10 | 35 | 0 | 9 | 8 | 1.3 | 1 | 6.4 | — | 1112 | 11 | 13 | 1.5 | — | — | — | — | — | Comparative |
| 146 | 62 | 62 | AJ | — | 52 | 9 | 24 | 15 | 13 | 0 | 0.0 | 2 | 6.7 | 0.1 | 965 | 9 | 10 | 0.85 | — | — | — | — | — | Comparative |
| 147 | 63 | 63 | AK | — | 51 | 11 | 19 | 0 | 6 | 12 | 1.1 | 0 | 7.4 | — | 984 | 17 | 61 | 4.1 | −50 | 0.31 | 19.5 | 48.0 | 0.41 | Example |
| 148 | 64 | 64 | AL | — | 55 | 9 | 27 | 0 | 2 | 5 | 1.0 | 1 | 5.2 | — | 1402 | 11 | 39 | 3.7 | −50 | 0.28 | 6.2 | 15.8 | 0.39 | Example |
| 149 | 65 | 65 | I | — | 18 | 40 | 23 | 10 | 12 | 6 | 1.2 | 0 | 12.5 | 0.1 | 851 | 23 | 25 | 2.9 | 10 | 0.11 | 6.9 | 31.4 | 0.22 | Comparative |
| 150 | 66 | 66 | K | — | 16 | 59 | 17 | 0 | 2 | 5 | 1.4 | 0 | 11.0 | — | 713 | 25 | 34 | 2.8 | −20 | 0.23 | 5.3 | 22.3 | 0.24 | Comparative |
| 151 | 67 | 67 | O | — | 8 | 67 | 12 | 0 | 0 | 12 | 1.3 | 0 | 10.8 | — | 684 | 29 | 28 | 2.7 | −10 | 0.19 | 14.6 | 46.9 | 0.31 | Comparative |
| 152 | 68 | 68 | W | — | 15 | 48 | 13 | 0 | 9 | 9 | 1.4 | 3 | 9.2 | — | 874 | 15 | 36 | 2.3 | 0 | 0.09 | 6.8 | 20.5 | 0.33 | Comparative |
| 153 | 1f | 1 | A | — | 0 | 59 | 24 | 0 | 11 | 4 | 1.0 | 1 | 7.9 | — | 933 | 17 | 31 | 2.7 | −40 | 0.24 | 13.8 | 41.2 | 0.33 | Comparative |
| 154 | 3d | 3 | B | — | 17 | 52 | 21 | 0 | 6 | 1 | 0.8 | 2 | 8.2 | — | 888 | 15 | 29 | 2.1 | −40 | 0.23 | 10.2 | 32.3 | 0.32 | Comparative |

※A value with underline indicates that the value is out of the scope of the invention.

A tensile test and a hole expansion test were performed in order to evaluate the strength and the formability. The tensile test was performed in accordance with JIS Z 2241. A test piece was a No. 5 test piece described in JIS Z 2201. A tensile axis was in line with a width direction of the steel sheet. The hole expansion test was performed in accordance with JIS Z 2256. In a high-strength steel sheet with TS of 590 MPa or more, when a formula (6) below consisting of the maximum tensile strength TS (MPa), total elongation EI (%), and hole expandability A (%) was satisfied, the steel sheet was judged to have excellent formability-strength balance.

$$TS^{1.5} \times EI \times \lambda^{0.5} \geq 3.5 \times 10^6 \quad (6)$$

The steel sheets not having sufficient strength and formability-strength balance in the tensile test and the hole expansion test were not subjected to the subsequent Charpy test and spot welded joint evaluation test.

Charpy impact test was conducted in order to evaluate toughness. When a thickness of a steel sheet was less than 2.5 mm, as a test piece, a laminated Charpy test piece was used. The laminated Charpy test piece was obtained by laminating the steel sheets until a total thickness thereof exceeds 5.0 mm, fastening the laminated steel sheets with bolts, and giving a V notch of 2-mm depth thereto. Other conditions were in accordance with JIS Z 2242.

When a ductile-brittle transition temperature $T_{TR}$ at which a brittle fracture surface ratio was 50% or more was −40 degrees C. or less, and a ratio $E_B/E_{RT}$ of shock absorption energy $E_B$ after brittle transition to shock absorption energy $E_{RT}$ at the room temperature was 0.15 or more, the steel sheet was judged to have an excellent toughness. Here, the ductility-brittle transition temperature $T_{TR}$ is a temperature at which the brittle fracture surface ratio reaches 50%. The shock absorption energy $E_B$ after the brittle transition refers to absorption energy at the time of having dropped to a flat level in response to the decrease in the shock test temperature.

In order to evaluate weldability, a shear test and a cross tensile test were performed on a spot welded joint. The shear test was performed in accordance with JIS Z 3136. The cross tensile test was performed in accordance with JIS Z 3137. The joint to be evaluated was created by stacking two target steel sheets, adjusting a welding current so that the diameter of a molten portion was 4.0 times the square root of the sheet thickness, and performing spot welding. When a ratio $E_C/E_T$ of the joint strength $E_T$ in the shear test and the joint strength $E_C$ in the cross tensile test was 0.35 or more, the steel sheet was judged to have an excellent weldability.

The steel sheets for heat treatment 1*c*, 1*d*, 1*f*, 2*a*, 3*d*, 5*a*, 9*c*, 18*a*, 24*b*, 25*b*, 27*b*, 30*c*, 32*d*, 47*c*, 50*b*, 53 to 62, 65, 66, 67, and 68 are examples of the steel sheet for heat treatment that does not satisfy the requirements for manufacturing the steel sheet A. Experimental Examples 6, 7, 10, 24, 36, 45, 63, 66, 70, 78, 85, 123, 131, 137 to 146, and 149 to 154 in which the above steel sheets for heat treatment were subjected to the heat treatment did not exhibit sufficient properties.

The steel sheets 65 to 68 for heat treatment are examples of a steel sheet in which the average cooling rate in a range from 850 degrees C. to 550 degrees C. was low, the microstructure of the hot-rolled steel sheet had a few lath structures, and polygonal ferrite. For this reason, in Experimental Examples 149 to 152 in which the respective steel sheets 65 to 68 were subjected to the heat treatment, acicular ferrite was not sufficiently obtained and a large amount of polygonal ferrite was present, resulting in deterioration in strength-formability balance, toughness, and weldability.

The steel sheets 5*a* and 50*b* for heat treatment are examples of a steel sheet in which a winding temperature after hot rolling was excessively high, and the microstructure of the hot-rolled steel sheet had a few lath structure and a wide Mn-concentrated region. For this reason, in Experimental Examples 24 and 131 in which the respective steel sheets 5*a* and 50*b* were subjected to the heat treatment, acicular ferrite was not sufficiently obtained, residual austenite of more than 2% was present, and a lot of coarse, aggregated island-shaped martensite was present, resulting in deterioration in strength-formability balance, toughness, and weldability.

The steel sheets 9*c* and 32*d* for heat treatment are examples of a steel sheet in which the temperature change of the steel sheet in the temperature region from the Bs point after hot rolling to (Bs−80) degrees C. did not satisfy the formula (1). The microstructure of the hot-rolled steel sheet contained a wide Mn-concentrated region and further had a coarse and aggregated residual austenite. Therefore, in Experimental Examples 36 and 85 in which the respective steel sheets 9*c* and 32*d* were subjected to the heat treatment, each steel sheet excessively containing residual austenite was obtained, resulting in deterioration in toughness.

The steel sheet 2*a* for heat treatment is an example of a steel sheet in which a winding temperature after hot rolling was excessively high, and the microstructure of the hot-rolled steel sheet did not contain the lath structure and contained a wide Mn-concentrated region. For this reason, in Experimental Example 10 in which the steel sheet 2*a* was subjected to the heat treatment, acicular ferrite was not obtained and a structure containing a large amount of residual austenite was obtained, resulting in deterioration in strength-formability balance, toughness, and weldability.

The steel sheet 1*c* for heat treatment is an example of a steel sheet in which the steel sheet temperature history in the temperature region of 700 degrees C. to (Ac3−20) degrees C. in the heating process did not satisfy the formula (2) at the manufacture of the steel sheet a by subjecting the hot-rolled steel sheet to the heat treatment. An excessive Mn-concentrated region was formed in the steel sheet 1*c*. Therefore, in Experimental Example 6 in which the steel sheet 1*c* was subjected to the heat treatment, the obtained steel sheet excessively contained residual austenite, resulting in deterioration in toughness.

The steel sheets 1*d* and 24*b* for heat treatment are examples of the steel sheet a in which the maximum heating temperature was excessively low at the manufacture of the steel sheet a by cold-rolling the hot-rolled steel sheet at a rolling reduction of more than 10% and subjecting the steel sheet for intermediate heat treatment to the intermediate heat treatment. A sufficient lath structure was not obtained in the steel sheets 1*d* and 24*b*. Therefore, in Experimental Examples 7 and 63 in which the respective steel sheets 1*d* and 24*b* were subjected to the heat treatment, a sufficient acicular ferrite was not obtained to deteriorate the strength-formability balance and weldability, and toughness was also deteriorated since coarse aggregated martensite increased as the acicular ferrite decreased.

The steel sheet 30*c* for heat treatment is an example of the steel sheet a in which the cooling rate in a range from 700 degrees C. to 550 degrees C. was excessively small at the manufacture of the steel sheet a by cold-rolling the hot-rolled steel sheet at a rolling reduction of more than 10% and subjecting the steel sheet for intermediate heat treatment to the intermediate heat treatment. A sufficient lath structure was not obtained in the steel sheet 30*c*. Therefore, in Experimental Example 78 in which the steel sheet 30*c* was subjected to the heat treatment, a sufficient acicular ferrite was not obtained to deteriorate the strength-formability balance and weldability, and toughness was also deteriorated since coarse aggregated martensite increased as the acicular ferrite decreased.

The steel sheets 25*b* and 47*c* for heat treatment are examples of the steel sheet a in which the cooling rate in a range from the Bs point to (Bs point−80) degrees C. was excessively small at the manufacture of the steel sheet a by cold-rolling the hot-rolled steel sheet at a rolling reduction of more than 10% and subjecting the steel sheet for intermediate heat treatment to the intermediate heat treatment, in which the microstructure of the hot-rolled steel sheet had coarse and aggregated residual austenite. Therefore, in Experimental Examples 66 and 123 in which the respective steel sheets 25*b* and 47*c* were subjected to the heat treatment, a lot of coarse and aggregated martensite were formed, resulting in deterioration in toughness.

The steel sheet 27*b* for heat treatment is an example in which the dwell time in a temperature region from (Bs point−80) degrees C. to Ms point was excessively long in the manufacture of the steel sheet a by cold-rolling the hot-rolled steel sheet at a rolling reduction of more than 10% and subjecting the steel sheet for intermediate heat treatment to the intermediate heat treatment, in which the microstructure of the hot-rolled steel sheet had coarse and aggregated residual austenite. Therefore, in Experimental Example 70 in which the steel sheet 27*b* was subjected to the heat treatment, a lot of coarse and aggregated martensite was formed, resulting in deterioration in toughness.

The steel sheet 18*a* for heat treatment is an example of a steel sheet in which the cooling rate in a range from the Ms point to (Ms point−50) degrees C. was excessively high in the manufacture of the steel sheet a by cold-rolling the hot-rolled steel sheet at a rolling reduction of more than 10% and subjecting the steel sheet for intermediate heat treatment to the intermediate heat treatment, in which the microstructure of the hot-rolled steel sheet had coarse and aggregated residual austenite. Therefore, in Experimental Example 70 in which the steel sheet 18*a* was subjected to the heat treatment, a lot of coarse and aggregated martensite were formed, resulting in deterioration in toughness.

In the manufacture of the steel sheet a by subjecting the hot-rolled steel sheet to the cold rolling, the steel sheets 1*f* and 3*d* for heat treatment were subjected to the cold rolling at the rolling reduction of more than 10%, however, not subjected to the intermediate heat treatment after the cold rolling, so that a sufficient lath structure was not obtained. Therefore, in Experimental Examples 153 and 154 in which the steel sheets 1*f* and 3*d* were subjected to the heat treatment, a sufficient acicular ferrite was not obtained to deteriorate the strength-formability balance and weldability, and weldability became inferior.

In each of Experimental Examples 2, 4, 5, 17, 19, 21, 50, 52, 60, 62, 89, 92, and 126, the steel sheet for heat treatment (steel sheet a) having a predetermined alloy structure was used, but the heat treatment conditions fell outside the range of the invention, so that sufficient characteristics were not obtained.

In Experimental Example 2, the temperature history did not satisfy the formula (3) in the heating step when the steel sheet 1*a* for heat treatment was subjected to the heat treatment, and the obtained steel sheet had a lot of coarse and aggregated martensite, which did not satisfy the formula (A), resulting in deterioration in toughness.

In Experimental Examples 4 and 50 where the respective steel sheets 1*b* and 19*a* for heat treatment were subjected to the heat treatment, the maximum heating temperature was excessively low in the heating step, so that a large amount of cementite remained undissolved and, consequently, a sufficient strength-formability balance was not obtained.

In Experimental Examples 5 and 92 where the respective steel sheets 1*b* and 35*a* for heat treatment were subjected to the heat treatment, the maximum heating temperature in the heating step was excessively high, so that sufficient acicular ferrite was not obtained to deteriorate the strength-formability balance and weldability, and toughness was also deteriorated since coarse aggregated martensite increased as the acicular ferrite decreased.

In Experimental Example 52 where the steel sheet 19*b* for heat treatment was subjected to the heat treatment, the retention time at the maximum heating temperature in the heating step was excessively long, so that a sufficient amount of acicular ferrite was not obtained to deteriorate the strength-formability balance and weldability, and toughness was also deteriorated since coarse aggregated martensite increased as the acicular ferrite decreased.

In Experimental Examples 19, 62 and 89 where the respective steel sheets 3*b*, 24*a* and 34*a* for heat treatment were subjected to the heat treatment, the average cooling rate for cooling from 700 degrees C. to 550 degrees C. in the cooling step was excessively low. Since acicular ferrite was decreased, the strength-formability balance and weldability were deteriorated.

In Experimental Examples 21 and 60 where the steel sheets 3*c* and 23 for heat treatment were subjected to the heat treatment, the formula (4) was not satisfied in the cooling step. Since bainite transformation proceeded excessively to concentrate carbons in untransformed austenite, a large amount of residual austenite was present in the steel sheet after the heat treatment, resulting in deterioration of toughness.

In Experimental Examples 17 and 126 where the steel sheets 3*a* and 48*a* for heat treatment were subjected to the heat treatment, the formula (5) was not satisfied in the cooling step. Since pearlite was excessively formed, a sufficient amount of martensite was not obtained, resulting in a significant deterioration in strength.

Among the steel sheets whose properties are shown in Tables 22 to 29, the steel sheets except for the above steel sheets in Comparatives are high-strength steel sheets having excellent formability, toughness, and weldability satisfying the conditions of the invention.

In particular, in Experimental Examples 1, 3, 8, 16, 30, 32, 41, 42, 46, 56, 57, 67, 71, 77, 88, 93, 94, 98, 100, 102, 103, 109, 113, 114, 117, 119, 122, 129, 132, and 136, the steel sheets for heat treatment were subjected to an appropriate heat treatment to cause martensitic transformation, and, subsequently, subjected to the tempering treatment to make martensite tough tempered-martensite. Thus properties were significantly improved.

In Experimental Examples 31, 99, and 116, the high-strength steel sheets after the heat treatment were subjected to electroplating. In Experimental Example 119, the steel sheet after the tempering treatment was subjected to electroplating. In Experimental Examples 93 and 103, the steel sheets after the heat treatment were subjected to electroplating, and subsequently, subjected to the tempering treatment.

Experimental Examples 9, 32 and 55 each show a high-strength hot-dip galvanized steel sheet obtained by immersing the steel sheet in a zinc bath immediately after dwelling from 550 degrees C. to 300 degrees C., and subsequently cooling the steel sheet to the room temperature in the heat treatment process. In particular, in Experimental Example 32, the steel sheet after being cooled to the room temperature was further subjected to the tempering treatment.

Experimental Examples 20, 91, 102 and 118 each show a high-strength hot-dip galvanized steel sheet obtained by, in the heat treatment process, cooling the steel sheet from 700 degrees C. to 550 degrees C., and subsequently immersing the steel sheet in a zinc bath immediately before dwelling in a range from 550 degrees C. to 300 degrees C. In particular, in Experimental Example 102, the steel sheet after being cooled to the room temperature was further subjected to the tempering treatment.

Experimental Examples 3, 54 and 121 each show a high-strength galvannealed steel sheet obtained by, in the heat treatment process, immersing the steel sheet in a zinc bath immediately after dwelling in a range from 550 degrees C. to 300 degrees C., further heating the steel sheet for the alloying treatment, and subsequently cooling the steel sheet to the room temperature. In particular, in Experimental Example 3, the steel sheet after being cooled to the room temperature was further subjected to the tempering treatment.

Experimental Examples 72, 75, 94 and 125 each show a high-strength galvannealed steel sheet obtained by, in the heat treatment process, cooling the steel sheet from 700 degrees C. to 550 degrees C., subsequently immersing the steel sheet in a zinc bath immediately before dwelling in a range from 550 degrees C. to 300 degrees C., and further heating the steel sheet for the alloying treatment. In particular, in Experimental Example 94, the steel sheet after being cooled to the room temperature was further subjected to the tempering treatment.

Experimental Examples 87, 100 and 106 each show a high-strength galvannealed steel sheet obtained by, in the heat treatment process, immersing the steel sheet in a zinc bath during dwelling in a range from 550 degrees C. to 300 degrees C., and further heating the steel sheet for the alloying treatment. In particular, in Experimental Example 100, the steel sheet after being cooled to the room temperature was further subjected to the tempering treatment.

Experimental Examples 67 and 132 each show a high-strength hot-dip galvannealed steel sheet obtained by immersing the steel sheet in a zinc bath during the heating in the tempering treatment, and subsequently, performing the alloying treatment and the tempering treatment at the same time.

As described above, according to the invention, a high-strength steel sheet excellent in formability, toughness and weldability can be provided. Since the high-strength steel sheet of the invention is a steel sheet suitable for a significant weight reduction in an automobile, the invention is highly applicable to the steel sheet manufacturing industry and the automobile industry.

The invention claimed is:

1. A steel sheet comprising a chemical composition comprising: by mass %,

C in a range from 0.05 to 0.30%;
Si of 2.50% or less;
Mn in a range from 0.50 to 3.50%;
P of 0.100% or less;
S of 0.0100% or less;
Al in a range from 0.001 to 2.000%;
N of 0.0150% or less;
O of 0.0050% or less; and
the balance consisting of Fe and inevitable impurities,
the steel sheet comprising a microstructure in a region from ⅛t to ⅜ t from a steel sheet surface, the microstructure comprising: by volume %,
acicular ferrite of 20% or more;
martensite of 10% or more;
polygonal ferrite of 20% or less;
residual austenite of 2.0% or less; and
5% or less of a structure other than a structure comprising bainite and bainitic ferrite in addition to the above whole structure, wherein
the martensite satisfies a formula (A) below, $$\sum_{i=1}^{5} \frac{d_i}{a_i^{1.5}} \leq 10.0 \quad \text{(A)}$$

where: t represents sheet thickness, $d_i$ represents a circle-equivalent diameter in μm of the i-th largest island-shaped martensite in the microstructure in the region of ⅛ t to ⅜ t, and $a_i$ represents an aspect ratio of the i-th largest island-shaped martensite in the microstructure in the region of ⅛ t to ⅜ t.

2. The steel sheet according to claim 1, wherein the chemical composition further comprises: by mass %, in place of a part of Fe, one or more of Ti of 0.30% or less, Nb of 0.10% or less, and V of 1.00% or less.

3. The steel sheet according to claim 1, wherein the chemical composition further comprises: by mass %, in place of a part of Fe, one or more of Cr of 2.00% or less, Ni of 2.00% or less, Cu of 2.00% or less, Mo of 1.00% or less, W of 1.00% or less, B of 0.0100% or less, Sn of 1.00% or less, and Sb of 0.20% or less.

4. The steel sheet according to claim 1, wherein
the chemical composition further comprises: by mass %, in place of a part of Fe, one or more of Ca, Ce, Mg, Zr, La, Hf, and REM at 0.0100% or less in total.

5. The steel sheet according to claim 1, wherein
martensite of the microstructure comprises, by volume %, 30% or more of tempered martensite where fine carbides having an average diameter of 1.0 μm or less are precipitated with reference to the entire martensite.

6. The steel sheet according to claim 1, wherein
the steel sheet comprises a galvanized layer or a zinc alloy plated layer on one surface or both surfaces of the steel sheet.

7. The steel sheet according to claim 6, wherein
the galvanized layer or the zinc alloy plated layer is an alloyed plated layer.

8. A method of manufacturing the steel sheet according to claim 1, the manufacturing method comprising:
subjecting a steel piece to hot rolling, completing the hot rolling at a temperature in a range from 850 degrees C. to 1050 degrees C. to provide a steel sheet after the hot rolling, wherein the steel piece has a chemical composition comprising: by mass %,
C in a range from 0.05 to 0.30%;
Si of 2.50% or less;
Mn in a range from 0.50 to 3.50%;
P of 0.100% or less;
S of 0.0100% or less;
Al in a range from 0.001 to 2.000%;
N of 0.0150% or less;
O of 0.0050% or less; and the balance consisting of Fe and inevitable impurities, cooling the steel sheet after the hot rolling at an average cooling rate of at least 30 degrees C. per second from 850 degrees C. to 550 degrees C., winding the steel sheet at a temperature equal to or less than a Bs point that is a bainite transformation start point defined according to a formula below, cooling the steel sheet after the hot rolling in a range from the Bs point to a point of (the Bs point−80) degrees C. under conditions satisfying a formula (1) below to provide a hot-rolled steel sheet, subjecting or not subjecting the hot-rolled steel sheet to cold rolling at a rolling reduction of 10% or less to manufacture a steel sheet for heat treatment, heating the steel sheet for heat treatment to a temperature in a range from (Ac1+25) degrees C. to an Ac3 point under conditions satisfying a formula (3) below for calculating by dividing an elapsed time in a temperature region from 700 degrees C. to an end point that is a lower one of a maximum heating temperature or (Ac3−20) degrees C. into 10 parts, retaining the steel sheet for 150 seconds or less in a temperature region from the maximum heating temperature minus 10 degrees C. to the maximum heating temperature, cooling the steel sheet from a heating retention temperature at an average cooling rate of at least 25 degrees C. per second in a temperature region from 700 degrees C. to 550 degrees C., and cooling the steel sheet in a limited range satisfying formulae (4) and (5) below for calculating by dividing a dwell time in a temperature region from a start point that is a lower one of 550 degrees C. or the Bs point to 300 degrees C. into 10 parts, Bs point in degrees C=611−33·[Mn]−17·[Cr]
−17·[Ni]−21·[Mo]−11·[Si]
+30·[Al]+(24·[Cr]+15·[Mo]
+5500·[B]+240·[Nb])/(8·[C])

[element]: mass % of each element $$\sum_{n=1}^{8}\Big\{5.37\times10^{-1}\cdot(10n+925-Bs-57W_{Cr}-78W_{Mn}-39W_{Si}+56W_{Al}-41W_{Ni}-1598\sqrt{W_B})^{2.5}\cdot\exp\left(\frac{1.44\times10^4}{10n-Bs-278}\right)\cdot\exp(-5.5W_{Nb}-2.0W_{Ti}-0.2W_{Cr}-1.1W_{Mo})\cdot\Delta t(n)^{1/3}+1.81\times10^1\cdot(10n-5)^{1.3}\cdot\exp\left(\frac{1.73\times10^4}{10n-Bs-278}\right)\cdot\exp\left(-1.1W_{Mo}-0.6W_{Cr}-9.0\sqrt{W_B}\right)\cdot\Delta t(n)^{1/2}\Big\}\le1.50 \quad (1)$$

Bs: Bs point in degrees C., $W_M$: a composition of each element in mass %,

Δt(n): an elapsed time in seconds from (Bs−10×(n−1)) degrees C. to (Bs−10×n) degrees C. in a duration from the cooling after the hot rolling, through the winding, to the cooling to 400 degrees C., $$\sum_{n=1}^{10}8.65\times10^2\cdot(W_{Mn}+0.51W_{Cr}+0.51W_{Ni}-0.64W_{Mo}-0.33W_{Si}+0.90W_{Al})^{0.5}\cdot f_\gamma(n)^{0.2}\cdot(1-f_\gamma(n))^{1.8}\cdot\exp\left(-\frac{9.00\times10^3}{T(n)+273}\right)\cdot\Delta t^{0.33}\le2.0 \quad (3)$$

Δt: one tenth in seconds of the elapsed time, $W_M$: a composition of each element in mass %, fγ(n): an average reverse transformation ratio in the n-th section, and T(n): an average temperature in degrees C. in the n-th section, $$\sum_{n=1}^{10}\left\{1.39\times10^1\cdot(Bs-T(n))^3\cdot\exp\left(-\frac{1.44\times10^4}{T(n)+273}\right)\cdot\Delta t^{0.5}\right\}\le1.0 \quad (4)$$

$$\sum_{n=1}^{10}\left\{1.56\times10^2\cdot\left(W_{Si}+0.9W_{Al}\cdot\left(\frac{T(n)}{550}\right)^2+0.3(W_{Cr}+W_{Mo})\cdot\frac{T(n)}{550}\right)\cdot\exp\left(-6.7\cdot\left(1-\frac{T(n)}{550}\right)\right)\cdot\left(\frac{T(n)-250}{300}\right)^{0.5}\cdot(Bs-T(n))^3\cdot\exp\left(-\frac{1.44\times10^4}{T(n)+273}\right)\times\Delta t^{0.5}\right\}\le1.0 \quad (5)$$

Δt: one tenth in seconds of the elapsed time,

Bs: Bs point in degrees C.,

T(n): an average temperature in degrees C. in the n-th section, and $W_M$: a composition of each element in mass %.

9. A method of manufacturing the steel sheet according to claim 1, the manufacturing method comprising:

subjecting a steel piece to hot rolling, completing the hot rolling at a temperature in a range from 850 degrees C. to 1050 degrees C. to provide a steel sheet after the hot rolling, wherein the steel piece has a chemical composition comprising: by mass %, C in a range from 0.05 to 0.30%;

Si of 2.50% or less;

Mn in a range from 0.50 to 3.50%;

P of 0.100% or less;

S of 0.0100% or less;

Al in a range from 0.001 to 2.000%;

N of 0.0150% or less;

O of 0.0050% or less; and the balance consisting of Fe and inevitable impurities, cooling the steel sheet after the hot rolling from 850 degrees C. to 550 degrees C. at an average cooling rate of at least 30 degrees C. per second, winding the steel sheet at a temperature equal to or less than a Bs point that is a bainite transformation start point defined according to a formula below, cooling the steel sheet after the hot rolling from the Bs point to a point of (the Bs point−80) degrees C. under conditions satisfying a formula (1) below to provide a hot-rolled steel sheet, subjecting or not subjecting the hot-rolled steel sheet to a first cold rolling to manufacture a steel sheet for intermediate heat treatment, heating the steel sheet for intermediate heat treatment to a temperature equal to or more than (Ac3−20) degrees C. under conditions satisfying a formula (2) below for calculating by dividing an elapsed time in a temperature region from 700 degrees C. to (Ac3−20) degrees C. into 10 parts, subsequently, cooling the steel sheet for intermediate heat treatment from the heating temperature at an average cooling rate of at least 30 degrees C. per second in a temperature region from 700 degrees C. to 550 degrees C., cooling the steel sheet for intermediate heat at the average cooling rate of at least 20 degrees C. per second in a temperature region from the Bs point to (Bs−80) degrees C., and leaving the steel sheet for intermediate heat from (Bs−80) degrees C. to an Ms point for a dwell time of at most 1000 seconds and from the Ms point to (Ms−50) degrees C. at the average cooling rate of at most 100 degrees C. per second to manufacture an intermediate heat-treated steel sheet, subjecting or not subjecting the cooled intermediate heat-treated steel sheet to a second cold rolling at a rolling reduction of 10% or less to manufacture a steel sheet for heat treatment, heating the steel sheet for heat treatment to a temperature in a range from (Ac1+25) degrees C. to an Ac3 point under conditions satisfying a formula (3) below for calculating by dividing an elapsed time in a temperature region from 700 degrees C. to an end point that is a lower one of a maximum heating temperature or (Ac3−20) degrees C. into 10 parts, and retaining the steel sheet for 150 seconds or less in a temperature region from the maximum heating temperature minus 10 degrees C. to the maximum heating temperature, cooling the steel sheet from a heating retention temperature at an average cooling rate of at least 25 degrees C. per second in a temperature region from 700 degrees C. to 550 degrees C., and cooling the steel sheet in a limited range satisfying formulae (4) and (5) below for calculating by dividing a dwell time in a temperature region from a start point that is a lower one of 550 degrees C. or the Bs point to 300 degrees C. into 10 parts, Bs point in degrees C=611−33·[Mn]−17·[Cr]
−17·[Ni]−21·[Mo]−11·[Si]
+30·[Al]+(24·[Cr]+15·[Mo]
+5500·[B]+240·[Nb])/(8·[C])
[element]: mass % of each element, $$\sum_{n=1}^{8}\{5.37\times10^{-1}\cdot(10n+925-Bs-57W_{Cr}-78W_{Mn}-39W_{Si}+56W_{Al}-41W_{Ni}-1598\sqrt{W_B})^2\cdot\exp\left(\frac{1.44\times10^4}{10n-Bs-278}\right)\exp(-5.5W_{Nb}-2.0W_{Ti}-0.2W_{Cr}-1.1W_{Mo})\cdot\Delta t(n)^{1/3}+1.81\times10^1\cdot(10n-5)^{1.3}\cdot\exp\left(\frac{1.73\times10^4}{10n-Bs-278}\right)\cdot\exp(-1.1W_{Mo}-0.6W_{Cr}-9.0\sqrt{W_B})\cdot\Delta t(n)^{1/2}\}\le1.50 \quad (1)$$

Bs: Bs point in degrees C., $W_M$: a composition of each element in mass %,

Δt(n): an elapsed time in seconds from (Bs−10×(n−1)) degrees C. to (Bs−10×n) degrees C. in a duration from the cooling after the hot rolling, through winding, to the cooling to 400 degrees C., Ms point in degrees C=561−474[C]−33·[Mn]
−17·[Cr]−17·[Ni]−21·[Mo]
−11·[Si]+30·[Al]
[element]: mass % of each element, $$\sum_{n=1}^{10}5.92\times10^2\cdot f_\gamma(n)^{0.3}\cdot(1-f_\gamma(n))^{14}\cdot\exp\left(-\frac{9.00\times10^3}{T(n)+273}\right)\cdot\Delta t^{0.5}\le1.0 \quad (2)$$

Δt: one tenth in seconds of the elapsed time, $f_\gamma(n)$: an average reverse transformation ratio in the n-th section, and T(n): an average temperature in degrees C. in the n-th section, $$\sum_{n=1}^{10}8.65\times10^2\cdot(W_{Mn}+0.51W_{Cr}+0.51W_{Ni}-0.64W_{Mo}-0.33W_{Si}+0.90W_{Al})^{0.5}\cdot f_Y(n)^{0.5}\cdot(1-f_Y(n))^{1.8}\cdot\exp\left(-\frac{9.00\times10^3}{T(n)+273}\right)\cdot\Delta t^{0.33}\le2.0 \quad (3)$$

Δt: one tenth in seconds of the elapsed time, $W_M$: a composition of each element in mass %, fγ(n): an average reverse transformation ratio in the n-th section, and T(n): an average temperature in degrees C. in the n-th section, $$\sum_{n=1}^{10}\left\{1.39\times10^1\cdot(Bs-T(n))^3\cdot\exp\left(-\frac{1.44\times10^4}{T(n)+273}\right)\Delta t^{0.5}\right\}\le1.0 \quad (4)$$

$$\sum_{n=1}^{10}\left\{1.56\times10^2\cdot\left(W_{Si}+0.9W_{Al}\cdot\left(\frac{T(n)}{550}\right)^2+0.3(W_{Cr}+W_{Mo})\cdot\frac{T(n)}{550}\right)\cdot\exp\left(-6.7\cdot\left(1-\frac{T(n)}{550}\right)\right)\cdot\left(\frac{T(n)-250}{300}\right)^{0.5}\cdot(Bs-T(n))^3\cdot\exp\left(-\frac{1.44\times10^4}{T(n)+273}\right)\cdot\Delta t^{0.5}\right\}\le1.0 \quad (5)$$

Δt: one tenth in seconds of the elapsed time,

Bs: Bs point in degrees C.,

T(n): an average temperature in degrees C. in the n-th section, and $W_M$: a composition of each element in mass %.

10. The method according to claim 8, further comprising a tempering treatment of heating the steel sheet for heat treatment to a temperature in a range from 200 degrees C. to 600 degrees C., after cooling the steel sheet in a limited range satisfying the formulae (4) and (5) for calculating by dividing a dwell time in a temperature region from a start point that is a lower one of 550 degrees C., and the Bs point to 300 degrees C. into 10 parts.

11. The method according to claim 8, comprising:

immersing the steel sheet in a plating bath including zinc as a main component during dwelling in a range from 550 degrees C. to 300 degrees C. to form a galvanized layer or a zinc alloy plated layer on one surface or both surfaces of the steel sheet, to obtain a steel sheet comprising the galvanized layer or the zinc alloy plated layer on one surface or both surfaces of the steel sheet.

12. The method according to claim 8, comprising:

leaving the steel sheet dwelling in a range from 550 degrees C. to 300 degrees C., cooling the steel sheet to a room temperature, and subsequently forming a galvanized layer or a zinc alloy plated layer by electroplating on one surface or both surfaces of the steel sheet, to obtain a steel sheet comprising the galvanized layer or the zinc alloy plated layer on one surface or both surfaces of the steel sheet.

13. The method according to claim 10, further comprising temper rolling at a rolling reduction of 2.0% or less before the tempering treatment.

14. The method according to claim 10,
comprising
immersing the steel sheet in a plating bath including zinc as a main component during the tempering treatment to form a galvanized layer or a zinc alloy plated layer on one surface or both surfaces of the steel sheet.

15. The method according to claim 10,
comprising:
subjecting the steel sheet to the tempering treatment, cooling the steel sheet to a room temperature, and subsequently forming a galvanized layer or a zinc alloy plated layer by electroplating on one surface or both surfaces of the steel sheet, to obtain a steel sheet comprising the galvanized layer or the zinc alloy plated layer on one surface or both surfaces of the steel sheet.

16. The method according to claim 12,
comprising:
a tempering treatment of heating the steel sheet for heat treatment to a temperature in a range from 200 degrees C. to 600 degrees C., after cooling the steel sheet in a limited range satisfying the formulae (4) and (5) for calculating by dividing a dwell time in a temperature region from a start point that is a lower one of 550 degrees C., and the Bs point to 300 degrees C. into 10 parts, and
setting a heating temperature of the plated layer or the zinc alloy plated layer to a temperature in a range from 450 degrees C. to 550 degrees C. in the tempering treatment to perform an alloying treatment on the galvanized layer or the zinc alloy plated layer.

17. The method according to claim 14,
comprising:
setting a heating temperature of the plated layer or the zinc alloy plated layer to a temperature in a range from 450 degrees C. to 550 degrees C. in the tempering treatment to perform an alloying treatment on the galvanized layer or the zinc alloy plated layer.

18. The method according to claim 15,
comprising:
immersing the steel sheet in a plating bath, subsequently while leaving the steel sheet dwelling from 300 degrees C. to 550 degrees C., heating the galvanized layer or the zinc alloy plated layer to a temperature in a range from 450 degrees C. to 550 degrees C. to perform an alloying treatment on the galvanized layer or the zinc alloy plated layer to form an alloyed plated layer.

19. The method according to claim 9, wherein the first cold rolling for the steel sheet for heat treatment is performed at the rolling reduction of 80% or less.

20. The method according to claim 9, wherein the first cold rolling for the steel sheet for heat treatment is performed at the rolling reduction of more than 10%.

21. The method according to claim 9, further comprising a tempering treatment of heating the steel sheet for heat treatment to a temperature in a range from 200 degrees C. to 600 degrees C., after cooling the steel sheet in a limited range satisfying the formulae (4) and (5) for calculating by dividing a dwell time in a temperature region from a start point that is a lower one of 550 degrees C., and the Bs point to 300 degrees C. into 10 parts.

22. The method according to claim 9,
comprising:
immersing the steel sheet in a plating bath including zinc as a main component during dwelling in a range from 550 degrees C. to 300 degrees C. to form a galvanized layer or a zinc alloy plated layer on one surface or both surfaces of the steel sheet.

23. The method according to claim 9,
comprising:
leaving the steel sheet dwelling in a range from 550 degrees C. to 300 degrees C., cooling the steel sheet to a room temperature, and subsequently forming a galvanized layer or a zinc alloy plated layer by electroplating on one surface or both surfaces of the steel sheet.

24. The method according to claim 21, further comprising temper rolling at a rolling reduction of 2.0% or less before the tempering treatment.

25. The method according to claim 21,
comprising:
immersing the steel sheet in a plating bath including zinc as a main component during the tempering treatment to form a galvanized layer or a zinc alloy plated layer on one surface or both surfaces of the steel sheet, to obtain a steel sheet comprising the galvanized layer or the zinc alloy plated layer on one surface or both surfaces of the steel sheet.

26. The method according to claim 21,
comprising:
subjecting the steel sheet to the tempering treatment, cooling the steel sheet to a room temperature, and subsequently forming the galvanized layer or the zinc alloy plated layer by electroplating on one surface or both surfaces of the steel sheet, to obtain a steel sheet comprising the galvanized layer or the zinc alloy plated layer on one surface or both surfaces of the steel sheet.

27. The method according to claim 23,
comprising:
a tempering treatment of heating the steel sheet for heat treatment to a temperature in a range from 200 degrees C. to 600 degrees C. after cooling the steel sheet in a limited range satisfying the formulae (4) and (5) for calculating by dividing a dwell time in a temperature region from a start point that is a lower one of 550 degrees C., and the Bs point to 300 degrees C. into 10 parts, and
setting a heating temperature of the plated layer or the zinc alloy plated layer to a temperature in a range from 450 degrees C. to 550 degrees C. in the tempering treatment to perform an alloying treatment on the galvanized layer or the zinc alloy plated layer.

28. The method according to claim 25,
comprising:
setting a heating temperature of the plated layer or the zin alloy plated layer to a temperature in a range from 450 degrees C. to 550 degrees C. in the tempering treatment to perform an alloying treatment on the galvanized layer or the zinc alloy plated layer.

29. The method according to claim 26,
comprising:
immersing the steel sheet in a plating bath, subsequently while leaving the steel sheet dwelling from 300 degrees C. to 550 degrees C., heating the galvanized layer or the zinc alloy plated layer to a temperature in a range from 450 degrees C. to 550 degrees C. to perform an alloying treatment on the galvanized layer or the zinc alloy plated layer.

* * * * *